US011356791B2

(12) United States Patent
Torres Ayala et al.

(10) Patent No.: US 11,356,791 B2
(45) Date of Patent: Jun. 7, 2022

(54) VECTOR AUDIO PANNING AND PLAYBACK SYSTEM

(71) Applicants: Gilberto Torres Ayala, Guadalajara (MX); Sonia Gladys Luque Vela, La Molina (PE)

(72) Inventors: Gilberto Torres Ayala, Guadalajara (MX); Sonia Gladys Luque Vela, La Molina (PE)

( * ) Notice: Subject to any disclaimer, the term of this patent is extended or adjusted under 35 U.S.C. 154(b) by 0 days.

(21) Appl. No.: 16/725,024

(22) Filed: Dec. 23, 2019

(65) Prior Publication Data

US 2020/0213801 A1 Jul. 2, 2020

Related U.S. Application Data

(60) Provisional application No. 62/785,457, filed on Dec. 27, 2018.

(51) Int. Cl.
*H04S 7/00* (2006.01)
*H04S 3/00* (2006.01)
*G10L 19/008* (2013.01)

(52) U.S. Cl.
CPC ..... *H04S 7/303* (2013.01); *G10L 19/008* (2013.01); *H04S 3/008* (2013.01); *H04S 2400/01* (2013.01); *H04S 2420/01* (2013.01)

(58) Field of Classification Search
CPC ..... H04S 7/303; H04S 3/008; H04S 2400/01; H04S 2420/01; G10L 9/008
USPC ..... 381/20–23, 309, 310
See application file for complete search history.

(56) References Cited

U.S. PATENT DOCUMENTS 8,126,172 B2 * 2/2012 Horbach ..... H04S 7/302 381/303
8,249,283 B2 * 8/2012 Ando ..... H04S 7/308 381/306
9,554,227 B2 1/2017 Kim
2005/0157883 A1 * 7/2005 Herre ..... H04S 3/02 381/17
2009/0150163 A1 6/2009 Martin
2010/0119092 A1 * 5/2010 Kim ..... H04S 3/008 381/306

(Continued)

FOREIGN PATENT DOCUMENTS

WO WO2016/147125 A1 9/2016

*Primary Examiner* — Xu Mei
(74) *Attorney, Agent, or Firm* — Knobbe Martens Olson & Bear LLP

(57) ABSTRACT

The present disclosure describes a method and a system of panning and vector reproduction of 4 audio channels, which is based on what in this document is defined as a vector panning, which allows audio panning that is not limited to placing sounds on a simple horizontal line, said vector panning, creates an audio image within a panoramic field delimited by X and Y axes. Said audio image is structured on 8 stereo panning lines which in turn allow us to place sounds in at least 25 panning points. The present disclosure comprises a vector audio reproduction equipment, which must have certain specific characteristics for the proper functioning of the disclosure, such as using only mono audio reproduction systems, same which must emit a full frequency range each, among other characters Energetic, which can be positioned in a configuration of specific angles and distances in relation to the listener in 3 different embodiments.

21 Claims, 30 Drawing Sheets

(56) References Cited

U.S. PATENT DOCUMENTS

| | | | | |
|---|---|---|---|---|
| 2016/0044433 | A1* | 2/2016 | Tsingos | H04S 3/002 381/307 |
| 2017/0249946 | A1 | 8/2017 | Borsum | |
| 2018/0184224 | A1 | 6/2018 | Mcgrath | |
| 2020/0204939 | A1* | 6/2020 | Kim | H04S 3/008 |

* cited by examiner

PRIOR ART 5.1

| Coordinates for Spatial Location points | | | | |
|---|---|---|---|---|
| 1) (-2,2) | 6) (-2,1) | 11) (-2,0) | 16) (-2,-1) | 21) (-2,-2) |
| 2) (-1,2) | 7) (-1,1) | 12) (-1,0) | 17) (-1,-1) | 22) (-1,2) |
| 3) (0,2) | 8) (0,1) | 13) (0,0) | 18) (0,-1) | 23) (0,2) |
| 4) (1,2) | 9) (1,1) | 14) (1,0) | 19) (1,-1) | 24) (1,-2) |
| 5) (2,2) | 10) (2,1) | 15) (2,0) | 20) (2,-1) | 25) (2,-2) |

Spatial location points

Wherein $\triangle Z_2$ C $=$ D E $\triangle X_2$ $\triangle Y_2$ A B

FIG. 25

Wherein $\triangle Z_3$ C $=$ D E $\triangle X_3$ $\triangle Y_3$ A B

FIG. 26

Sound level $L$ and Distance $r$ $$L_2 = L_1 - \left|20 \cdot \log\left(\frac{r_1}{r_2}\right)\right| \qquad L_2 = L_1 - \left|10 \cdot \log\left(\frac{r_1}{r_2}\right)^2\right|$$

$$r_2 = r_1 \cdot 10^{\left(\frac{|L_1 - L_2|}{20}\right)} \qquad r_1 = \frac{r_2}{10^{\left(\frac{|L_1 - L_2|}{20}\right)}}$$

FIG. 37

VECTOR AUDIO PANNING AND PLAYBACK SYSTEM

FIELD

The present disclosure relates to multichannel audio systems, specifically describing a vector audio panning and playback system of 4 audio channels, which will be referred to herein as an audio vector system.

The audio vector system of the present disclosure is capable of offering audio player numerous creative variants in the audio production process, in addition, the listener will be able to perceive exactly where the sounds come from in the acoustic space, their movement, your body and depth, achieving with this, offer the opportunity to create and enjoy new auditory and visual audio experiences.

As an example, and without these applications being limiting, the audio system of the present disclosure is applied in the processes of creation and reproduction of audio in general, music, video audio, mass shows, etc.

BACKGROUND

For a better understanding of the present disclosure, it is necessary first to understand what a stereophonic panning consists of, whereby the nature of a panning in general terms and how a stereophonic panning is performed is briefly described below.

Panning is a technique that is responsible for placing sounds in specific places or giving them movement from one place to another, directing them to different speakers to define a specific location according to the perception of a listener placed in the sweet spot suggested by the playback equipment used.

Sweet spot should be understood as the maximum point of appreciation of the user, either to appreciate an audio or to appreciate a video, and this guarantees to offer the best experience compared to any other point of appreciation. Normally, the sweet spot is located right in front of the audio or video playback equipment and in the middle part of the presentation room since it is usually the location where the audio or video effects can best be appreciated. A person skill in the art may understand that the sweet spot suggested for each audio reproduction equipment will depend on the amount of recorded channels, audio outputs, position of the audio outputs in the physical space, use of subwoofers, etc., therefore, the quality, emotion, and feeling the sound perceived by the listener located in the sweet spot will depend on everything mentioned above.

When talking about a stereophonic panning, this also means that sounds can be placed at a specific point within a linear axis or horizontal linear plane, as well as giving them movement from left to right or vice versa according to the panning the audio producer decides to do. For example, to place a sound in the center of said axis of linear panning, also known as a phantom center, 50% of the sound is sent to the left channel and 50% of the same sound is sent to the right channel. If you want to place a sound completely to the left, 100% of the sound is sent to the left channel and 0% of the same sound is sent to the right channel. In the same way, when placing a sound completely to the right, 100% of the sound is sent to the right channel and 0% of the same sound is sent to the left channel.

In a stereophonic panning, sounds can be placed in a variety of specific points, technically known as panning points. An example of a stereophonic panning line is shown in FIG. 1, will be describing in detail below, which shows 5 preferred audio panning points, although said line may include n quantity of points. Said 5 preferred points are represented as A, B, C, D, E for explanatory purposes of the present disclosure. As an example, to place a sound on said 5 main stereophonic panning points, the following percentages of sound must be assigned in their corresponding left and/or right channels;

Place a sound at the panning point "A" 100% of such sound is sent to the left channel, Place a sound at the panning point "B" 100% of such sound is sent to the right channel.

Place a sound at the panning point "C" 50% of such sound is sent to the left channel and 50% of the same sound is sent to the right channel.

Place a sound at the panning point "D" 75% of such sound is sent to the left channel and 25% of the same sound is sent to the right channel.

Place a sound at the panning point "E", 25% of that sound is sent to the left channel and 75% of the same sound is sent to the right channel.

In accordance with the above, the sound of an instrument can be placed at any of the points "A, B, C, D, E" within the horizontal linear plane of a stereophonic panning, that is, the sound of each instrument can be place on the left side represented at point "A", or at the center represented at point "C", or at any of the other stereophonic panning points.

The multi-channel playback system is the audio playback platform recorded on more than 2 channels, where these audios are played on more than two speakers depending on the number of channels the recording contains. There are several multichannel reproduction systems currently among which are the quadraphonic multichannel systems, the 5.1, 6.1, 7.1, 7.2, and 9.2 surround systems, among others with similar characteristics.

The quadraphonic multi-channel system, also known as the 4-channel or 4.0 multi-channel audio system, reproduces 4 channels in 4 speakers placed at 4 specific points around the listener, forming a horizontal square around the listener. The signals emitted by the 4 speakers are independent of each other. In addition to playing 4 independent channels, the quadraphonic system has its own format, so it can only be played on playback systems compatible with its format. An example of a quadraphonic multi-channel reproduction system is shown in FIG. 2.

On the other hand, the 5.1 playback system, shown in FIG. 3*a*, is a system made up of 5 speakers that emit an audio channel each and each audio channel is independent of the others. Additionally, this system has a sixth speaker that is placed at ground level, this sixth speaker emits the sounds with more serious frequencies and is called a subwoofer, said audio system is called 5.1 because it uses 5 speakers and 1 subwoofer.

It is important to note that the recordings created to be reproduced in 5.1 systems from now on, also have their own format, so they can only be played in the playback systems created for those recordings.

A peculiarity of the 5.1 surround sound systems is that their 5 speakers emit frequency ranges determined according to their position in relation to the listening in the following way: Being 5 speakers, the center speaker emits sounds with medium frequencies that generally come from the voices, the front left and right speakers emit sounds with medium-high frequencies and do not emit serious frequencies, the left and right rear speakers emit sounds with medium-high frequencies that generally come from ambient sounds and finally, the subwoofer placed on the Ground height emits sounds with more serious frequencies, close to 100 Hz.

In the same way as in the previous explanation, system 6.1, shown in FIG. 3*b*, refers to 6 speakers positioned around the listener, which emit medium-high frequencies, as well as using a subwoofer that is placed at the height of the ground and emits sounds with more serious frequencies.

In the system 7.1, shown in FIG. 3*c*, two more speakers are located on the side with respect to the 5.1 system, in the same way, the 7 speakers emit sounds with medium-high frequencies around the ear and the subwoofer placed to the ground height emits the sounds with the most serious frequencies of the recordings.

In the system 7.2, shown in FIG. 3*d*, has the same principles as system 7.1, with 7 speakers positioned around the listening, which emit sounds with medium-high frequencies, the difference is that this system makes use of 2 subwoofers placed at the height of the ground, which emit the sounds with more low frequencies, unlike the 7.1 system that uses only 1 subwoofer.

In the system 9.1, shown in FIG. 3*e*, works like systems 7.1 and 7.2 in such a way that its speakers emit sounds with medium-high frequencies around the listening, the difference is that the eighth and ninth speakers can be positioned at the top front of the listener or, in some cases, even on the front roof. This system still has a subwoofer that is placed at ground level and emits sounds with more low frequencies.

All the multichannel systems mentioned above, perform a multichannel surround sound panning through various types of software, audio sequencers and plugins. However, regardless of the means by which multichannel surround sound panning is performed, said panning is based on an exclusively linear horizontal panning.

As described above, all the audio reproduction systems work through a panning and linear reproduction system, this limits the potential of the sounds, since all the high, medium and low frequencies are confined to the same horizon, as shown in FIG. 4.

It is important to mention that the audio systems described above can therefore be classified as linear systems, because they make use of a single horizontal axis in their audio panning processes, therefore, such systems can be considered as systems of 1D audio The US Patent Application No. US2018/0184224 A1, "AUDIO PANNING TRANSFORMATION SYSTEM AND METHOD" of Dolby Laboratories Licensing Corporation, Published on Jun. 28, 2018, describes a method for generating a multichannel audio signal comprising multiple channels, wherein each channel corresponds to a location on a surface at least one object of an audio input. This method determines through phantom signals the considerations necessary to represent the audio input object and determine the audio channels by panning the phantom signals. Subsequently it combines the audio channels to produce a multichannel audio signal.

Meanwhile, International Patent Application No. WO2016/14715 A1, "APPARATUS FOR TRANSMISSION OF SUBSONIC SOUND WAVES TO THE HUMAN BODY", by Michele Aldini, published on Sep. 22, 2016, describes a multifunctional device for selectively transmitting in the human body subsonic sound waves supplied from a music source. The objective of this disclosure is to provide an apparatus for transmitting, through contact, to the human body musical sound waves, which can be selected and transmitted to certain parts of the human body.

The US Patent Application No. US 2017/0249946 A1, "APPARATUS AND METHOD FOR PROVIDING ENHANCED GUIDED DOWNMIX CAPABILITES FOR 3D AUDIO", by Fraunhofer-Gesellschaftz zur Foerderung der Angewandten Forschung eV, published on Aug. 31, 2017, describes a method to make a mix in such a way that a multi-channel signal can be reduced to a smaller number of speakers, but with information such that the speaker output produces virtual points so that they represent the location of the original signal. An arrangement is also described showing the positions of the actual speakers in which an array of vertical speakers is observed in front of the listener, where the speakers are at different heights.

The US Patent Application No. US 2009/0150163 A1, "METHOD AND APPARATUS FOR MULTICHANNEL UPMIXING AND DOWNMIXING" by Geoffrey Glen Martin, published on Jun. 11, 2009, describes a method and apparatus for combining accurate knowledge about relative speaker positions (virtual speakers) and precise knowledge about the actual location of the speakers in a vector space that allows calculating the corrections of signal movement used to simulate the presence of virtual speakers.

Finally, U.S. Pat. No. 9,554,227 B2 "METHOD AND APPARATUS FOR PROCESSING AUDIO SIGNAL" of Samsung Electronics Co., published on Jan. 24, 2017, describes an apparatus for processing an audio signal comprising a unit of indexing estimate that receives information from a three-dimensional image as an input and generates indexed information to apply a three-dimensional effect to an audio object in at least one direction of the right, left, top, bottom, front and back directions, based in the three-dimensional image information, and a reproduction unit to apply a three-dimensional effect to the audio object in at least one direction of the right, left, upper, lower, front and rear directions, based on the indexed information.

In a novel way, the vector audio system of the present disclosure makes use of 2 axes in its audio panning process, a horizontal axis and a vertical axis, therefore, the present disclosure can be considered as a 2D audio system, which in addition to offering the technical advantages described in detail in the detailed description on 1D systems, has the advantage of being much simpler to operate and requiring much less resources than a system at the other end of the spectrum such as those They use 3 axes in their audio panning processes, one horizontal, one vertical and one that marks the depth.

The prior art documents identified fail to describe a vector panning system, a vector audio reproduction system and a frequency offset method such as those described in this application, with the use of 4 channels and two panning axes. which allows obtaining the values assigned by the present disclosure in said panning axes.

Also, the prior art discloses various speaker arrangements for audio reproduction, where the speakers can be placed at different heights; however, in most of these examples, listening is always in front of the speaker array without the possibility of obtaining efficient variables based on the listening position. For example, the state of the art does not describe or suggest an arrangement where the speakers placed on the left side are placed in front of the speakers on the right side and where the listening is in the middle of the left and right speakers.

The use of a frequency offset to calibrate the frequencies that will be emitted by the speakers increasing the power of the treble so that these increased treble frequencies gradually decrease as the sound moves upwards within a vector panning system, nor was it described far from suggested by the state of the art. In a novel way, the vector audio system of the present disclosure makes use of 2 axes in its processes of panning and audio reproduction, a horizontal axis and a vertical axis, therefore, the present disclosure can be considered as a system of 2D audio A person skilled in the art would therefore not have any motivation to modify a 1D system towards a 2D system using mono outputs, nor motivation to modify a 3D system towards a 2D one.

SUMMARY

The present disclosure relates to a multichannel audio system, specifically to a panning and vector reproduction system of 4 audio channels, which has its own vector panning, a unique format and its own playback and/or recording equipment of vector audio, as well as means to perform them.

The vector panning of the present disclosure, unlike a stereophonic panning, allows audio panning that is not limited to placing sounds on a simple horizontal line, therefore, said vector panning releases sounds with any range of frequencies to that can occupy any selected location in the acoustic space of the listener. An example of the above described is shown in FIG. 5.

The audio system of the present application achieves said vector panning and creates an "audio image" in which the horizontal and vertical appreciation of the sounds in the acoustic space of the listening is broadened, specifically within a panoramic field delimited by X-axis. and Y. Said audio image is structured on 8 stereophonic panning lines which in turn allow sounds to be placed in at least 25 panning points.

The audio system of the present disclosure is based on a vector panning table of the present application, which represents the basis of the technique for placing a sound at any of the at least 25 panning points mentioned above. making use of 1, 2 or 4 of the corresponding audio channels of the present disclosure and their sound percentages.

The audio system of the present disclosure incorporates examples, which are not limiting thereof, on at least a couple of panning controls, which can be added to each line or audio track of a physical or virtual mixer (described below), wherein said at least two panning controls will serve to grant the horizontal and vertical location of a sound within the mentioned panoramic field delimited by its X and Y axes.

Additionally, the audio system of the present disclosure incorporates by way of example, without limitation, at least one electronic circuit suitable for regulating the functionality of said at least one pair of panning controls.

The audio system of the present application also comprises by way of example, without limitation, at least a Virtual Studio Technology (VST) plug-in to be executed in the confines of a music sequencer or Digital Audio Workstation (DAW), where said plug-in must comprise at least 2 virtual horizontal and vertical panning axes to place each sound within the mentioned panoramic field delimited by its X and Y axes.

In the scope of the present disclosure, a method of real-time vector panning is also proposed in an audio production, wherein said real-time vector panning consists of capturing the sound with its location that is perceived in a panoramic image within A real physical space.

Additionally, the present disclosure also considers a method for performing a frequency adjustment, which consists in increasing the high frequencies at the outputs of the 2 lower channels vectorized by means of a physical mixer or by means of a digital mixer.

An integral part of the present disclosure also includes a method of encoding and decoding by using a multimedia file player to create and reproduce a unique audio format.

Additionally, the present disclosure comprises a vector audio reproduction equipment, which uses only mono audio reproduction systems, which can be positioned in a specific angle and distance configuration in relation to listening in 3 different modes, to emit a range full frequency, which will be described in detail later.

These and other advantages of the present disclosure will be better understood by the description detailed below, in conjunction with the accompanying drawings.

Figure 15:
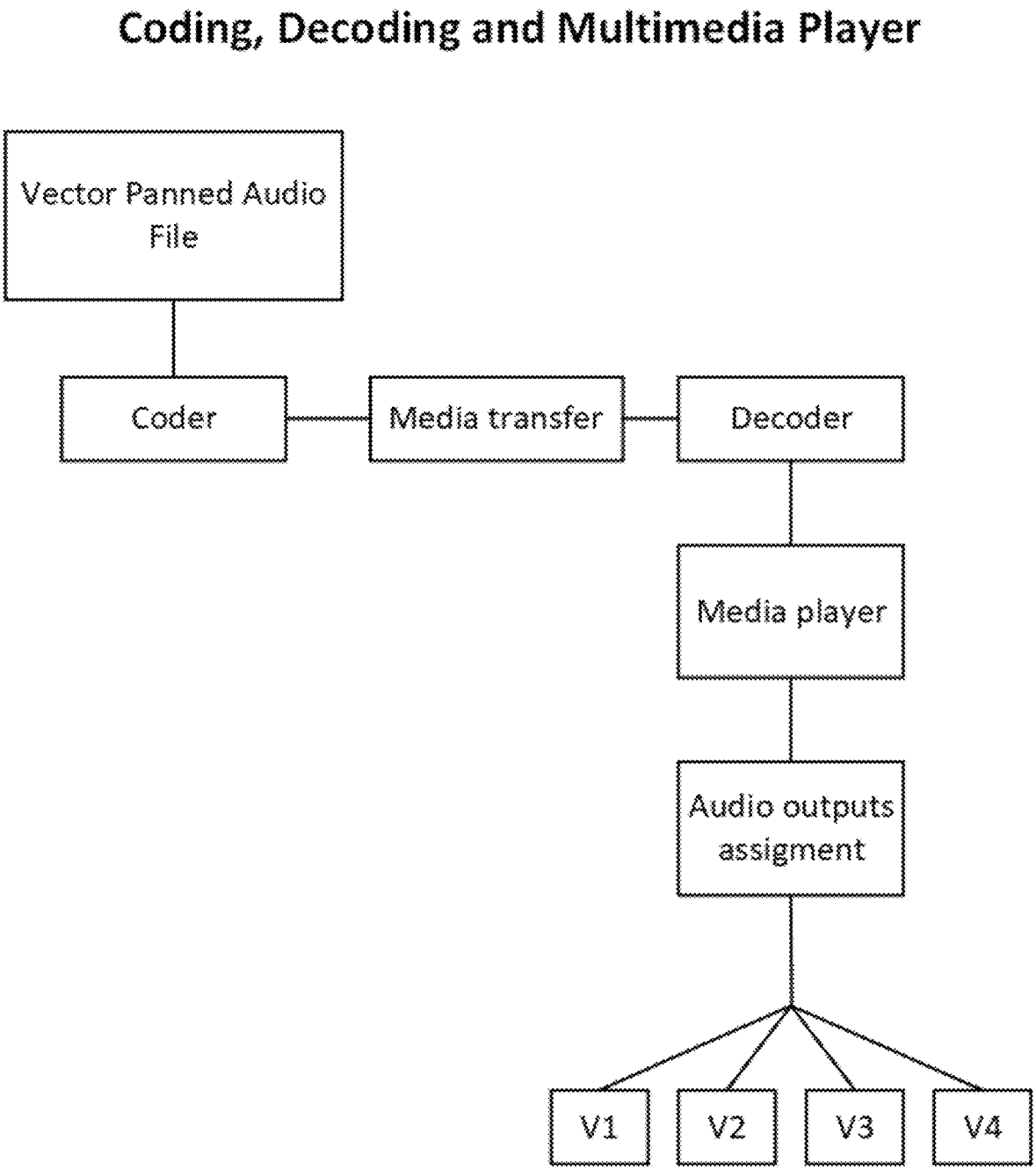

The FIG. 15, shows a flow chart showing the generalities of the method used in coding, decoding and multimedia player.

Figure 16:
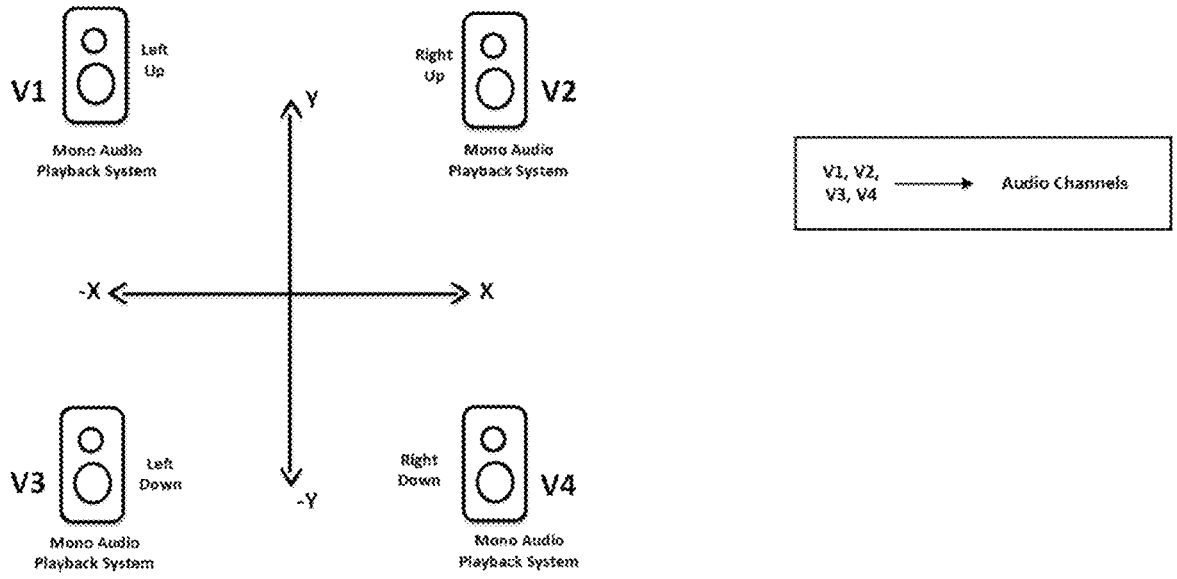

FIG. 16, shows the arrangement of each of the 4 mono audio reproduction systems used in embodiment 1 and 2 of the vector audio reproduction equipment of the present disclosure, wherein said arrangement forms a quadrilateral or vertical quadrangle, as well as the relationship of each mono-audio reproduction system with its corresponding vector-panned channel is also shown.

Figure 17:
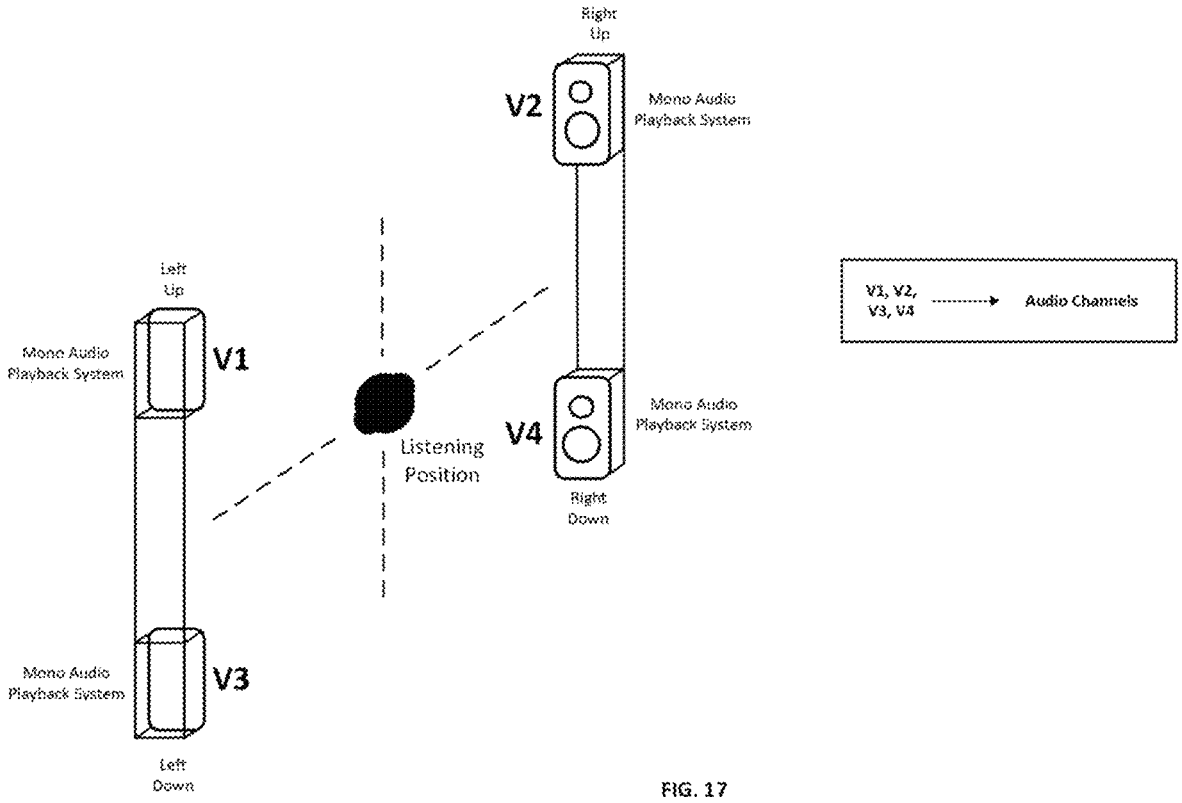

FIG. 17, shows the arrangement of the 4 mono audio reproduction systems in relation to listening, in accordance with Embodiment 1 of the vector audio reproduction equipment.

Figure 18:
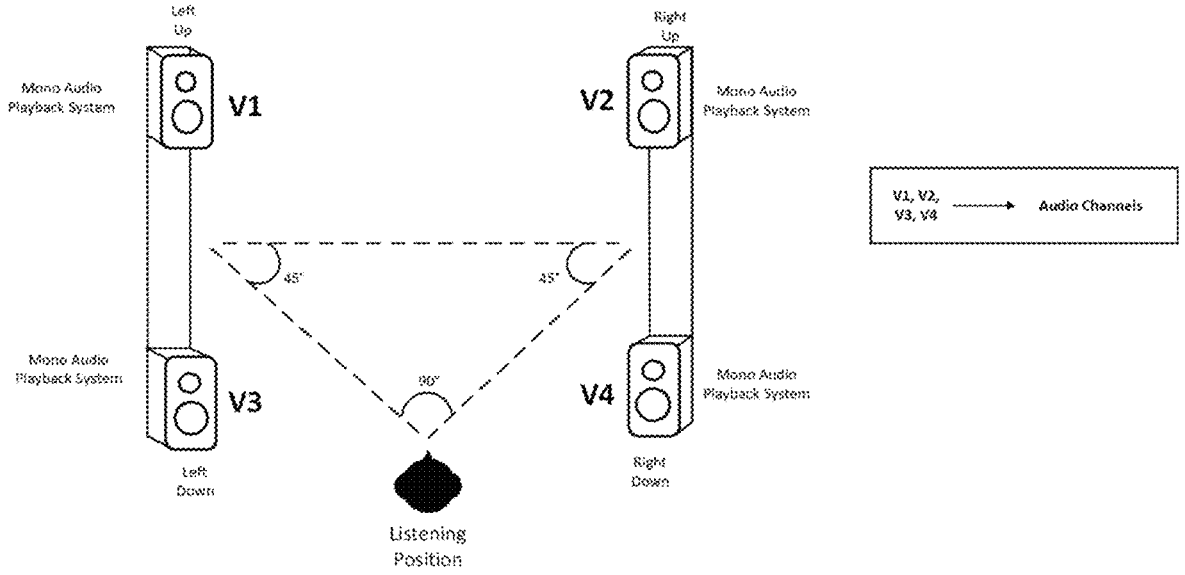

FIG. 18, shows the arrangement of the 4 mono audio reproduction systems in relation to listening, in accordance with Embodiment 2 of the vector audio reproduction equipment.

Figure 19:
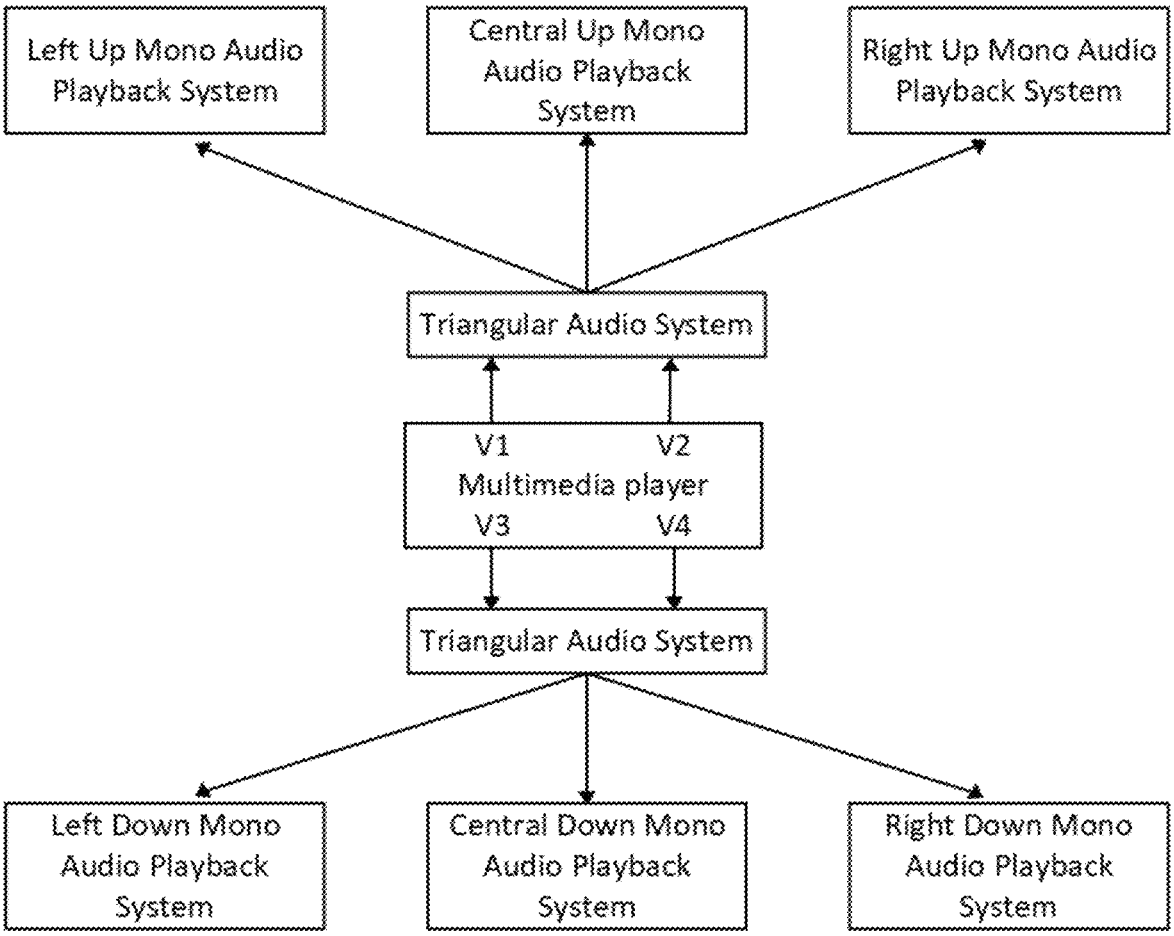

FIG. 19, shows a flow chart showing the operation of Embodiment 3, wherein an intervention and interaction of two triangular systems is performed with the vector audio reproduction equipment of the present disclosure.

Figure 20:
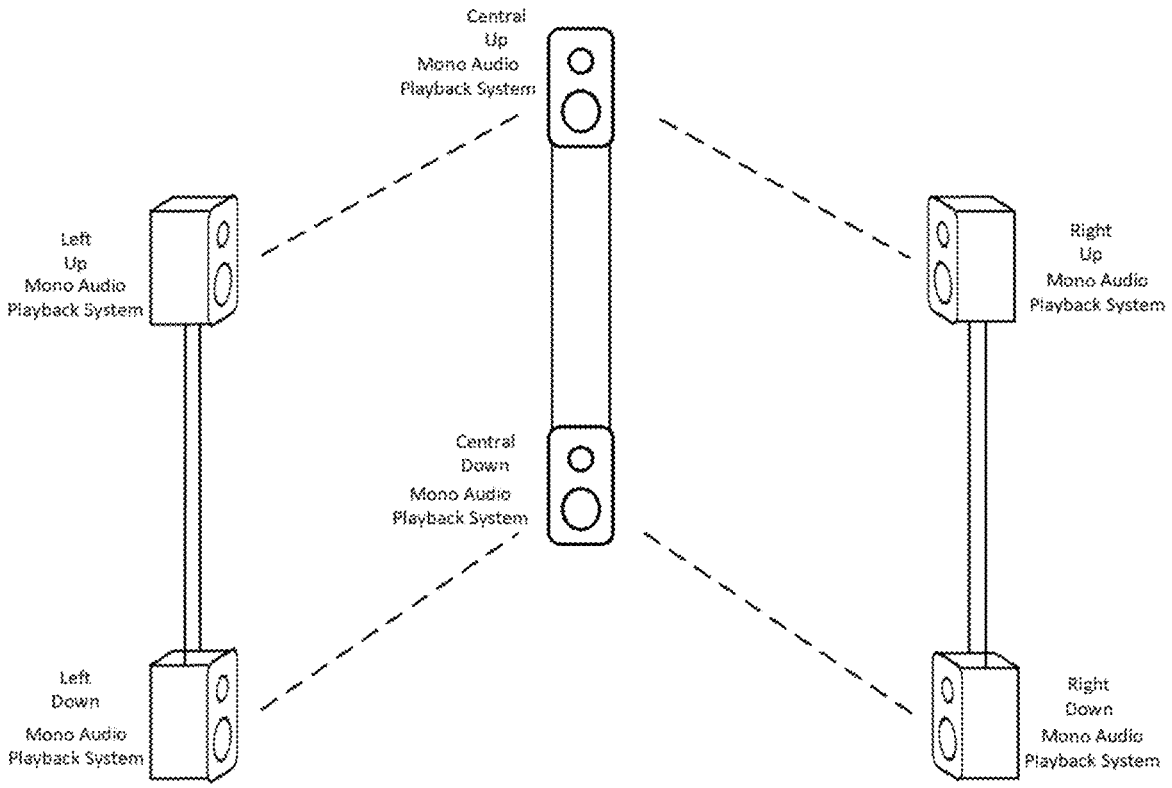

FIG. 20, shows the arrangement of the 6 mono audio reproduction systems in the acoustic physical space in accordance with Embodiment 3 of the vector audio reproduction equipment, where 3 mono audio reproduction systems are placed at the top and 3 mono audio reproduction systems at the bottom.

Figure 21:
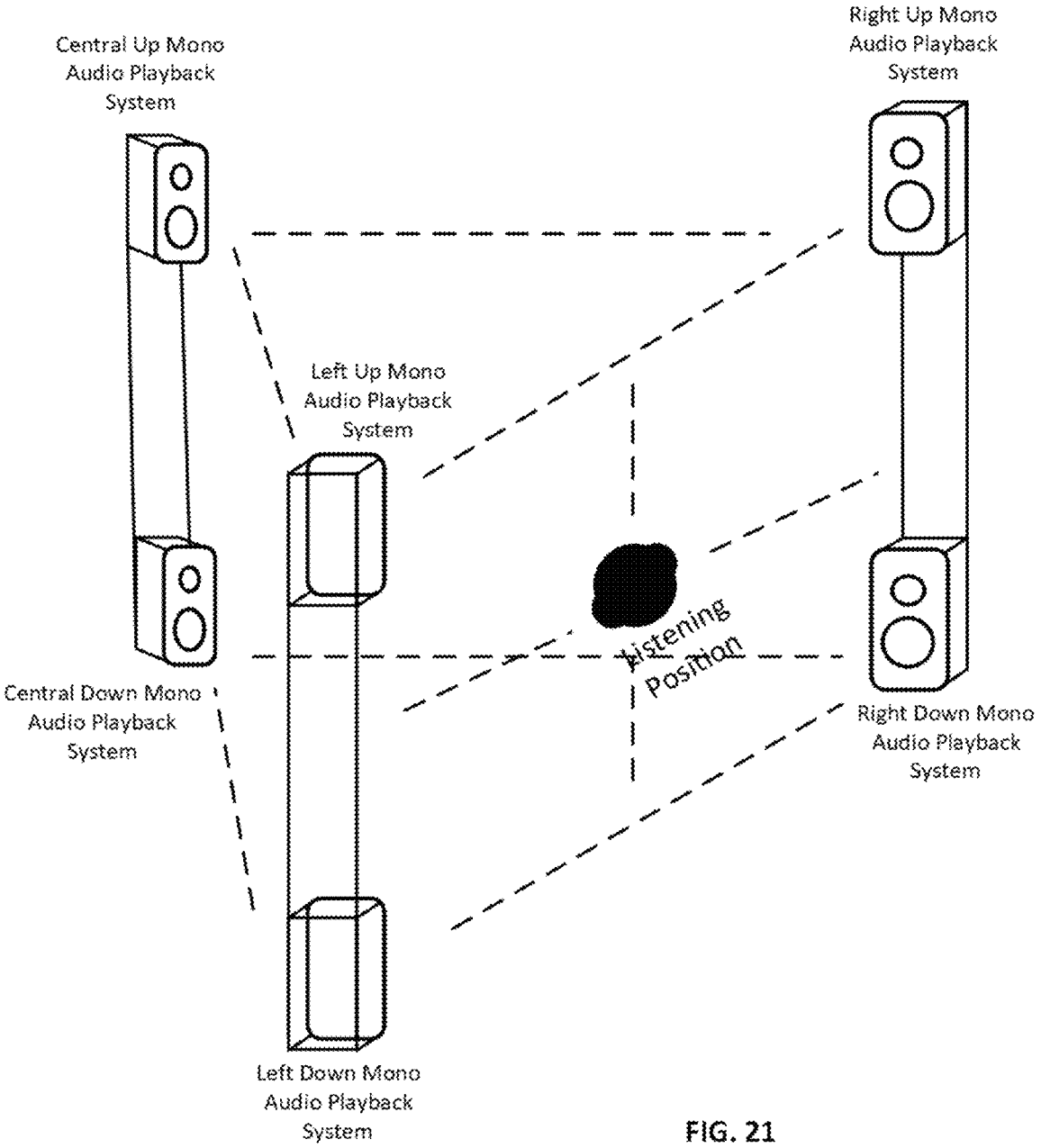

FIG. 21, shows the arrangement of the 6 mono audio reproduction systems in relation to listening, in accordance with Embodiment 3 of the vector audio reproduction equipment.

Figure 22:
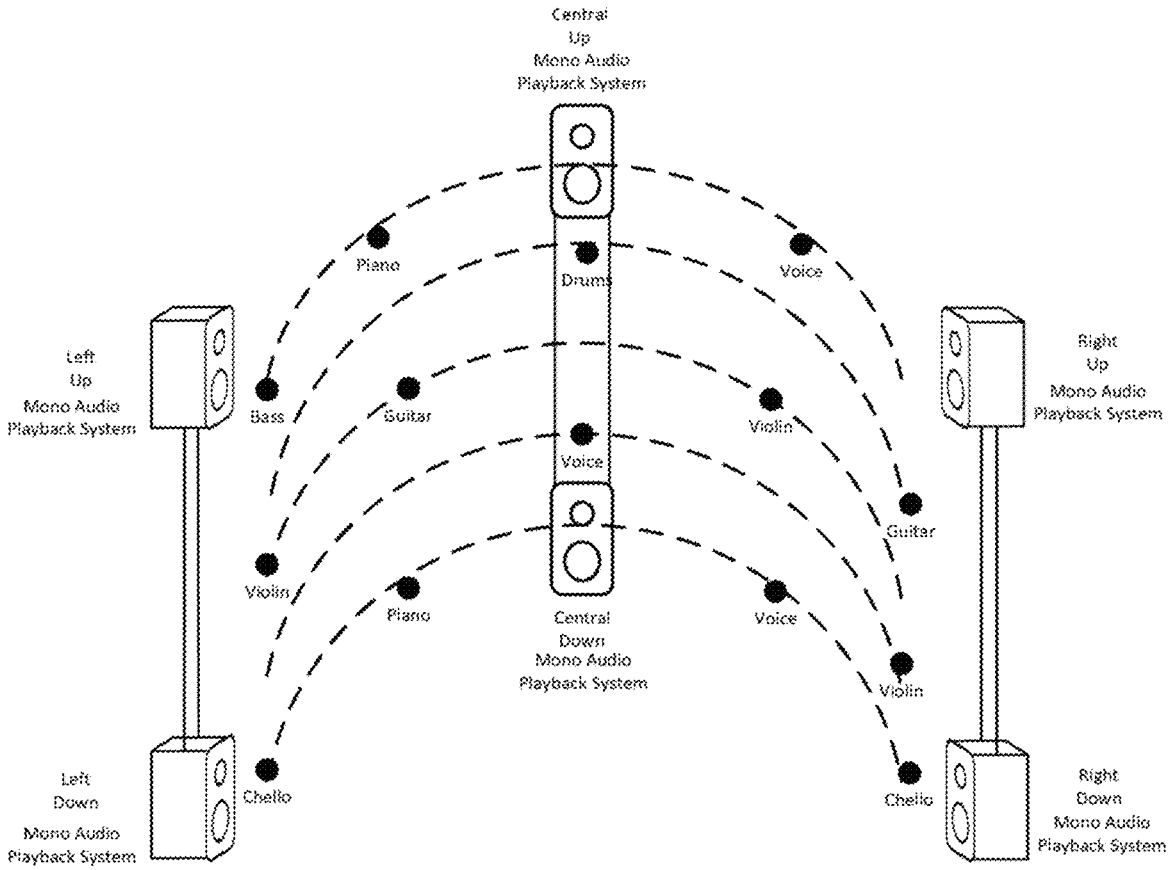

FIG. 22, shows the acoustic effect that is achieved with Embodiment 3 of the vector audio reproduction equipment, where a curvature is created in the panoramic field, which creates a kind of panoramic semicircle that can be seen in the front part of the acoustic space of the listener when playing vector-panned audios.

Figure 23:
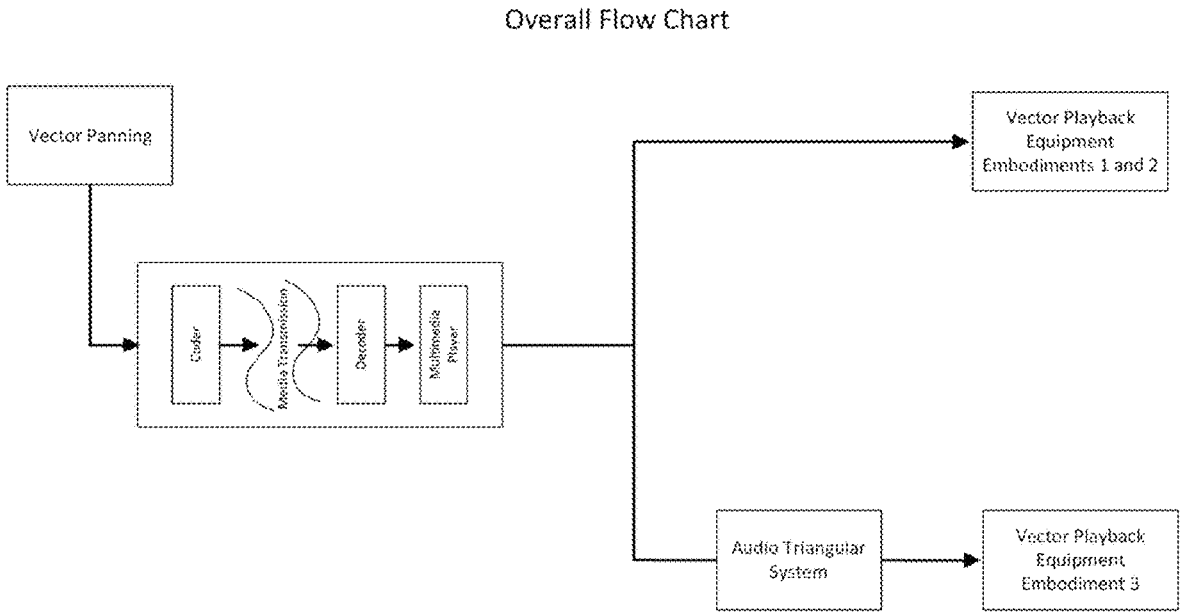
Figure 24:
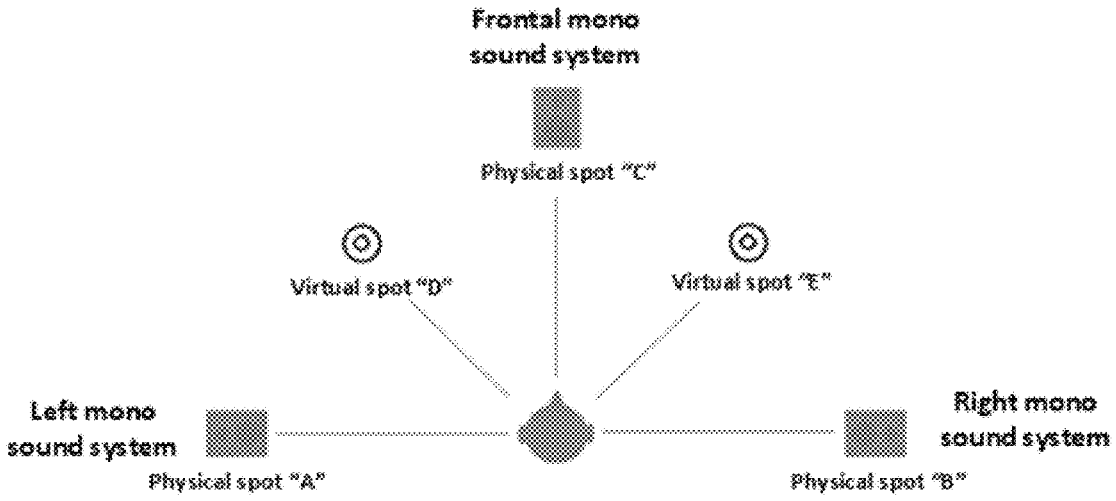

FIG. 23 shows a general flow chart showing the interaction and connection between the different elements that constitute the present disclosure FIG. 24, illustrates the main 5 physical and virtual panning points created with the system of the present disclosure are shown as reference.

FIG. 25, illustrates the relationship between the audio signals X2, Z2 and Y2 with the panning points A, D, C, E, B in the physical space is shown as reference.

FIG. 26, illustrates the relationship between the audio signals X3, Z3 and Y3 with the panning points in the physical space is shown as reference.

Figure 27:
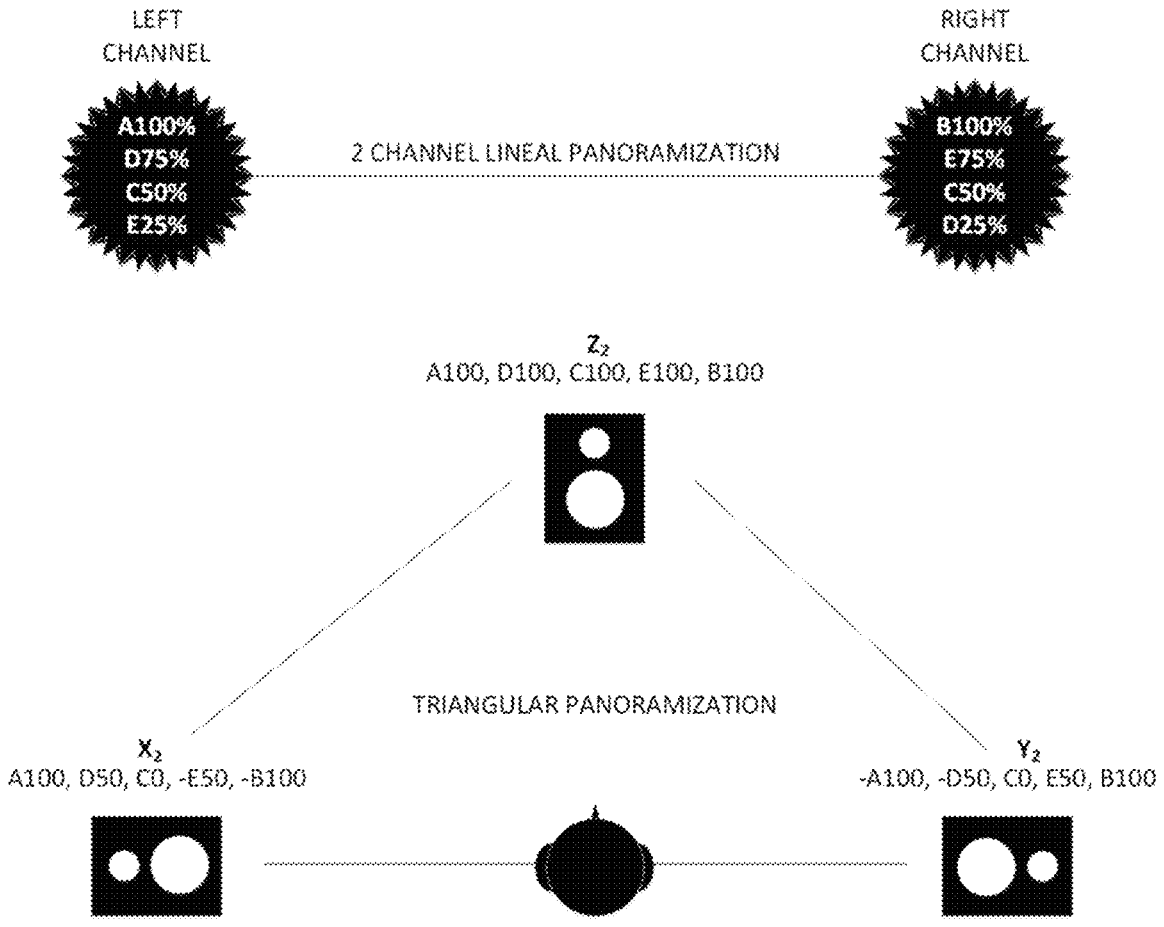

FIG. 27, illustrates the comparison of a linear stereophonic panning with the triangular panning provided by the present disclosure in the X2Z2Y2 embodiment of the present disclosure is shown as a reference.

Figure 28:
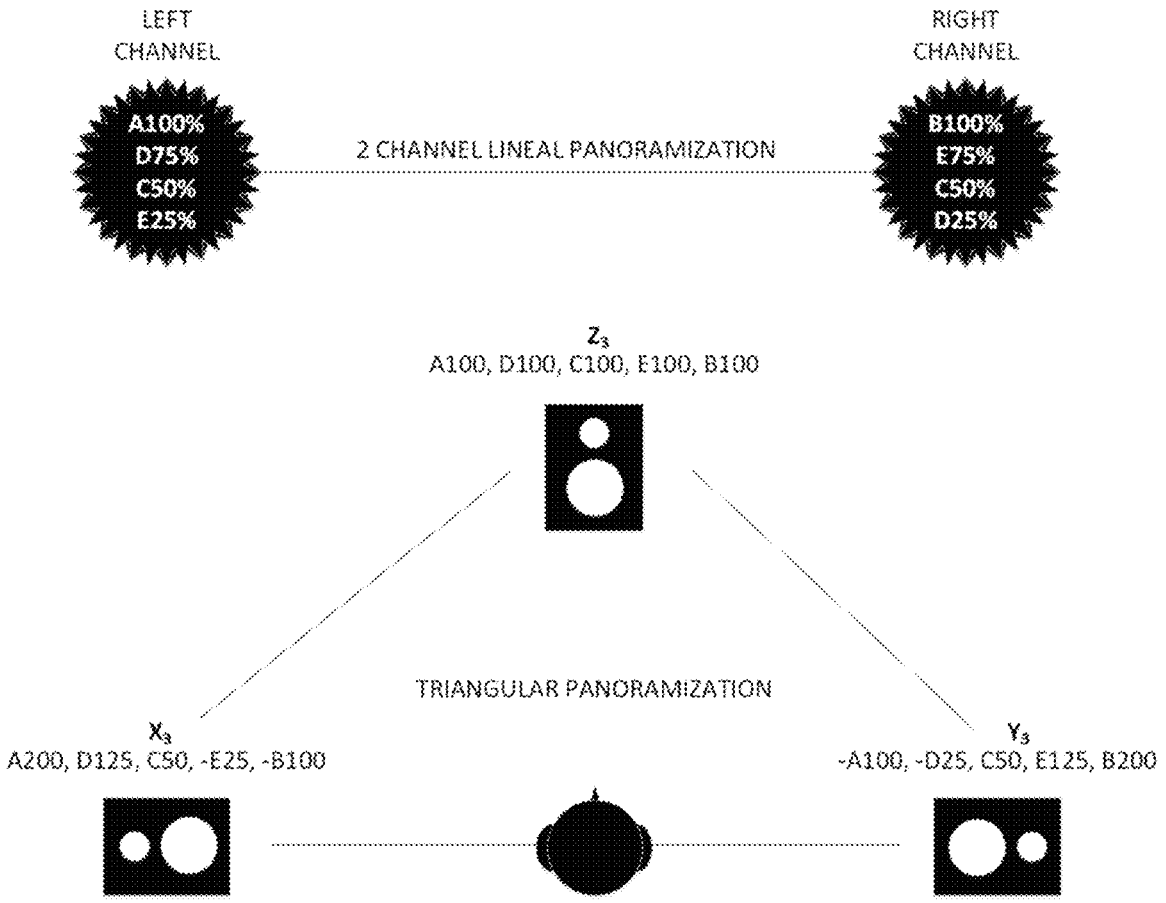

FIG. 28, illustrates the comparison of a linear stereophonic panning with the triangular panning provided by the present disclosure in the X3Z3Y3 embodiment of the present disclosure is shown as a reference.

Figure 29:
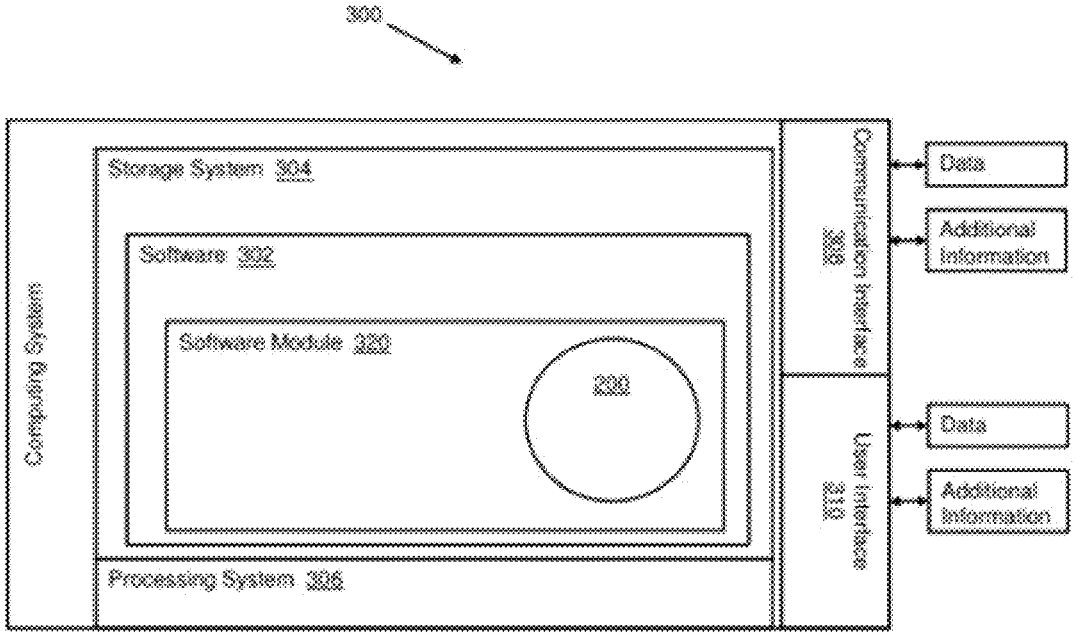

FIG. 29, illustrates a computer system for assigning values for each one of the mono audio playback systems.

Figure 30:
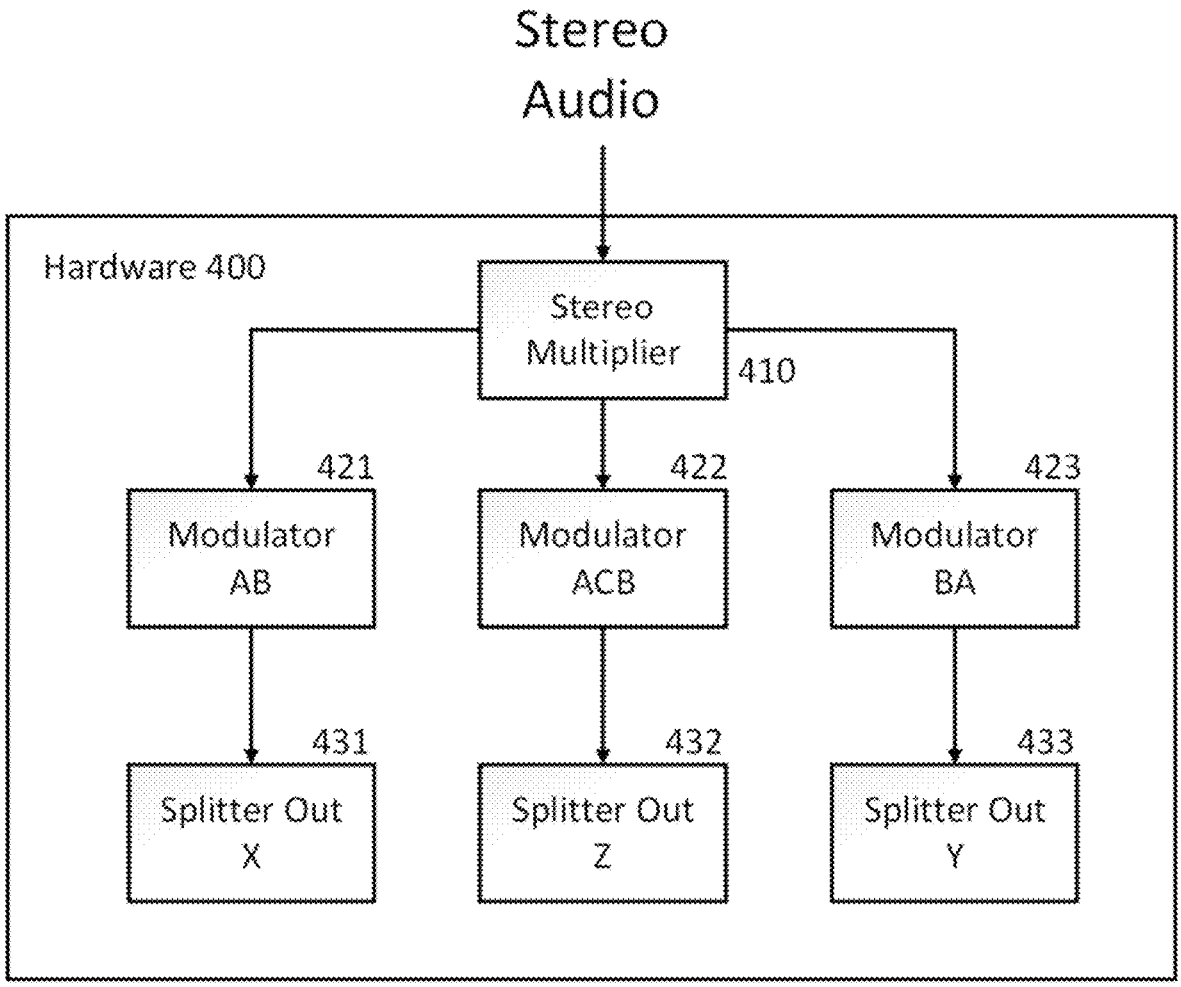

FIG. 30, illustrates a block diagram of an exemplary embodiment of hardware to create the assignment of values for each one of the mono audio playback systems.

Figure 31A:
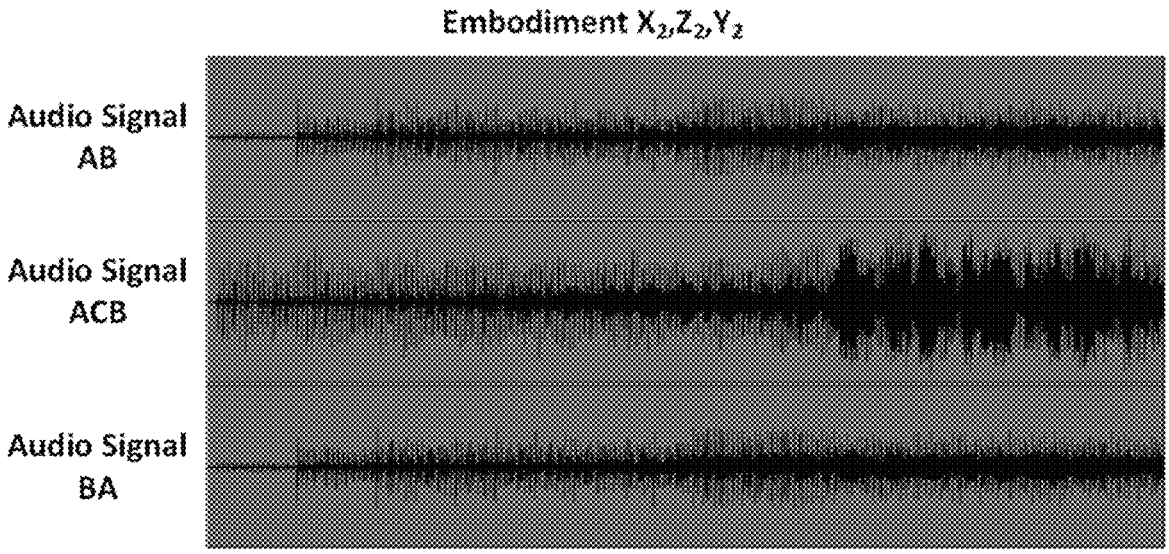

FIG. 31*a*, illustrates the graphical audio lines corresponding each of the three mono audio playback systems after the assignment of values in embodiment X2, Z2, Y2 of the present disclosure.

Figure 31B:
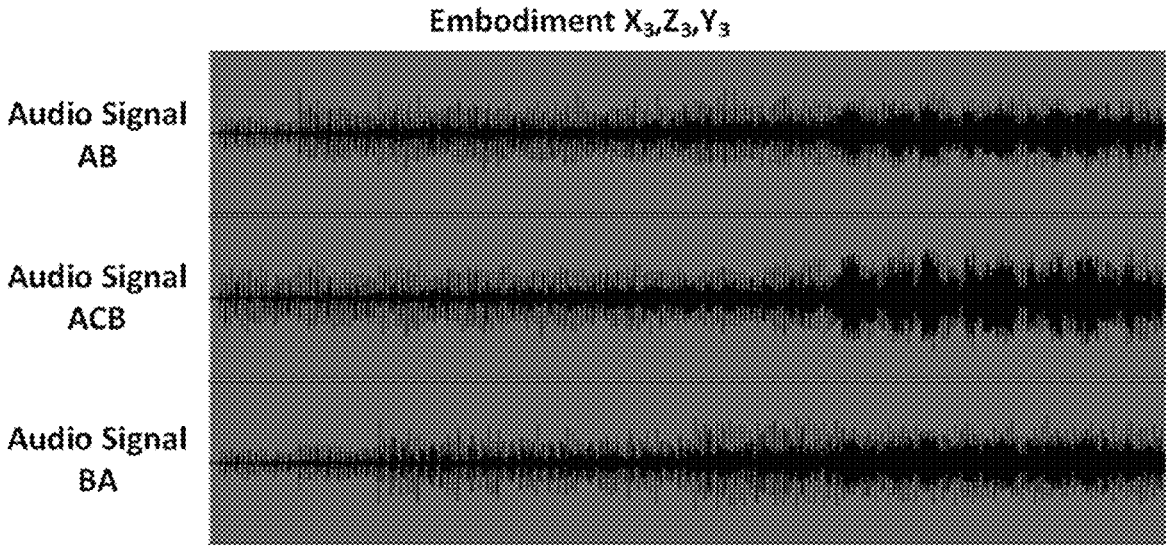

FIG. 31*b*, illustrates the graphical audio lines corresponding each of the three mono audio playback systems after the assignment of values in embodiment X3, Z3, Y3 of the present disclosure.

Figure 32A:
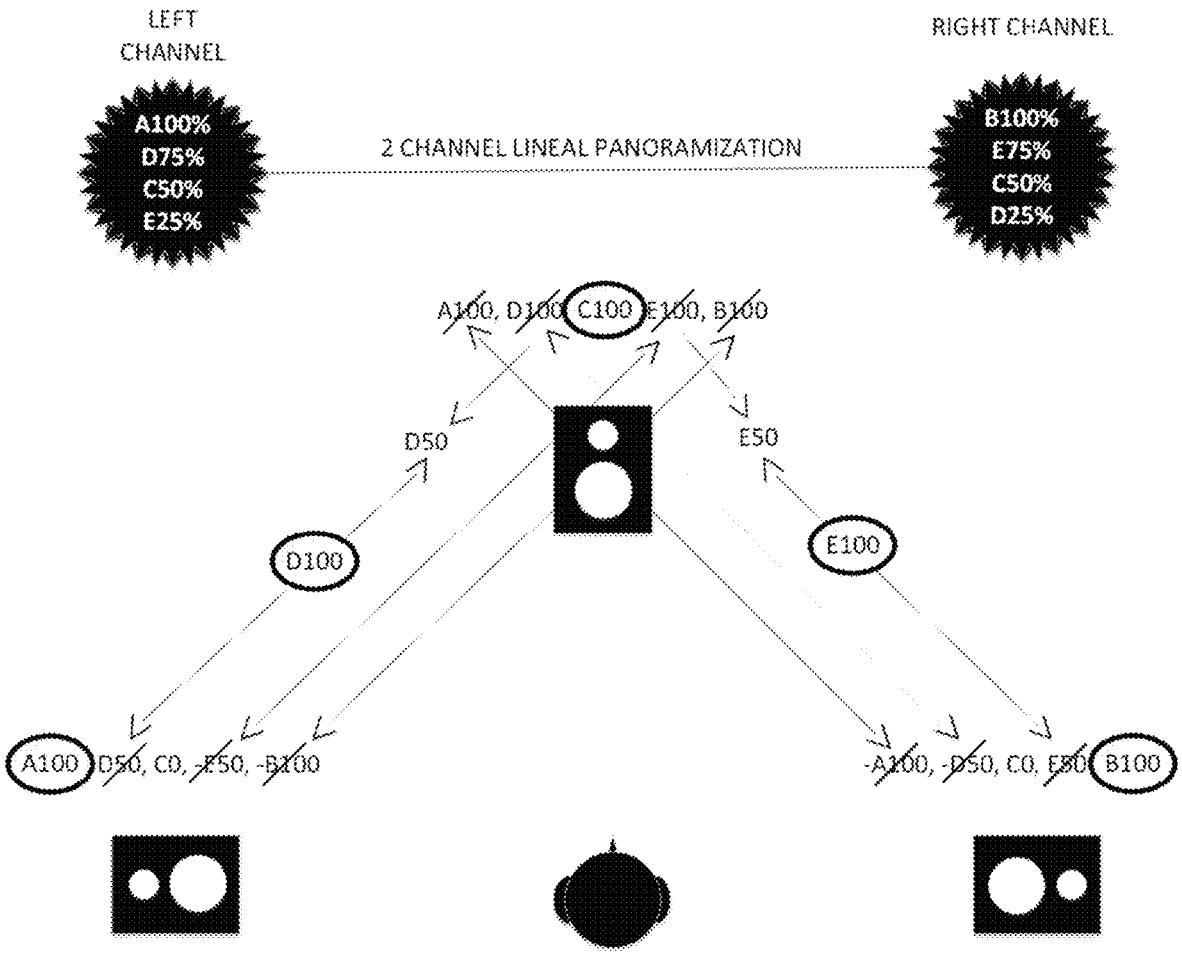

FIG. 32*a*, illustrates the process of physical merge of the values for creating the panning points in the X2Z2Y2 embodiment created with the technology of the present disclosure.

Figure 32B:
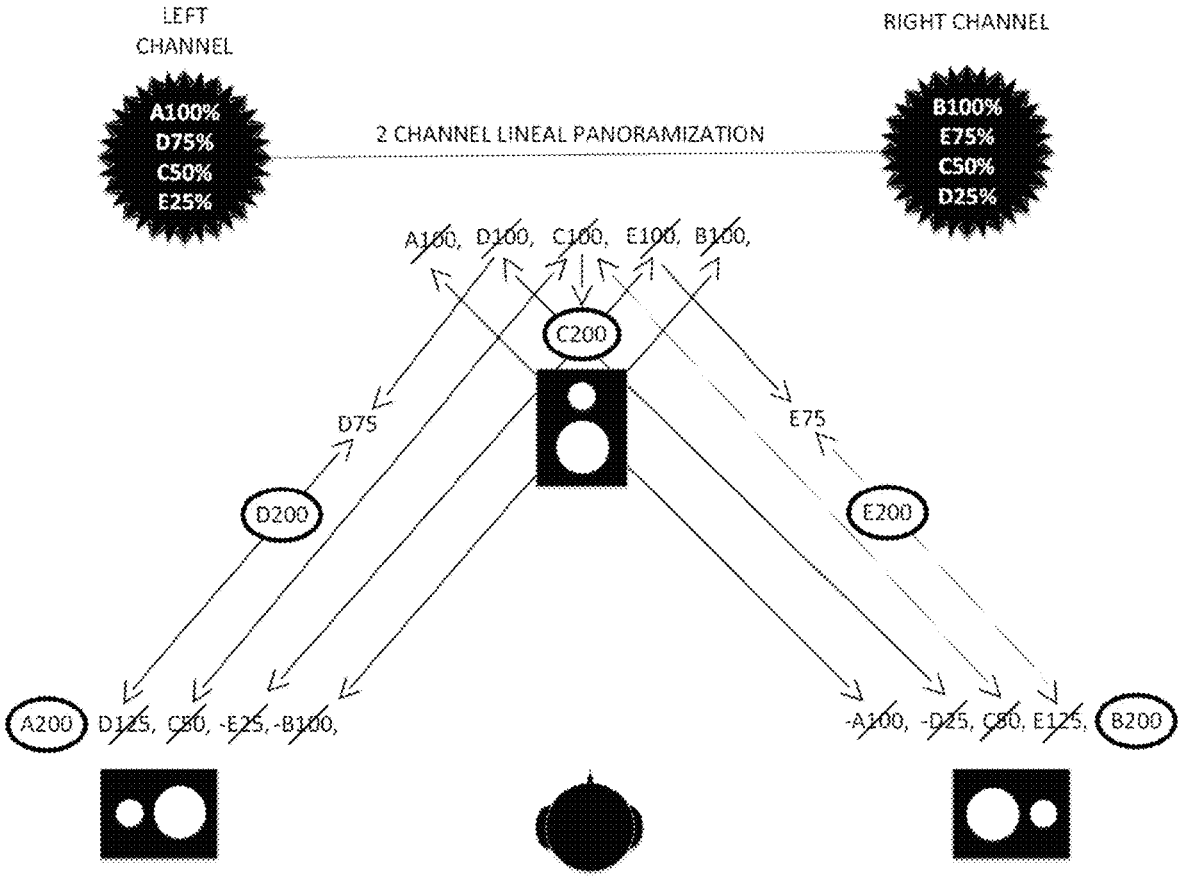

FIG. 32*b*, illustrates the process of physical merge of the values for creating the panning points in the X3Z3Y3 embodiment created with the technology of the present disclosure.

Figure 33:
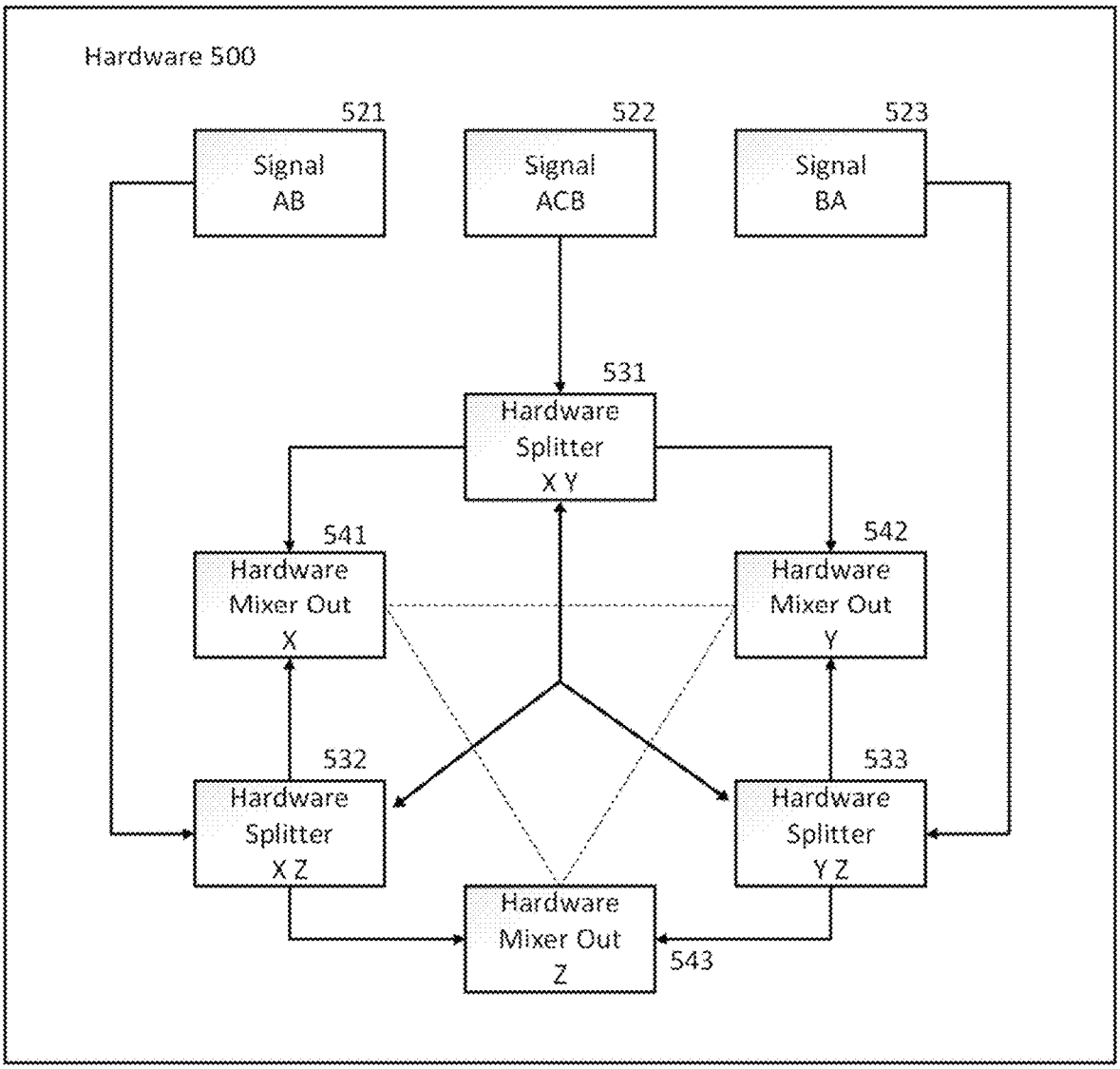

FIG. 33, illustrates a block diagram of an exemplary embodiment to create the audio triangular effect in hardware using the technology of the present disclosure.

Figure 34:
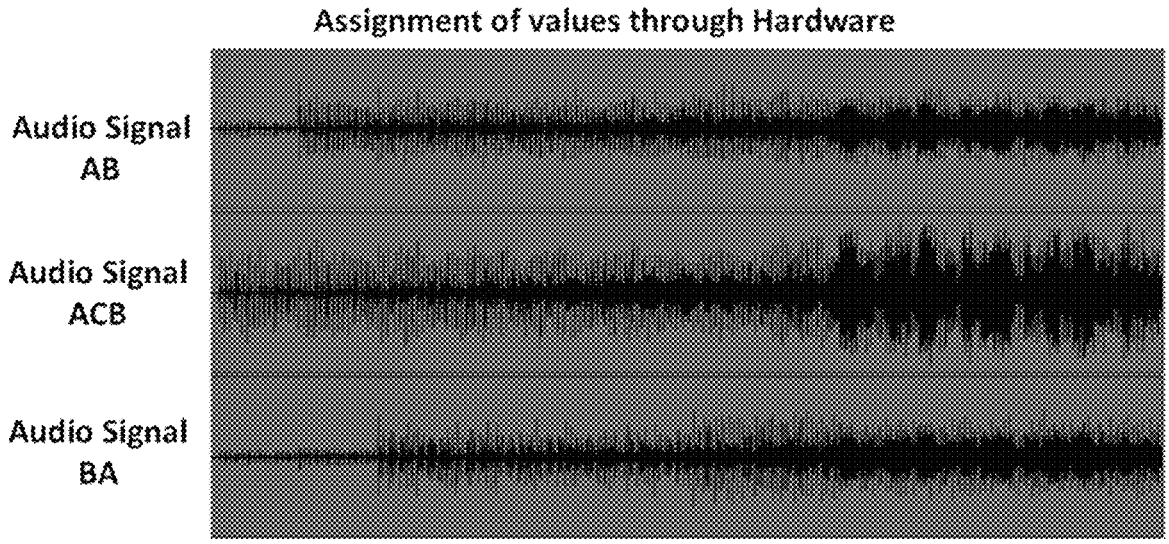

FIG. 34, illustrates the graphical audio lines corresponding each of the three mono audio playback systems after the triangular effect through hardware.

Figure 35:
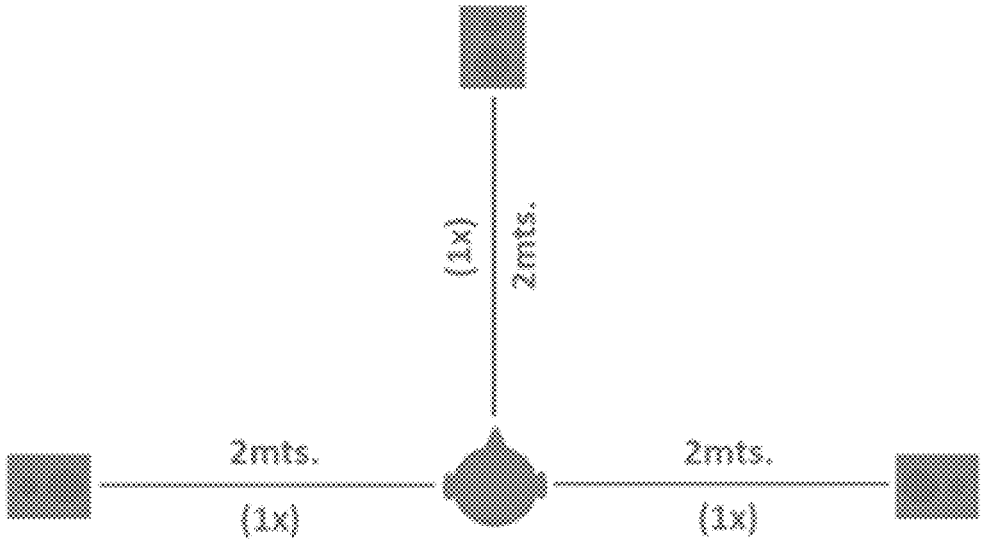

FIG. 35, illustrates the location of the mono audio playback systems in relation to the listener for the triangular audio system of the present disclosure is shown as a reference.

Figure 36:
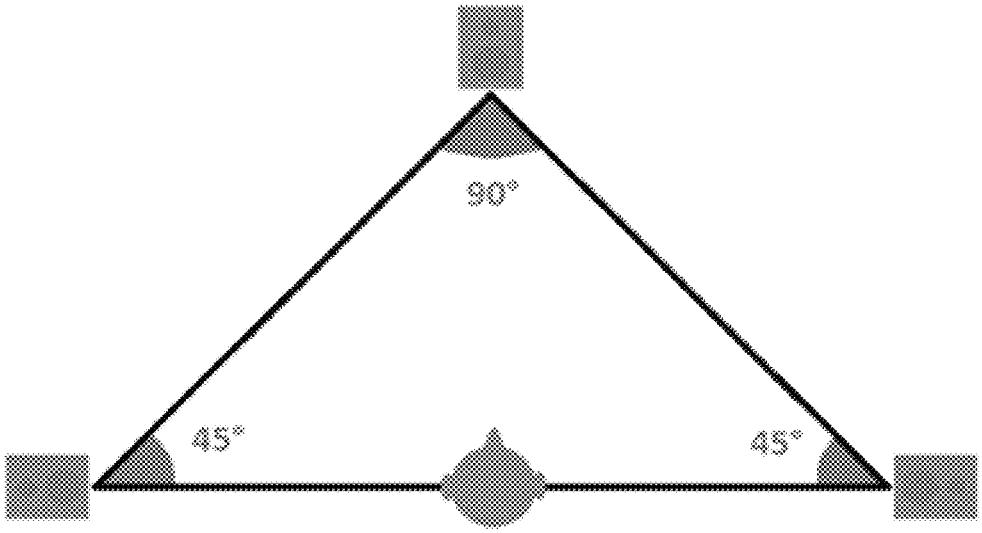

FIG. 36, illustrates the audio's triangular space created by the placement of the mono audio playback systems in the present disclosure is shown as a reference.

FIG. 37, illustrates the mathematical formulas that allow calculate the relationship between the sound levels depending on the distance (r) are shown.

It is important to note that the embodiments illustrated in the accompanying drawings are incorporated as an example and in no way are intended to limit the spirit and scope of the embodiments described herein.

DETAILED DESCRIPTION

It is important to note that the details and elements of the different embodiments of the present disclosure described below are mentioned as an example and for the purpose of illustrative discussion of the preferred embodiments and are shown as the most complete description and that allows the best understanding of the principles and conceptual aspects of the disclosure.

Likewise, it should be understood that the disclosure is not limited in its application to the details of construction and the arrangement of the components set forth in the following description or illustrated in the drawings. The disclosure is applicable to other embodiments or can be practiced or carried out in several ways. It should also be understood that the phraseology and terminology employed in the present disclosure is for the purpose of description and should not be considered as limiting.

For a better understanding of the present disclosure, it is necessary to understand what a stereophonic panning consists of, therefore, said stereophonic panning is briefly described in the background of this document.

Figure 1:
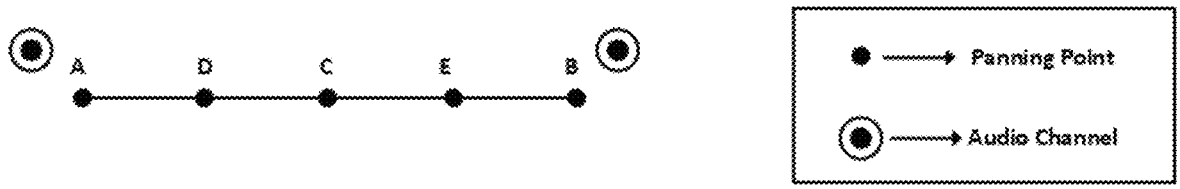
FIG. 1, is a representation of a stereophonic panning wherein the 5 main panning points are shown.
Figure 2:
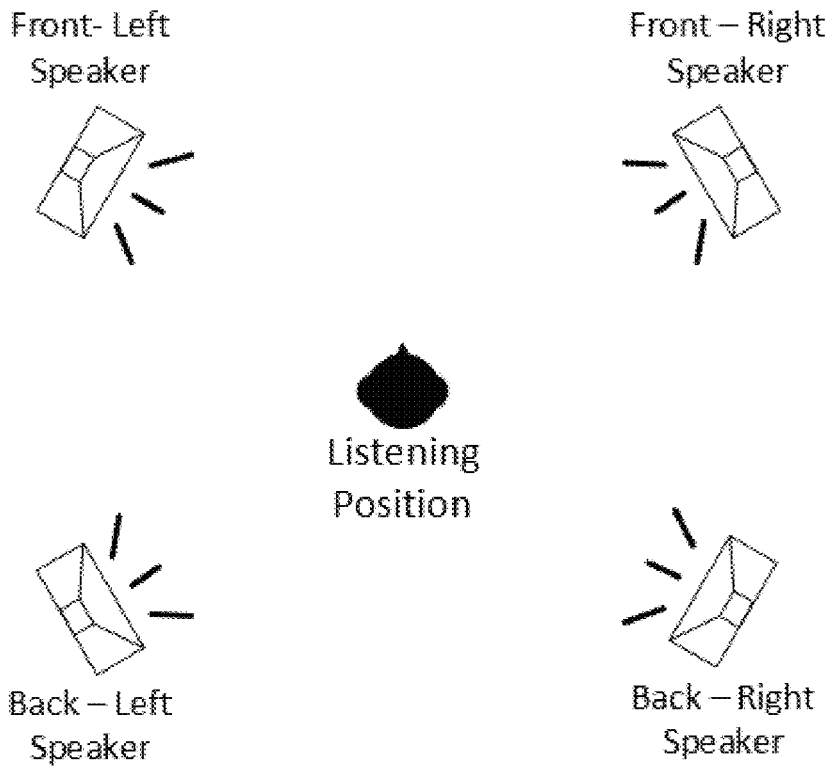
FIG. 2, shows a traditional quadraphonic system in accordance with the prior art.
Figure 3A:
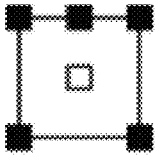
FIG. 3a PRIOR ART
FIG. 3*a*, shows an audio system 5.1 in accordance with the prior art.
Figure 3B:
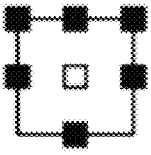
FIG. 3b PRIOR ART
FIG. 3*b*, shows an audio system 6.1 in accordance with the prior art.
Figure 3C:
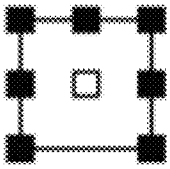
FIG. 3c PRIOR ART
FIG. 3*c*, shows an audio system 7.1 in accordance with the prior art.
Figure 3D:
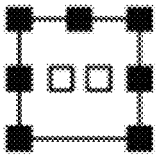
FIG. 3d PRIOR ART
FIG. 3*d*, shows an audio system 7.2 in accordance with the prior art.
Figure 3E:
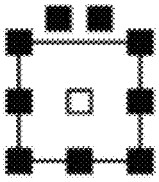
FIG. 3*e*, shows an audio system 9.1 in accordance with the prior art.
Figure 4:
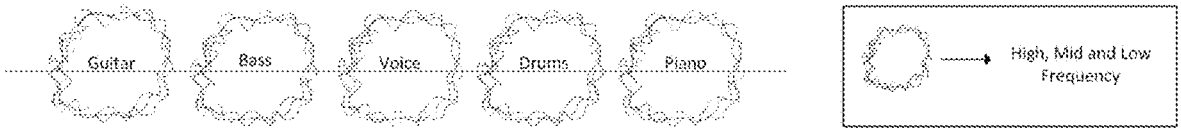
FIG. 4, shows a linear graphical representation of the sounds and their frequencies confined to the same horizon when they are emitted through the linear audio systems of the prior art.
Figure 5:
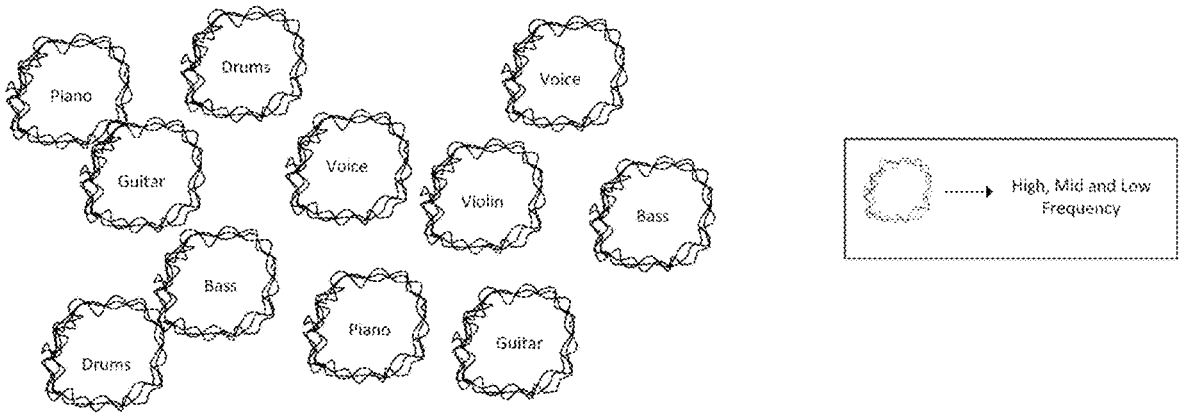
FIG. 5, shows a graphic representation of the sounds and their free frequencies in the acoustic listening space when making use of the audio vector system in accordance with the present disclosure.
Figure 6:
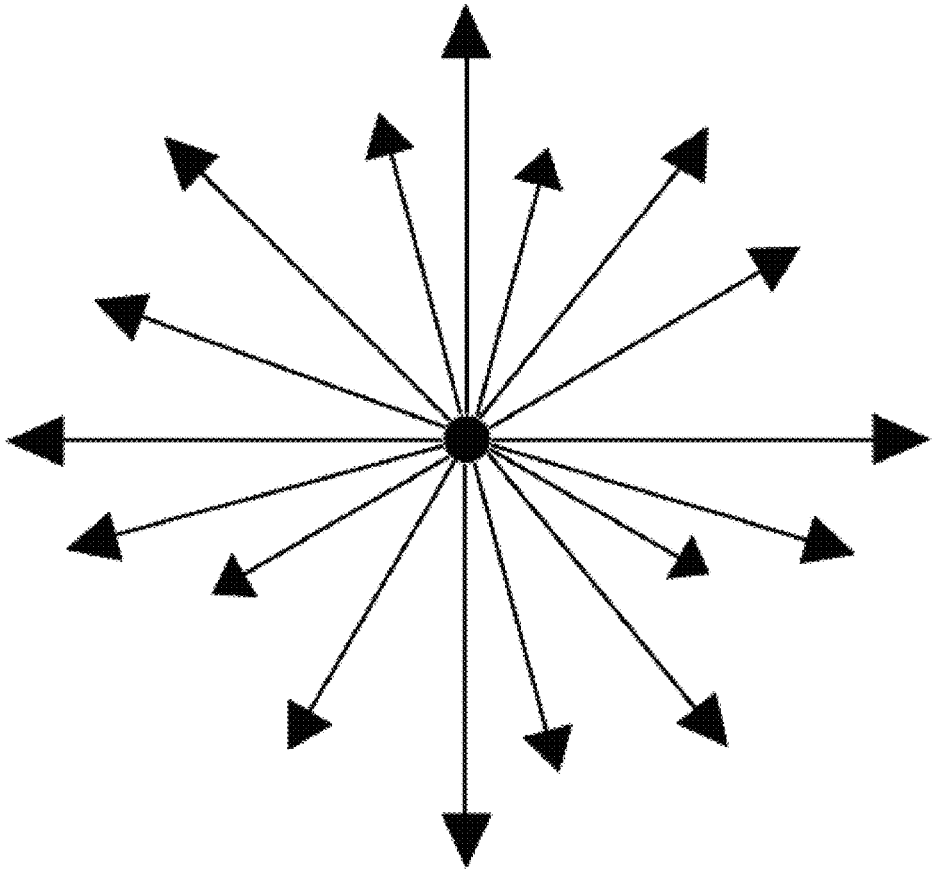
FIG. 6, shows a graphic representation of the vector concept in accordance with the present disclosure.

The audio system of the present disclosure uses the word vector as a descriptive adjective of the embodiments due to the characteristics that define a vector from different fields of utility, for example, a vector can be used to represent a physical quantity, being defined by a module and a direction or orientation, from a geometric interpretation, a vector consists of line segments directed towards a certain side, resembling an arrow. The FIG. 6, shows how a vector can represent a sound coming from or located from any specific point and with an intended direction within a delimited space, as is the case in the present disclosure.

The present disclosure therefore relates to a new method for generating audio, its related multichannel audio system, and specifically the present disclosure describes a new integral audio system unknown so far, and which contemplates all the necessary steps. for its realization, which has its own vector panning, the development of a unique and own writing/reading format, and its own vector audio reproduction equipment, as well as the physical, software and hardware means necessary to implement This new technology.

Therefore, the present disclosure comprises at least the following elements:

A unique panning method/process based on vectorization processes specially designed to be materialized by the other elements that make up the embodiments, and which will be described in detail below, A method/process for building a unique and own audio format, A vector audio reproduction equipment.

Vector Panning Method

The vector panning of the present disclosure, unlike a stereophonic panning, allows audio panning that is not limited to placing sounds on a simple horizontal line, therefore, the vector panning of the present disclosure creates an audio image complete and in all the possible height and verticality in which the horizontal and vertical appreciation of the sounds in the acoustic space of the listening is extended, specifically within a panoramic field delimited by X and Y axes, wherein said audio image is structured by 8 stereophonic panning lines that at the same time allow sounds to be placed in at least 25 panning points that are preferred.

The vector panning of the present disclosure is comprised of various stages or elements. It is very important to respect the specific parameters and characteristics in each of them for its operation, these stages or elements are the following:

Spatial location, 8 stereophonic panning lines,

Panning points,

Vector panning table,

Physical mixers,

Digital mixers,

Real-time vector panning method,

Frequency adjustment method, and 4-channel audio file

Next, each of the stages or elements of the detailed vector panning will be described.

Spatial Location

The first point to perform the vector panning of the present disclosure is to delimit a panoramic field in the physical space, which must be delimited by the X and Y axes of a Cartesian plane.

It is important to understand that said panoramic field, preferably, but not limited to it, must be on the front of the audio producer to define the location of the sounds within said panoramic field, which will be appreciated in the physical space.

The panoramic field should be understood as the one or those spaces that are decided will be the limits of the physical space in which the vectors will have their application. Physical space should be understood as the space zone in which a listener effectively perceives the sounds generated and positioned at the different panning points.

Thus, the panoramic field contemplated in the present disclosure can be as wide as necessary according to the characteristics of the physical space where the auditory presentation will be performed, for example, either a concert in a huge esplanade or an essay in a small bar or even the panoramic field defined in the space of headphones; the physical space being represented by the cubic meters in which the sound of said auditory presentation will be appreciated.

From the above within this panoramic field delimited by the X and Y axes of a Cartesian plane, there are multiple spatial location points, which are located within coordinates (X, Y).

Figure 7:
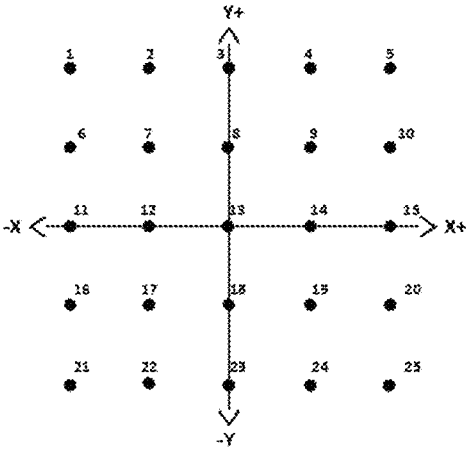
FIG. 7, shows a graphical representation of 25 spatial location points within a panoramic field delimited by its X and Y axes, such as that which can be generated by the system of the present disclosure.

In FIG. 7, said multiple spatial location points can be seen, and specifically, the at least 25 spatial location points within said panoramic field delimited by their X and Y axes. In addition, specific coordinates can be observed to locate each one of the said at least 25 spatial location points of the present disclosure, which allows a great variety of options to visualize and plan the location of the sounds that will be appreciated in the physical space.

Figure 8:
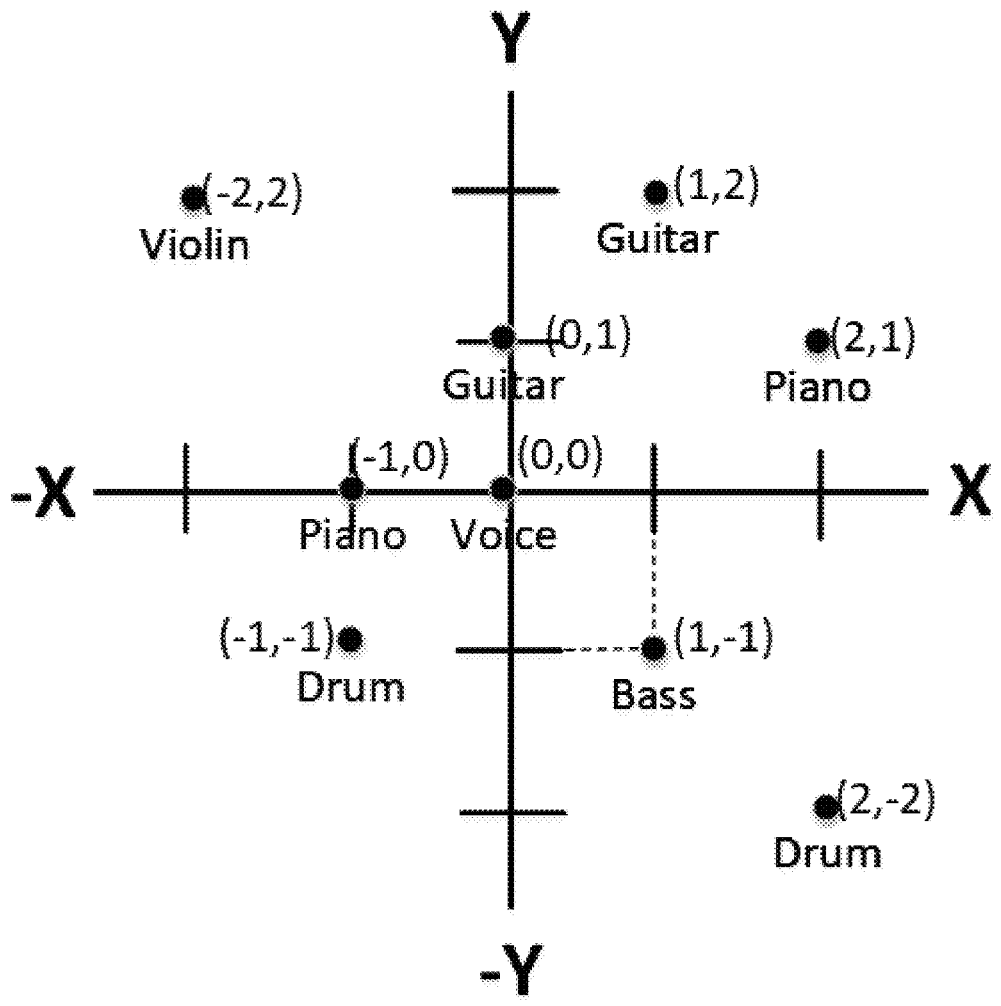
FIG. 8, shows an example of a rendering of instruments in the acoustic space of the listener within said panoramic field generated by the system of the present disclosure delimited by its X and Y axes.

In FIG. 8, an example of the use of said spatial location points can be observed to place the sounds that will be appreciated in the physical space, where the voices are placed right at the center of the panoramic field in a static way, while the sound of a guitar can be placed at the coordinates (0,1) at a certain moment and at another specific moment it can be placed at the coordinates (1,2) to achieve a movement effect.

Those skilled in the art will understand that it will be possible to place any sound at any of the at least 25 spatial location points as described above.

b) 8 Stereophonic Panning Lines.

Once the desired location of each sound in the physical space is visualized within the panoramic field delimited by its X and Y axes described above, 8 stereo panning lines will be necessary to use, which must be located specifically within said panoramic field, which will be used by the audio producer to reach their creative goals.

It should be noted that each of the 8 stereophonic panning lines are delimited by a left end and a right end.

As previously described, said 8 stereo panning lines must be located specifically within the panoramic field delimited by their X and Y axes, therefore, in FIG. 9, the specific position that each of 8 stereo panning lines should occupy within said panoramic field can be observed as follows:

The stereo panning lines 1-2 is placed horizontally at the top of said panoramic field;

The stereo panning lines 3-4 is placed horizontally at the bottom of said panoramic field;

The stereo panning lines 5-6 is placed vertically on the left side of said panoramic field;

The stereo panning lines 7-8 is placed vertically on the right side of said panoramic field;

The stereo panning lines 9-10 is located diagonally from the lower left corner to the upper right corner of said panoramic field;

The stereo panning lines 11-12 is located diagonally from the upper left corner to the lower right corner of said panoramic field;

The stereo panning lines 13-14 is placed horizontally on the "X" axis of said panoramic field;

The stereo panning lines 15-16 is positioned vertically on the "Y" axis of said panoramic field.

It should be noted that this specific position that must be occupied by each of the 8 stereo panning lines is due to the acoustic effect produced by the geometry formed with the 8 lines in the physical space.

Moreover, it is important to understand that each of the 8 stereo panning lines are fundamental part of the present disclosure, since the use of them will be necessary to give each sound a selected location within said panoramic field, this means that it will only be possible to place the sounds on the 8 stereo panning lines above mentioned.

Figure 9:
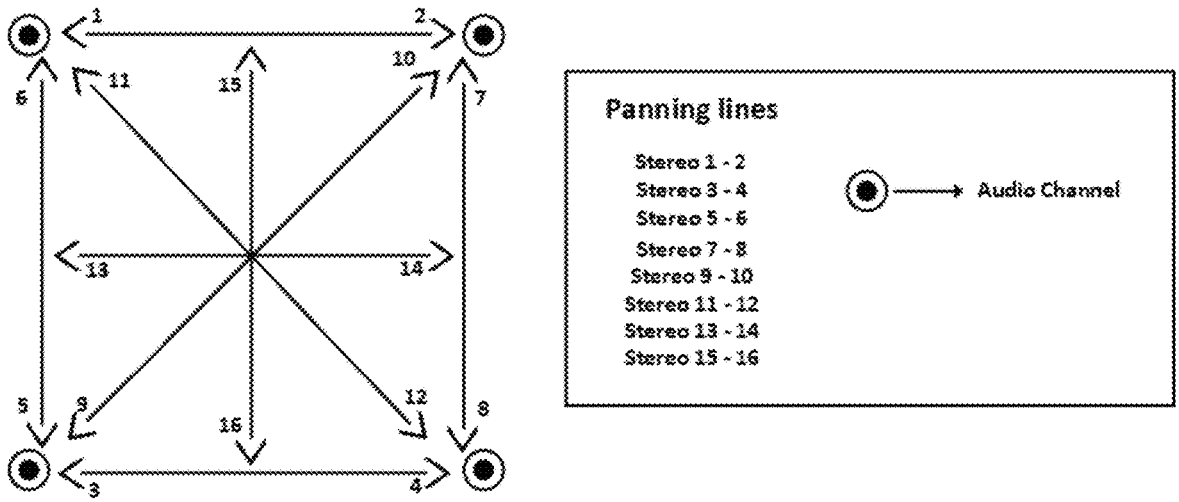
FIG. 9, shows a graphical representation of the specific position of each of the 8 stereo pan lines within said panoramic field delimited by its X and Y axes.

Those skilled in the art will understand by observing FIG. 9, that 6 of the 8 stereo panning lines must be created with the use or allocation of 2 of the 4 audio channels needed in the present disclosure and that 2 of the 8 stereo panning lines must be created with the use or allocation of said 4 audio channels necessary in the present disclosure.

c) Panoramic Points

As mentioned in the background, in a classic stereo panning, sounds can be placed in 5 panning points, a person skilled in the art will understand that in said stereo panning, it is possible to place sounds in more than 5 panning points, however, the perception of listening will be as if these sounds were placed only in these 5 panning points.

Therefore, in the vector panning of the present disclosure, sounds can be effectively placed in the 5 panning points, but on each of the 8 stereo panning lines, and said panning points will be referred to herein as points. A, B, C, D and E for descriptive clarity purposes of the present disclosure.

Figure 10:
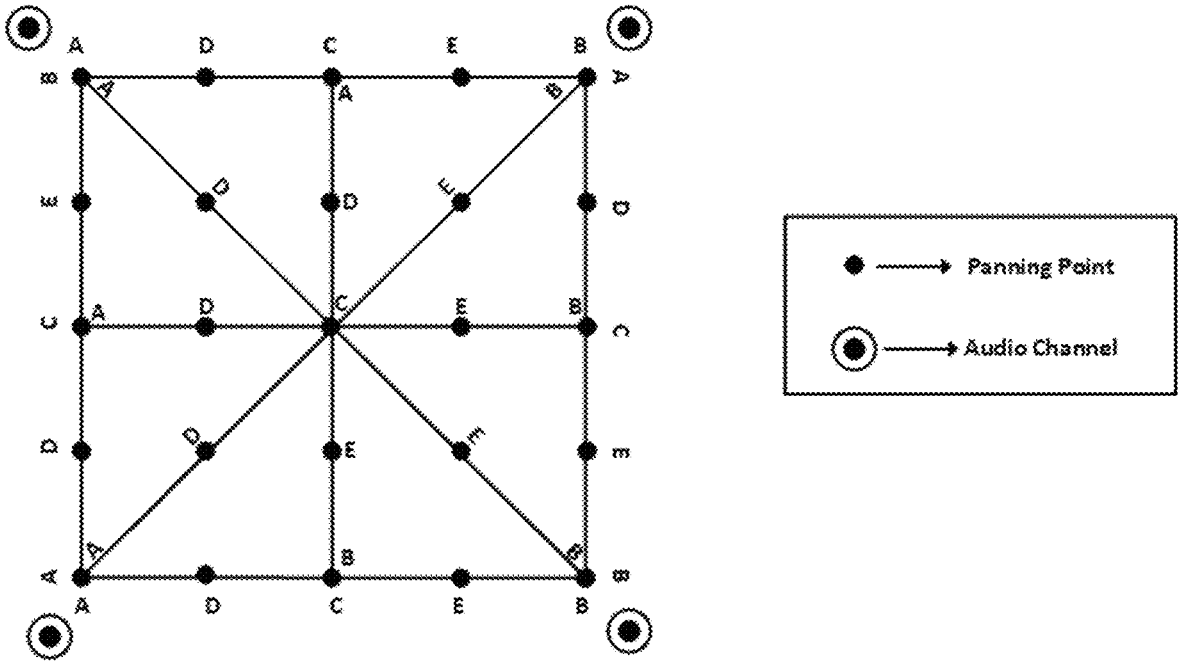
FIG. 10, shows a graphical representation of the 25 preferred panning points of the present disclosure placed on said 8 stereophonic panning lines.

In FIG. 10, the present disclosure shows an exemplary embodiment of the 5 panning points placed on each of the respective 8 stereo panning lines, which results in a number of possible panning points, including at least 25 different preferred panning points for the present disclosure.

It is important to understand that the vector panning of the present disclosure uses, preferably, 25 panning points, which are created on the 8 stereo panning lines aforementioned, in addition, said 25 panning points correspond to or represent the 25 spatial location points described in subparagraph a) of point 1) vector panning, in the present disclosure.

d) Vector Panning Table

As previously described, the present disclosure includes 4 audio output channels to perform a vector panning.

Those skilled in the art will understand that in a classic stereo panning as well known in the prior art, 2 audio output channels are used to place 5 panning points, of which 2 correspond to physical panning points. (audio playback outputs) and 3 correspond to virtual panning points.

Unlike the above, it should be noted that in the vector panning of the present disclosure, 4 audio output channels are used to place the at least 25 preferred panning points of the present disclosure, of which 4 correspond to physical panning points (audio playback outputs) and 21 correspond to virtual panning points.

Figure 11:
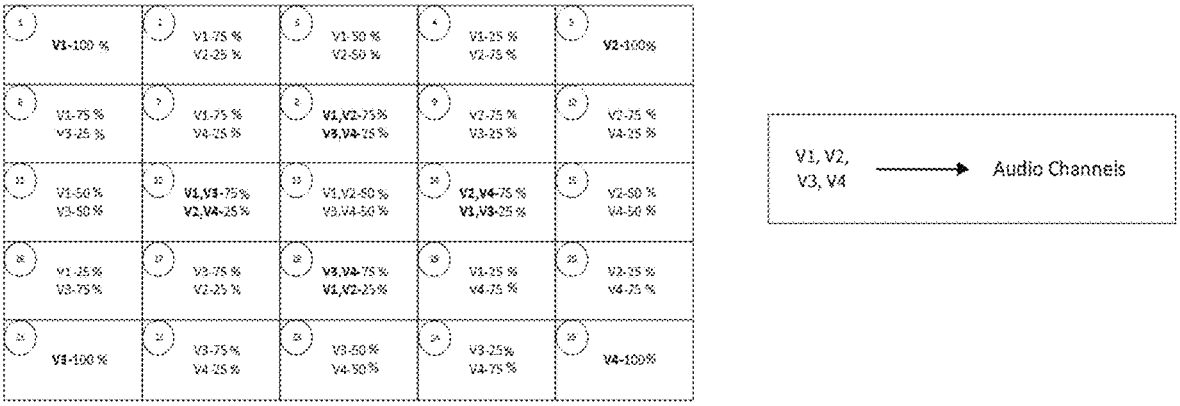
FIG. 11, shows a vector panning table, which shows the technique for placing sounds at any of the at least 25 preferred panning points of the present disclosure.

Said 4 audio output channels used to perform the vector panning of the present disclosure are referred to as "V1", "V2", "V3" and "V4" channel for descriptive purposes of the present disclosure. Based on the foregoing, in the present disclosure a Vector Panning Table is proposed, which is shown in FIG. 11. Said vector panning table shows the technique developed to place one or more sounds at any of the 25 panning points of the present disclosure, which consists in allocating a specific percentage or percentages of sound, regardless of the volume of said sound, in 1, 2 or 4 of said audio output channels "V1", "V2", "V3", "V4" of the present disclosure, which will depend on the panning point at which said sound is to be placed.

Because of its relevance for the present disclosure, said vector panning table will become a fundamental tool for audio engineers who wish to make vector panning.

To place a sound on any of said 25 panning points of the present disclosure, it is necessary to assign the following sound percentages in their corresponding audio output channels "V1", "V2", "V3", "V4":

For example, to place a sound at the panning point "1", 100% of that sound is sent only to the "V1" channel.

To place a sound at the panning point "2", 75% of that sound is sent to the "V1" channel and 25% of the same sound is sent to the "V2" channel.

To place a sound at the panning point "3", 50% of that sound is sent to channel "V1" and 50% of the same sound is sent to the "V2" channel.

To place a sound at panning point "4" 25% of that sound is sent to channel "V1" and 75% of the same sound is sent to the "V2" channel.

To place a sound at the panning point "5", 100% of that sound is sent only to the "V2" channel.

To place a sound at the panning point "6", 75% of that sound is sent to the "V1" channel and 25% of the same sound is sent to the "V3" channel.

To place a sound at the panning point "7", 75% of that sound is sent to the "V1" channel and 25% of the same sound is sent to the "V4" channel.

To place a sound at the panning point "8", 75% of the sound divided equally is sent to the "V1 and V2" channels and 25% of the same sound divided equally is sent to the "V3 and V4" channels.

To place a sound at the panning point "9" 75% of that sound is sent to the "V2" channel and 25% of the same sound is sent to the "V3" channel.

To place a sound at the panning point "10", 75% of that sound is sent to the "V2" channel and 25% of the same sound is sent to the "V4" channel.

To place a sound at the panning point "11" 50% of that sound is sent to the "V1" channel and 50% of the same sound is sent to "V3" channel.

To place a sound at the panning point "12", 75% of the sound divided equally is sent to the "V1 and V3" channels and 25% of the same sound divided equally is sent to the channels "V2 and V4".

To place a sound at the panning point "13" 50% of that sound is sent to the "V1" and "V2" channels and 50% of the same sound is sent to the "V3" and "V4" channels.

To place a sound at panning point "14" 75% of that sound is sent to the "V2 and V4" channels and 25% of the same sound is sent to "V1 and V3" channels.

To place a sound at panning point "15", 50% of that sound is sent to the "V2" channel and 50% of the same sound is sent to the"V4" channel.

To place a sound at the "16" pan point, 25% of that sound is sent to the "V1" channel and 75% of the same sound is sent to the "V3" channel.

To place a sound at the panning point "17", 75% of that sound is sent to the "V3" channel and 25% of the same sound is sent to the "V2" channel.

To place a sound at the panning point "18", 75% of that sound is sent to the "V3 and V4" channels and with 25% of the same sound to the "V1 and V2" channels.

To place a sound at the panning point "19", 25% of that sound is sent to the "V1" channel and 75% of the same sound is sent to the "V4" channel.

To place a sound at the panning point "20" 25% of that sound is sent to the "V2" channel and 75% of the same sound is sent to the "V4" channel.

To place a sound at the panning point "21", 100% of that sound is sent only to the "V3" channel.

To place a sound at the panning point "22" 75% of that sound is sent to the "V3" channel and 25% of the same sound is sent to the "V4" channel.

To place a sound at the panning point "23", 50% of that sound is sent to the "V3" channel and 50% of the same sound is sent to the "V4" channel.

To place a sound at the panning point "24", 25% of that sound is sent to the "V3" channel and 75% of the same sound is sent to the "V4" channel.

To place a sound at the panning point "25", 100% of that sound is sent only to the "V4" channel.

The numbers within circles in FIG. 11 indicate the number of the panning point. In this regard, it should be noted that it is of utmost importance to respect the percentages of sound assigned to their corresponding audio output channels of the present disclosure, because if these percentages are not strictly adhered to, the sounds could not be placed in the 25 panning points of the present disclosure.

Those skilled in the art will understand that it is possible to perform a vector panning with multiple creative variants from the principles of the present disclosure.

It should be noted that the sounds from said 25 panning points create perceptible harmonics for listening. These harmonics are created by the symmetrical geometry that is formed with the distances between each of the 25 panning points, which causes a spatial harmony, where the sounds collide with each other and with the listener to create these harmonics.

e) Physical Mixers

The vector panning of the present disclosure is naturally implemented as a whole, for example, and not limited to this, through a pair of physical panning controls in physical mixers, said pair of controls being one of the innovations proposed by the present disclosure. It should be noted that said pair of panning controls must be included in each line or audio track of a physical mixer.

As described above, said pair of panning controls will have the function of marking the horizontal panning axis and the vertical panning axis to represent the panoramic field delimited by its X and Y axes in the physical space, same panoramic field that was described in subsection a) of point 1) vector panning, in the present disclosure, therefore, by moving said pair of panning controls, it will be possible to place any sound on any of said 25 panning points within said panoramic field along its X and Y axes.

Figure 12:
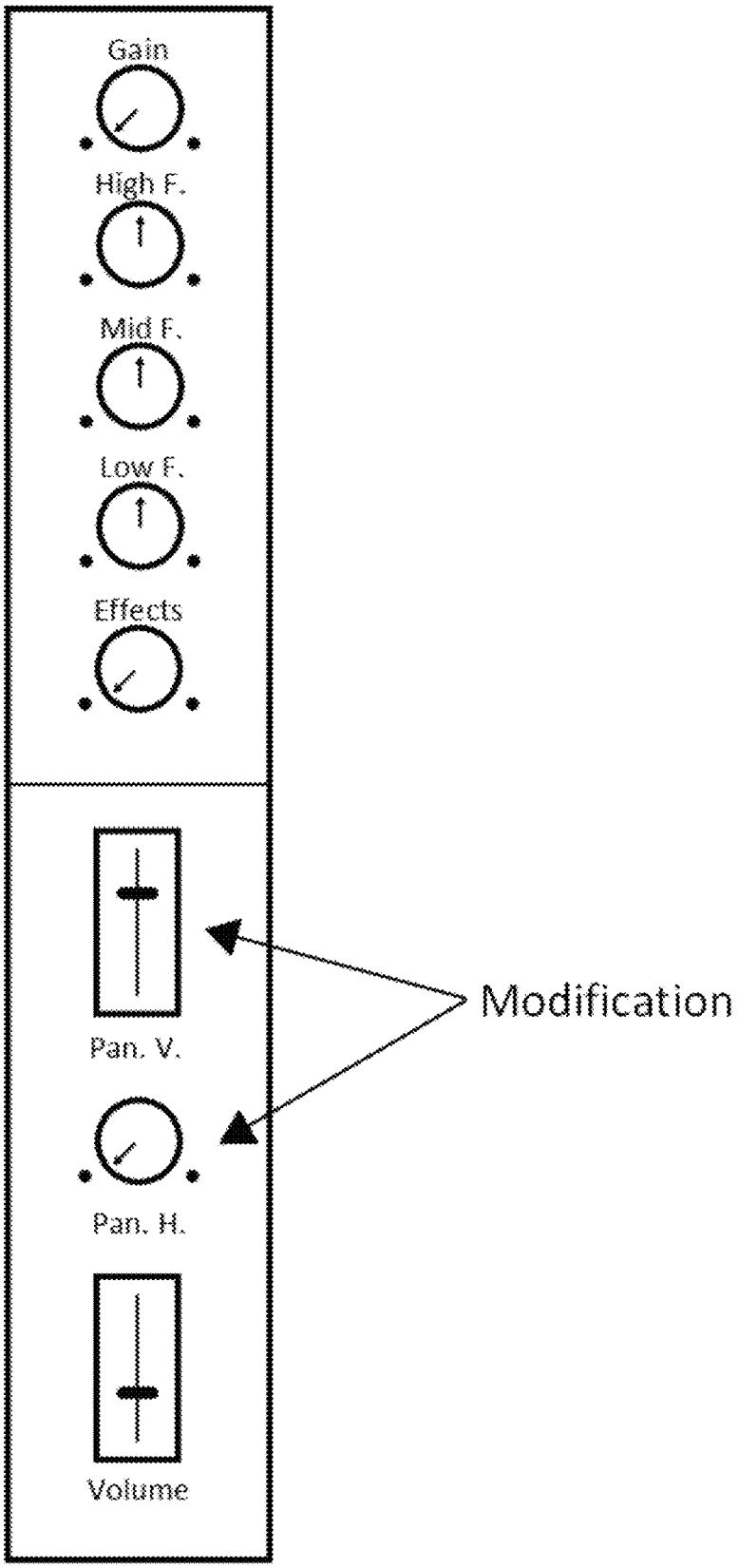
FIG. 12, shows a representation of the physical pan controls on an audio line or track in a physical mixer, which are proposed by the present disclosure.

FIG. 12 shows in an exemplary but non-limiting way, the physical appearance of said pair of panning controls, where the first control named as (Pan V.) will function to grant the vertical location of a sound within the panoramic field delimited by its X and Y axes, and the second control named as (Pan H.) will work to grant the horizontal location of the same sound within said panoramic field.

In addition, the panning controls of the present disclosure comprise, in an exemplary embodiment, an electronic circuit suitable as an electronic module to be added to a physical mixer, which makes possible the functionality of said pair of panning controls. Said electronic circuit has the ability to modify the voltages of an analog signal so that the percentage of sound corresponding to each audio output channel "V1", "V2", "V3", "V4" can be provided, this in relation to the panning point at which it was decided to place each sound.

Figure 13A:
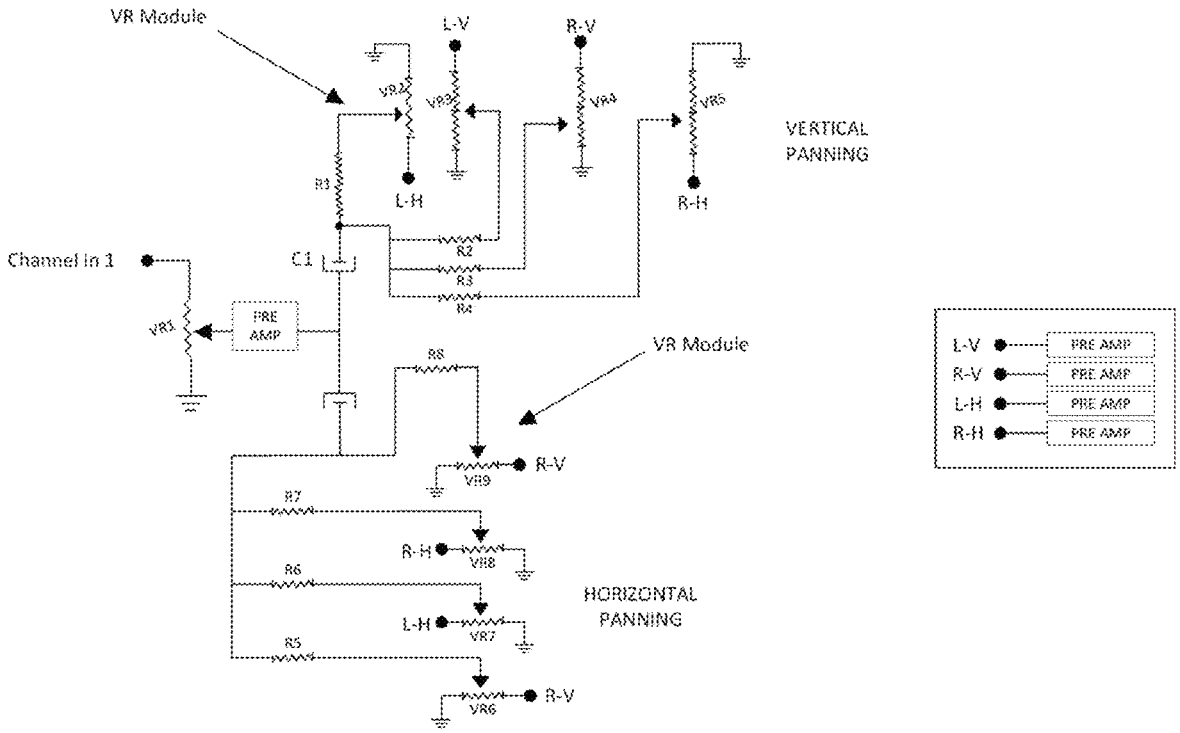
FIG. 13*a*, shows a diagram of the first mode of operation in which an electronic circuit can be observed that can form a pair of vector panning controls for the physical mixers proposed by the present disclosure.
Figure 13B:
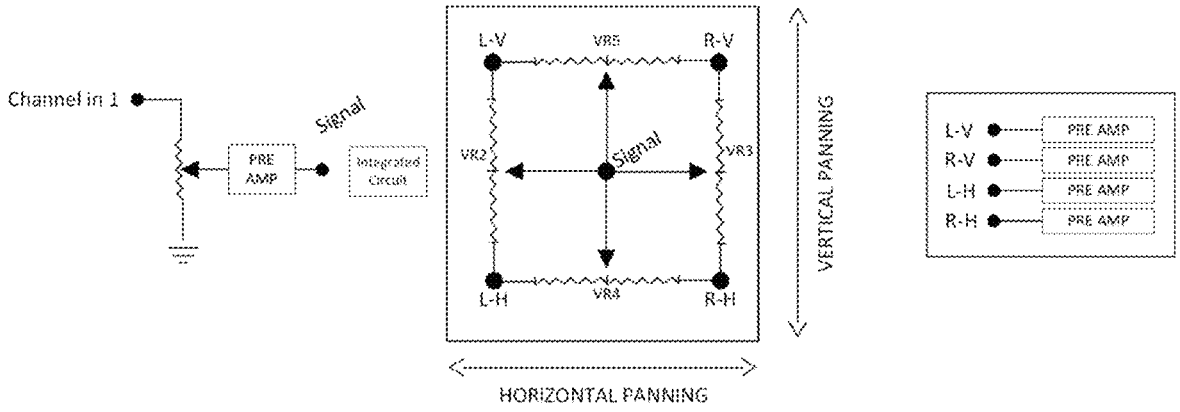
FIG. 13*b*, shows a scheme of the second mode of operation in which an electronic circuit can be observed that can form a pair of vector panning controls for the physical mixers proposed by the present disclosure.

FIGS. 13*a* and 13*b* show in an exemplary but non-limiting way said electronic circuit, which is represented by two schemes showing a different mode of operation each, a person skilled in the art will understand that the most convenient scheme should be used according to the characteristics of the physical mixer to which it is required to add said pair of pan controls.

The scheme of the first mode of operation of said electronic circuit can be seen in FIG. 13*a*, which is represented as follows:

The input "channel in 1" channel receives the audio signal from an audio track of a physical mixer of N numbers of channels represented by tracks, following the scheme, said audio signal enters VR1 (Variable Resistance) to give a voltage represented by the concept of audio signal volume at the input of the preamp, this in turn increases the audio signal from 6 to 12 db to be used in the next stage.

The preamplified signal is divided into two directions and said preamplified signal will give the necessary signal to be able to divide it without so much loss into 2 different panning, vertical panning and horizontal panning, this is done by means of 2 coupling capacitors C1 and C2 being at these are the ones that connect to 2 different VR connection modules (Variable Resistance); one for vertical panning control and another for horizontal panning control.

Control of vertical panning: it is composed of 4 VR (Variable Resistance) (VR2, VR3, VR4, VR5) interconnected, to be able to move at the same time to each other when being controlled under the same axis but with different polarities, also has 4 resistors impedance coupling R1, R2, R3, R4 connected in parallel input. When the audio signal of the coupling capacitor C1 is output, it is divided into the 4 impedance coupling resistors to the VR2, VR3, VR4, VR5 interconnected with each other by the same axis but with different polarities, achieving with this, that while the VR3 and VR4 raise the audio signal to the L-V and R-V audio output points, the VR2 and VR5 lower the signal of the LH and RH audio output points to ground, thereby achieving compensation and decrease of the audio signals towards the different audio output points L-V, R-V, LH, RH.

Horizontal panning control: it is composed of 4 VR (Variable Resistance) (VR6, VR7, VR8, VR9) interconnected, to be able to move at the same time to each other when being controlled under the same axis but with different polarities, it also has 4 resistors impedance coupling R5, R6, R7, R8 connected in parallel input. When the audio signal of the coupling capacitor C2 is output, it is divided into the 4 impedance coupling resistors towards the VR6, VR7, VR8, VR9 interconnected with each other by the same axis but with different polarities, achieving with this, that while the VR7 and VR8 raise the audio signal to the L-H and R-H audio output points, the VR6 and VR9 lower the ground signal of the L-V and R-V audio output points thereby achieving compensation and decrease of the audio signals to the Different points of audio outputs LV, RV, LH, RH.

The scheme of the second embodiments of operation of said electronic circuit can be seen in FIG. 13*b*, which is represented as follows:

The input channel in 1 channel receives the audio signal from an audio track of a physical mixer of N numbers of channels represented by tracks, following the scheme, said audio signal enters VR1 (Variable Resistance) to give a represented voltage due to the concept of audio signal volume at the input of the preamp, this in turn increases the audio signal from 6 to 12 db to be used in the next stage.

The pre-amplified signal passes to an integrated circuit that will be responsible for generating a circuit inside, as can be seen in the representative figure of the variable resistors VR2, VR3, VR4, VR5 within said FIG. 13*b*, said variable resistors have in its ends, the outputs LV, RV, LH, RH and said outputs will have everything necessary in its integrated circuit to make the coupling properly, thus achieving the necessary compensations and attenuations to achieve that objective. It should be noted that this is a basic scheme, which intends, in an exemplary but non-limiting manner, to make the audio signal point reach the different outputs with their respective compensations and attenuations for proper operation.

In addition to their functionality in recording studios, said panning controls included in these physical mixers will be 100% necessary for live performances or concerts, since with the use of said two panning controls on each line or audio track within these physical mixers, it is possible to place any sound in an exact location or give it a multidirectional movement from top to bottom and vice versa, and from left to right and vice versa, thus achieving to place any sound at any of the 25 points of panning the present disclosure within the panoramic field delimited by its X and Y axes in a live presentation or concert.

The present disclosure therefore opens a new world of possibilities for the experiences by those attending a live concert or presentation, to whom the music producer can direct or move the sounds in real time within the panoramic field at different moments of the concert so that regardless of the place that the listener occupies, he can live an experience of listening to critical or favorite sounds in his physical space.

f) Virtual Mixers

The vector panning of the present disclosure can also be performed in an exemplary but non-limiting manner, through a special plug-in that must be included in the virtual mixers or DAW (Digital Audio Workstations), which is proposed by the present disclosure.

Said plug-in will attach horizontal and vertical panning tools to represent the panoramic field delimited by its X and Y axes described in part a) of point 1) vector panning in the present disclosure, therefore, said plug-in will be configured in such a way that it is possible to place any sound in any of the 25 panning points of the present disclosure within said panoramic field delimited by its X and Y axes.

Figure 14:
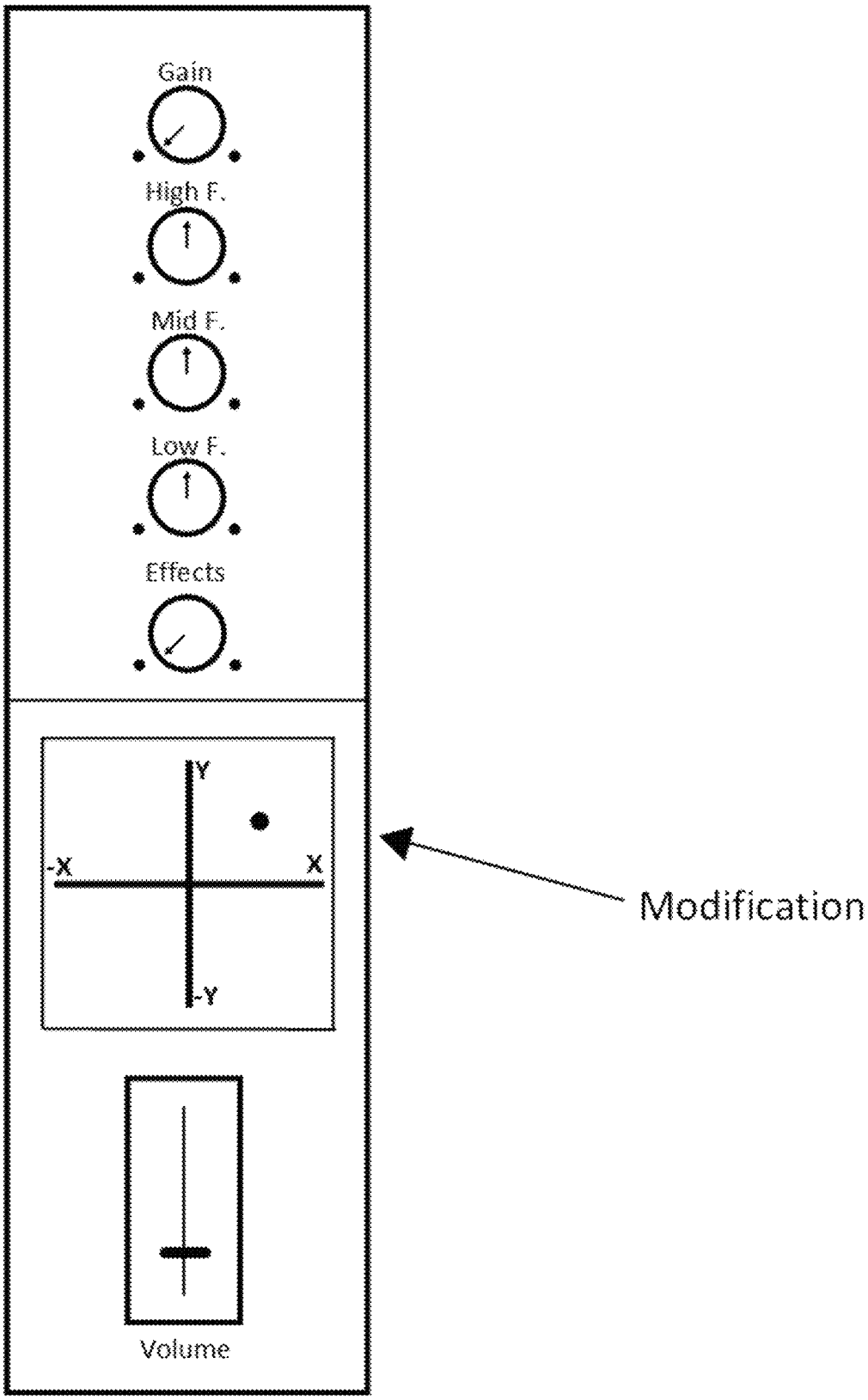
FIG. 14, shows a non-limiting representation of a graphical user interface of a plugin to make vector panoramas through a digital mixer or Digital Audio Workstation (DAW).

FIG. 14 shows a non-limiting representation of the visual appearance of the graphic user interface of said VST plug-in (Virtual Studio Technology) to be executed in the confines of a music sequencer or DAW (Digital Audio Workstation).

It should be noted that said plug-in must provide 2 virtual panning axes, one horizontal and one vertical in each line or audio track of a digital mixer or DAW (Digital Audio Workstation), therefore, with a single movement made through said graphic user interface, each sound can be placed in any of said 25 panning points within said panoramic field delimited by its X and Y axes.

When moving the multichannel control using said graphical user interface of said plug-in to any direction within the panoramic field delimited by its X and Y axes, the 2 virtual horizontal and vertical panning axes will assign the corresponding sound percentages to each audio output channel "V1", "V2", "V3", "V4", this in relation to the panning point at which it is decided to place each sound, thus giving the desired location to each sound within the panoramic field delimited by its X and Y axes.

g) Real-Time Vector Panning Method

The real-time vector panning method of the present disclosure aims to capture the sound with its location that is perceived in a certain panoramic in a real physical space. This panoramic from which the sounds that are perceived are captured, is delimited by placing four microphones that in turn form a vertical panoramic quadrangle in the desired real space of the location to be recorded, it should be noted that each microphone will capture the sounds that are perceived from its corresponding location.

The type of microphones as well as the recording equipment necessary for audio capture will depend completely on the needs in relation to the quality of the audio production being carried out, it should be noted that what is most necessary for the correct realization of the real-time vector panning method is the quadrangular location in which the microphones are placed to capture the sounds and perceive their exact location in the physical space where the recording is made.

Each of the 4 microphones will capture the content of its corresponding audio channel "V1", "V2", "V3" or "V4", therefore, these captured sounds will be reproduced through the systems of mono audio reproduction necessary for the vector audio reproduction equipment of the present disclosure and said mono audio reproduction systems will emit the sound in their corresponding area according to the real-time vector panning previously performed.

The real-time vector panning method of the present disclosure is ideal for capturing live concerts, capturing a musical group playing together at the same time or for capturing sounds for any audiovisual material, that is, the real-time vector panning method is not exclusively used for music, since you can also capture the sounds of scenes for movies, voices, natural ambient sounds, etc.

The real-time vector panning method of the present disclosure allows for a much faster vector audio production, since the panning will depend on where the sounds are captured at the time of applying the real-time vector panning method. It is important to understand that with this method it is impossible to give a movement that has not occurred during the capture of a particular sound in real time, for this, it would be necessary to perform a vector panning as previously described, where it is used a vector panning table and a digital mixer or a physical mixer that includes the aforementioned tools to perform said vector panning.

h) Frequency Adjustment Method

It is notorious that the human ear has suffered wear due to the evolution and auditory contamination of modern life, for this reason we do not clearly perceive the acute frequencies coming from the bottom of our physical listening space in relation to our head. In view of this, the current audio systems decide to direct the bass frequencies towards the bottom.

The present disclosure therefore inherently presents an additional technical advantage that consists in the ability of the frequency adjustment method to allow the placement of high-pitched sounds in the lower part, such that if a high-pitched sound is located in the lower part in relation to listening, can be listen to with its high frequencies from said lower part.

This method consists of making an adjustment of acute frequencies in the 2 lower audio output channels vector panned by means of a physical mixer or by means of a virtual mixer, otherwise, said adjustment of the acute frequencies can be made in the inputs of the 2 mono audio playback systems that are positioned at the bottom in relation to listening.

The adjustment of the high frequencies consists specifically of increasing from 6 to 9 decibels in each of the 2 lower audio output channels vector panned or in the inputs of the 2 mono audio reproduction systems that are positioned at the bottom in relation to listening. A person skilled in the art will understand the range of 6 to 9 decibels is technically justified and the precise value will depend on the reproduction equipment used.

The frequency adjustment method of the present disclosure as described above, allows several increased treble frequencies to gradually decrease as the sound moves up.

i) 4 Channel Audio File

Once the vector panning was carried out, since it had been done by means of a virtual mixer, a physical mixer or by means of the real-time vector panning method and after having made the frequency adjustment mentioned in the method of frequency adjustment, will result in 4 vector panned independent channels. These 4 channels must be merged (combined) into a 4-channel .WAV file, this .WAV file is available in professional digital mixer programs or DAW (Digital Audio Workstation) for recording studios. When the channels are combined, the parameters will be automatically adjusted to a multichannel output file and therefore the codec of the .WAV format will encode the four channels in a single playback file, thereby achieving a multichannel fade with 4 vector panned channels.

In order to make video productions with vector audio, it is necessary to merge (combine) the 4 channels obtained from vector panning into a 4-channel .MPG file, this file can be exported to the video editing programs and when finished the editing is obtained the video file with the 4-channel .MPG file merger, resulting in a new 4-channel .MPG video file vector panned.

In order to perform the vector panning of the present disclosure it is necessary to make precise use of the panning points described in the vector panning table, either to be done through digital mixers or through physical mixers, which must be comply with the necessary technical and operational characteristics, otherwise, make use of the real-time vector recording method, as well as applying the frequency adjustment method to obtain a previously 4-vector panned channel audio file. In addition, it is also essential for the vector reproduction of the present disclosure in performances or live concerts, to use the physical mixers with the specifications described above, otherwise the desired effect will not be obtained.

2) Single Format

In an exemplary but non-limiting manner, the present disclosure uses a set of algorithms that allow coding and decoding audio files for a specific purpose, in this case, converting vector audio files (which have 4 vector channels), in audio files with a unique format.

i. Coding

Once we have a 4-vector-panned. WAV audio file channel or a .MPG file in the case of a video with 4-vector panned audio channel, encoding is done through an own encoder to change the .WAV or .MPG format to a unique format, so that all audio files of 4 vector panned channels have a unique format to be able to make a media transmission to our own decoder. It should be noted that when talking about media transmission it means the ability to transfer said audio file in a single format through a USB device, a wireless medium, among others.

ii. Decoding

Once we have an audio file encoded with a unique format, it will be necessary to perform a specific decoding, which is done by means of a decoder of N input bits and M output lines, said decoder will decode the previously encoded audio files and in conjunction with a media player, they will direct the channels of the vector audio file to the different audio inputs of the vector audio reproduction equipment of the present disclosure, which will be described in detail below.

It should be noted that said decoder must be within said multimedia player, which will be described later.

iii. Multimedia Player

The multimedia file player performs all the basic functions of a player, such as reading, playing, stopping, forwarding, delaying and controlling the volume of an audio file, in addition, said multimedia player includes the mentioned decoder that contains the necessary algorithms for decode the previously encoded audio files, thus, the multimedia file player and said decoder, working together, direct the audio output channels V1, V2, V3 and V4 of the decoded vector audio file to the inputs of audio of the vector audio reproduction equipment of the present disclosure for correct reproduction, the addressing is done in relation to the vector panning performed in the production of said vector audio file.

Preferably, non limiting manner, the multimedia player can only reproduce the vector audio files having the unique format above mentioned, therefore, preferably, and without limiting it, said audio format can be considered as a unique and exclusive format for said multimedia player which can be considered as a unique and exclusive multimedia player for said audio format.

The multimedia player can work as a separate multimedia player or it could also be included in the vector audio reproduction equipment of the present disclosure, which will be described in detail below.

FIG. 15 shows a flow chart showing the transition of the elements used in encoding, decoding and multimedia player in accordance with what has been described above.

ii) Vector Playback Equipment

The present disclosure further includes its own vector audio playback equipment. In order to play audios made with the vector panning of the present disclosure, it is necessary to make exclusive use of said vector audio reproduction equipment, which will be described in detail as follows:

First, it is important to understand that audio productions made with the vector panning of the present disclosure have 4 audio channels vector panned, which are referred to herein as "V1", "V2", "V3" and "V4 channels." Therefore, said vector audio reproduction equipment has specific features and a joint operation that allow it to correctly reproduce said 4 vector-panned audio channels.

The vector playback equipment of the present disclosure uses only mono audio reproduction systems. The technical and economic advantages of using this type of mono audio reproduction systems of less complexity than stereo systems are evident to a person skilled in the art. The vector audio playback equipment of the present disclosure uses mono audio reproduction systems to obtain better performance in power, balance and functionality. It should be mentioned that each of the mono audio reproduction systems used to reproduce vector-panned audios must have its own independent amplifier, its own speakers and its own adjustment control in order to perform the frequency adjust method as mentioned in subsection h) of point 1) vector panning in the present disclosure.

Moreover, the playback equipment of the current audio systems, emit their frequencies in a specific way: Bass in the lower or bottom part, Medium in the middle part and Treble in the upper or top part, therefore, the vertical location of the sound always depends on the frequency it has.

On the other hand, the vector audio playback equipment of the present disclosure comprises mono audio reproduction systems, which are capable of emitting a full frequency range of treble, medium and bass each; therefore, you can appreciate any frequency range at any point within the panoramic field delimited by the position of said mono audio reproduction systems, additionally, the sounds will be heard in their designated location regardless of the frequencies they have. Due to the above, the vector audio playback equipment of the present disclosure does not need any subwoofer, with all the technical, economic, transpote, etc. advantages being evident.

The vector audio playback equipment is a fundamental part of the present disclosure, since otherwise, if any other audio reproduction equipment is used to playback vector-panned audios, the effect intended by the audio producer when performing vector panning will not be achieved.

The vector audio playback equipment works in 3 different embodiments, which offers options that can be better adapted to the needs or requirements of the listening, in all 3 embodiments mono audio reproduction systems are used with all characteristics previously mentioned. In addition, in said 3 embodiments, said 4 vector channels of V1, V2, V3 and V4 are correctly reproduced, which were obtained after performing the vector panning of the present disclosure. Therefore, the vector audio playback equipment of the present disclosure works with the following 3 embodiments:

Embodiment 1 (4 mono audio playback systems)

Embodiment 2 (4 mono audio playback systems)

Embodiment 3 (6 mono audio playback systems)

The characteristics and specifications necessary for each of the 3 embodiments are described in detail as follows, in which, what is described represents the preferred arrangement and embodiments to achieve a maximum point of appreciation, however, as can be understood, additional embodiments derived from the adjustment of values, position, angles and other possible variables are also included within the scope of the present disclosure:

Embodiment 1

The vector panning of the present disclosure creates 4 vector-panned channels, which are referred herein as "V1", "V2", "V3" and "V4" channels, therefore, in embodiment 1 comprises the use of 4 mono audio playback systems so that each one emits its corresponding vector-panned channel.

The 4 mono audio reproduction systems must be strategically positioned in the acoustic space of the listener, forming a quadrilateral or vertical quadrangle, where each of said mono audio reproduction systems must emit its corresponding vector-panned channel, as shown for example in FIG. 16, wherein;

A mono audio playback system called left-up is positioned in the upper left and corresponds to channel V1;

A mono audio playback system called right-up is positioned in the upper right and corresponds to the V2 channel;

A mono audio playback system called left-down is positioned in the lower left and corresponds to the V3 channel; and A mono audio playback system called right-down is positioned in the lower right and corresponds to the V4 channel.

In the embodiment 4 of the vector audio playback equipment of the present disclosure, said 4 mono audio reproduction systems should be placed preferably, non-limiting, specifically in relation to listening, as shown in FIG. 17, where;

A first mono audio reproduction system called left-down is arranged on the left side of the listener and at floor level, a second mono audio reproduction system denominated as right-down is disposed on the right side of the listener at floor level. The distance between the listener and the left-down mono audio reproduction system in a preferred manner, non limiting, will be the same between the listener and the right-down mono audio reproduction system and this will depend on the panoramic amplitude wished to perceive and the space available to install said vector audio playback equipment. A third mono audio reproduction system called left-up is arranged vertically aligned with respect to the mono left-down audio reproduction system and at a height delimited by twice the distance between the listener's head and the floor, a fourth system of mono audio reproduction called right-up is arranged vertically aligned with respect to the right-down mono audio reproduction system and at a height defined by twice the distance between the head of the listener and the floor.

Another relevant aspect for the correct arrangement of the vector audio playback equipment of the present disclosure in said Embodiment 1, correspond to the left mono audio reproduction systems must be directed to their corresponding right mono audio reproduction systems, this means that the left-down mono audio reproduction system must be directed to the right-down mono audio reproduction system and vice versa and the left-up mono audio reproduction system must be directed towards the mono right-up audio reproduction system vice versa. Moreover, the listener must be located right in the middle between the left mono audio reproduction systems in relation to the right mono audio reproduction systems, so that the sounds collide with each other and with the listener.

As previously mentioned, each mono audio playback system transmits a full frequency range of treble, mid and bass, and said mono audio reproduction systems must be positioned at certain angles and distances from each other and in relation to listener.

Embodiment 2

In relation to Embodiment 1, the vector panning of the present disclosure creates 4 vector-panned channels "V1", "V2", "V3" and "V4", therefore, Embodiment 2 also uses 4 mono audio playback systems so that each one emits its corresponding vector-panned channel, in addition, said mono audio playback systems must also be placed forming a quadrilateral or vertical quadrangle in the acoustic space of the listener.

In Embodiment 2, said 4 mono audio playback systems should be placed preferably, and not limited thereto, specifically in relation to listener, as shown in FIG. 18, where;

A first mono audio playback system called left-down is arranged in the left front part of the listener and at floor level, a second mono audio reproduction system denominated as right-down is arranged in the right front part of the listener and at floor level.

A third mono audio reproduction system called left-up is arranged vertically aligned with respect to the mono left-down audio reproduction system and preferably at a delimited height, for example, by twice the distance between the head of the listening and the floor, a fourth mono audio reproduction system called right-up is arranged vertically aligned with respect to the right-down mono audio playback system and at a height delimited by twice the distance between the listener's head and the I usually.

Furthermore, FIG. 18 shows preferably, non-limiting, an isosceles triangle must be formed between the listener and the mono audio playback systems, where; the first corner of said formed triangle is represented by the left mono audio playback systems, and the second corner of said formed triangle is represented by the right mono audio playback systems, therefore, the 3rd corner of said formed triangle It is represented by the listener.

Based on the foregoing described, it can be understood that the distance between the left mono audio playback systems and the right mono audio playback systems will depend on the panoramic amplitude that a person wishes to perceive and on the space available to install said playback equipment. In addition, it is possible to understand that the distance between the listener and the mono audio playback systems left-down, right-down, left-up and right-up will be delimited by respecting the internal angles of the formed triangle, moreover it can be understood that the distance between the listener and the left mono audio playback systems must be the same between the listener and the right mono audio playback systems.

In the Embodiment 2, the listener, in the preferred aspect, is located just in front of the 4 mono audio playback systems and said mono audio playback systems: left-down, right-down, left-up and right-up should be oriented relatively facing the listener.

Embodiment 3

In Embodiment 3 there is an important difference in relation to the previous Embodiments, since in the present it is possible to reproduce the 4 audio channels V1, V2, V3 and V4 through 6 mono audio playback systems.

It is necessary to understand that in order to achieve the above described, an intervention must be carried out in the process of vector audio playback, specifically at the moment in which the multimedia player as proposed by the present disclosure directs said audio output channels V1, V2, V3 and V4 towards their corresponding mono audio playback systems. FIG. 19 shows, for example, non-limiting, how this intervention occurs, which is described below.

Therefore, said intervention consists in said multimedia player directing the higher audio output channels V1 and V2 to the inputs of a first triangular audio system, which will perform an assignment of panning values to obtain 3 output channels of audio, which will be routed to the audio inputs of the 3 mono audio playback systems that must be placed on top in relation to the listener.

In this sense, said multimedia player must direct the lower audio output channels V3 and V4 to the inputs of a second triangular audio system, which will perform an assignment of panned values to obtain 3 channels of audio output, which will be addressed to the inputs of the 3 mono audio playback systems that must be placed at the bottom in relation to the listener.

FIG. 20 shows the arrangement of the 6 mono audio playback systems necessary for the present Embodiment 3, where 3 of them are placed at the top and 3 at the bottom, which will be described in detail below.

The assignment of panning values performed by each triangular audio system will be explained in detail below:

Such an audio triangular system is based in the structure of panning in the stereophonic mix, said audio triangular system uses 2 input audio channels and 3 output mono audio playback systems, also creates an assignment of panning values to obtain the audio signals corresponding to each one of the three mono audio playback systems, it is important to mention that the interaction of the audio signals obtained from the previous assignment of values causes the triangular effect of the present disclosure, additionally, the previously mentioned 3 mono audio playback systems must be capable of reproduce a full frequency range of treble, mid and bass tones each one, furthermore, said mono audio playback systems should be located at a certain distance and angles from each other and in relation to the listener.

This audio triangular system is based on the panning structure of music in stereophony to create a triangular effect in a form of semicircle with the stereophonic music or any stereophonic audio.

This audio triangular system comprise of a process of an assignment of values to obtain the audio signals corresponding to each one of the 3 mono audio playback systems, where the audio signal's interaction creates physical and virtual panning points to what we call as the triangular effect of the present disclosure, also, the audio triangular system comprises of 2 input audio channels and 3 output mono audio playback systems capable to emit a full range of treble, mid and bass frequencies each one so the use of a sub-woofer is unnecessary. The audio triangle system is also characterized because the 3 mono audio playback systems are located at a certain distance and angles from each other and in relation to the listener.

In another embodiment, the audio triangular system further comprises a processor, and a non-transient computer readable medium programmed with computer readable code that upon execution by the processor causes the processor to execute a method of assignment of panning values to obtain the audio signals for each one of the three mono audio playback systems.

In another embodiment, the audio triangular system, comprises also a way to execute the process of assignment of panning values through hardware to obtain the audio signals corresponding to each mono audio playback system.

It is important to mention that said triangular effect of the present disclosure can be done with the interaction of sound in the acoustic space to create a plurality of physical and virtual panning points, it is important to mention that said audio triangular effect of the present disclosure can also be executed through hardware with the interaction of signals obtained in the process of assignment of values, both ways to create the audio triangular effect, i.e. through acoustic space and through hardware, will be deeply described later in this document.

The audio triangular system is applied to 2 input audio channels to be transmitted in 3 output mono audio playback systems, by this way, the audio triangular system is created from 5 to up to "n" panning audio points which are formed by 3 physical points and from 2 up to "n" virtual points. This can be observed in FIG. 24

In an exemplary, but not limitative embodiment of the present disclosure, it will be described an audio triangular system 100 that has three physical points named "A", "B" and "C", and two virtual points named "D" and "E"; nevertheless, a person skilled in the art will understand that the audio triangular system 100 can locate an "n" number of virtual panning points in a single atmospheric plane of 180°, creating the sensation of space and body for the sounds and instruments, providing realism and quality for the sound recorded and mixed stereophonically.

It is essential to provide the three mono audio playback systems and that the 3 emit a full range of treble, mid and bass tones. The mono audio playback systems must be of the same size and power and must be calibrated to each other in relation to the volume and frequencies emitted by each one. Therefore, using mono audio playback systems that do not comply with all the above-mentioned parameters will not work for the audio triangular system 100.

Assignment of Panning Values to Obtain the Audio Signals Corresponding to Each One of the Three Mono Audio Playback Systems.

Once the physical representation of the audio triangular system 100 has been mentioned, it is necessary to mention another important aspect of the present disclosure: the method 200 of selection and assignment of values to obtain the audio signals corresponding to each one of the mono audio playback systems of the audio triangular system 100. The means for carrying out said values selection and assignment are well known by a person skilled in the art; some illustrative, but non-limiting examples of this means are, i.e., software elements such as sequencers, multitrack producer, expanders, phaser modulation, compressor limiters, maximizers, swap channels, surround fuse and commercial plugins, or hardware elements such as sequencers, mono mixer consoles, phase matrix, stereo widener, vocal remove, etc. In an exemplary embodiment, a computer system 300 for selecting and assigning values to obtain the audio signals corresponding to each one of the mono audio playback systems, which will be detailed below, may be included in the audio triangular system 100. Also, in an exemplary embodiment, a hardware system 400 for selecting and assigning values to obtain the audio signals corresponding to each one of the mono audio playback systems, which will be detailed below, may be included in the audio triangular system 100.

In an exemplary embodiment of the present method 200, we create the Assignment of values to obtain the audio signals corresponding to each of the three mono audio playback systems in accordance with the following process, wherein:

A, B, C, D, E=Panning points
L=Left Channel
R=Right Channel
Δ=Audio triangular effect
$\mathfrak{T}$=Merge
$\mathfrak{X}$=Interaction
wherein:
L=(A100/D75/C50/E25)
R=(D25/C50/E75/B100)
Embodiment 1
$Z_2$=Audio signal for the front mono system
$X_2$=Audio signal for the left lateral mono system
$Y_2$=Audio signal for the right lateral mono system
Embodiment 2
$Z_3$=Audio signal for the front mono system
$X_3$=Audio signal for the left lateral mono system
$Y_3$=Audio signal for the right lateral mono system Process of Assignment of Panning Values to Obtain the Audio Signals Corresponding to Each One of the Three Mono Audio Playback Systems.

wherein:

$$L \mathfrak{T} R = Z_2$$

$$(A100/D75/C50/E25) \mathfrak{T} (D25/C50/E75/B100) = (A100/D100/C100/E100/B100) = Z_2$$

wherein:

$$\mathfrak{T}\, 180° = W$$

$$(D25/C50/E75/B100) \mathfrak{T}\, 180° = (-D25/-C50/-E75/-B100) = W$$

wherein:

$$W \mathfrak{T} L = X_2$$

$$(-D25/-C50/-E75/-B100) \mathfrak{T} (A100/D75/C50/E25) = (A100/D50/-E50/-B100) = X_2$$

wherein $$X_2 \mathfrak{T} L = X_3$$

$$(A100/D50/-E50/-B100) \mathfrak{T} (A100/D75/C50/E25) = (A200/D125/C50/-E25/-B100) = X_3$$

wherein $$L \mathfrak{T}\, 180° = M$$

$$(A100/D75/C50/E25) \mathfrak{T}\, 180° = (-A100/-D75/-C50/-E25) = M$$

wherein $$M \mathfrak{T} R = Y_2$$

$$(-A100/-D75/-C50/-E25) \mathfrak{T} (D25/C50/E75/B100) = (-A100/-D50/E50/B100) = Y_2$$

wherein $$Y_2 \mathfrak{T} R = Y_3$$

$$(-A100/-D50/E50/B100) \mathfrak{T} (D25/C50/E75/B100) = (-A100/-D25/C50/E125/B200) = Y_3$$

wherein $$X_3 \mathfrak{T} Y_3 = Z_3$$

$$(A200/D125/C50/-E25/-B100) \mathfrak{T} (-A100/-D25/C50/E125/B200) = (A100/D100/C100/E100/B100) = Z_3$$

Explanation of the Process of Assignment of Panning Values to Obtain the Audio Signals Corresponding to Each One of the Three Mono Audio Playback Systems.

wherein:

$$L \mathfrak{T} R = Z_2$$

Left Channel $L$=(panning point $A$100%+panning point $D$75%+panning point $C$50%+panning point $E$25%) merged with Right Channel $R$=(panning point $D$25%+panning point $C$50%+panning point $E$75%+panning point $B$100%) results in (panning point $A$100%+panning point $D$100%+panning point $C$100%+panning point $E$100%+panning point $B$100%) what is named as audio signal for the front mono system=$Z_2$.

wherein:

$$R \mathfrak{T}\, 180° = W$$

Right Channel $R$=(panning point $D$25%+panning point $C$50%+panning point $E$75%+panning point $B$100%) merged at 180° results in =(panning point−$D$25%+panning point−$C$50%+panning point−$E$75%+panning point−$B$100%) what is named as phase $W$.

wherein:

$$W \mathfrak{T} L = X_2$$

Phase $W$=(panning point−$D$25%+panning point−$C$50%+panning point−$E$75%+panning point−$B$100%) merged with Left Channel $L$=(panning point $A$100%+panning point $D$75%+panning point $C$50%+panning point $E$25%) results in =(panning point $A$100%+panning point $D$50%+ panning point−$E$50%+panning point−$B$100%) what is named as audio signal for the left lateral mono system=$X_2$.

Wherein:

$X_2 \mathfrak{X} L = X_3$

Audio signal for the left lateral mono system $X_2$=(panning point $A$100%+panning point $D$50%+panning point−$E$50%+panning point−$B$100%) merged with left channel $L$=(panning point $A$100%+panning point $D$75%+panning point $C$50%+panning point $E$25%) results in =(panning point $A$200%+panning point $D$125%+panning point $C$50%+panning point−$E$25%+panning point−$B$100%) what is named as audio signal for the left lateral mono system=$X_3$.

wherein $L \mathfrak{X} 180° = M$

Left channel $L$=(panning point $A$100%+panning point $D$75%+panning point $C$50%+panning point $E$25%) merged at 180° results in =(panning point−$A$100%+panning point−$D$75%+panning point−$C$50%+panning point−$E$25%) what is named as phase $M$.

wherein $M \mathfrak{X} R = Y_2$

Phase $M$=(panning point−$A$100%+panning point−$D$75%+panning point−$C$50%+panning point−$E$25%) merged with right channel $R$=(panning point $D$25%+panning point $C$50%+panning point $E$75%+panning point $B$100%) results in =(panning point−$A$100%+panning point−$D$50%+panning point $E$50%+panning point $B$100%) what is named as audio signal for the right lateral mono system=$Y_2$ wherein $Y_2 \mathfrak{X} R = Y_3$ Audio Signal for the right lateral mono system $Y_2$=(panning point−$A$100%+panning point−$D$50%+panning point $E$50%+panning point $B$100%) merged with right channel $R$=(panning point $D$25%+panning point $C$50%+panning point $E$75%+panning point $B$100%) results in =(panning point−$A$100%+panning point−$D$25%+panning point $C$50%+panning point $E$125%+panning point $B$200%) what is named as audio signal for the right lateral mono system=$Y_3$ wherein $X_3 \mathfrak{X} Y_3 = Z_3$ Audio signal for the left lateral mono system $X_3$=(panning point $A$200%+panning point $D$125%+panning point $C$50%+panning point−$E$25%+panning point−$B$100%) merged with audio signal for the right lateral mono system $Y_3$=(panning point−$A$100%+panning point−$D$25%+panning point $C$50%+panning point $E$125%+panning point $B$200%) results in =(panning point $A$100%+panning point $D$100%+panning point $C$100%+panning point $E$100%+panning point $B$100%) what is named as audio signal for the front mono system=$Z_3$ It is important to mention that said process of assignment of values described before, can be done through software of through hardware, both embodiments will be explained later in this document.

Audio Triangular Effect of the Present Disclosure for its Two Embodiments: Embodiment $X_2$, $Z_2$, $Y_2$ and Embodiment $X_3$, $Z_3$, $Y_3$ Explanation of the Audio Triangular Effect in Embodiment $X_2Z_2Y_2$ The interaction of the audio signals $X_2$, $Z_2$ and $Y_2$ causes the triangular effect in each one of the mono audio playback systems, which results in the appreciation of the panning points A, D, C, E, B in the boundaries of the formed triangle, as it is represented in the FIG. 25 wherein:

$X_2 \mathfrak{X} Z_2 = \Delta X_2 = AD$ $Y_2 \mathfrak{X} Z_2 = \Delta Y_2 = BE$ $Z_2 \mathfrak{X} X_2 \mathfrak{X} Y_2 = \Delta Z_2 = CDE$ wherein:

The audio signal for the left lateral mono system $X_2$ in interaction with the audio signal for the front mono system $Z_2$ results in the triangular effect $\Delta X_2$ for creating the panning points "AD".

wherein:

The audio signal for the right lateral mono system $Y_2$ in interaction with the audio signal for the front mono system $Z_2$ results in the triangular effect $\Delta Y_2$ for creating the panning points "BE".

wherein:

The audio signal for the left lateral mono system $X_2$ in interaction with the audio signal for the front mono system $Z_2$ and at the same time the audio signal for the right lateral mono system $Y_2$ in interaction with the audio signal for the front mono audio system $Z_2$ results in the triangular effect $\Delta Z_2$ for creating the panning points "CDE".

wherein:

$$(A100/D50/\overset{X_2}{-E50}/-B100) \mathfrak{X} (A100/D100/\overset{Z_2}{C100}/E100/B100) \mathfrak{X} (-A100/-\overset{Y_2}{D50}/E50/B100) = (\overset{\Delta X_2}{A100/D50})(\overset{\Delta Z_2}{D50/C100}/E50)(\overset{\Delta Y_2}{E50/B100})$$

wherein:

The audio signal for the left lateral mono system $X_2$=(panning point A100%+panning point D50%+panning point−E50%+panning point−B100%) in interaction with the audio signal for the front mono system $Z_2$=(panning point A100%+panning point D100%+panning point C100%+panning point E100%+panning point B100%) in interaction with the audio signal right lateral mono system $Y_2$=(panning point−A100%+panning point−D50%+panning point E50%+panning point B100%) results in the triangular effects:

Triangular effect $\Delta X_2$=(panning point A100%+panning point D50%)

Triangular effect $\Delta Z_2$=(panning point D50%+panning point C100%+panning point E50%)

Triangular effect $\Delta Y_2$=(panning point E50%+panning point B100%)

Explanation of the audio triangular effect in embodiment $X_3Z_3Y_3$

The interaction of the audio signals $X_3$, $Z_3$ and $Y_3$ causes that the triangular effect in each one of the mono audio systems, which results in the appreciation of the panning points A, D, C, E, B in the boundaries of the formed triangle, as it is represented in the FIG. 26

Wherein:

$X_3 \between Z_3 = \Delta X_3 = AD$ $Y_3 \between Z_3 = \Delta Y_3 = BE$ $Z_3 \between X_3 \between Y_3 = \Delta Z_3 = CDE$ wherein:

The audio signal for the left lateral mono system $X_3$ in interaction with the audio signal for the front mono system $Z_3$, results in the triangular effect $\Delta X_3$ creating the panning points "AD".

wherein

The audio signal for the right lateral mono system $Y_3$ in interaction with the audio signal for the front mono system $Z_3$ results in the triangular effect $\Delta Y_3$ for creating the panning points "BE".

wherein:

The audio signal for the left lateral mono system $X_3$ in interaction with the audio signal for the front mono system $Z_3$ and at the same time the audio signal for the right lateral mono system $Y_3$ in interaction with the audio signal for the front mono audio system $Z_3$ results in the triangular effect $\Delta Z3$ for creating the panning points "CDE".

wherein $$(A200/D125/\overset{X_3}{C50}/-E25/-B100) \between (A100/D100/\overset{Z_3}{C100}/E100/B100) \between (-A100/-D25/\overset{Y_3}{C50}/E125/B200) = (\overset{\Delta X_3}{A200}/D125)(D75/\overset{\Delta Z_3}{C200}/E75)(E125/\overset{\Delta Y_3}{B200})$$

wherein

The audio signal for the left mono lateral system $X_3$=(panning point A200%+panning point D125%+panning point C50%+panning point−E25%+panning point−B100%) in interaction with the audio signal for the front mono system $Z_3$=(panning point A100%+panning point D100%+panning point C100%+panning point E100%+panning point B100%) in interaction with audio signal for the right lateral mono system $Y_3$=(panning point−A100%+panning point−D25%+panning point C50%+panning point E125%+panning point B200%) results in the triangular effects:

Triangular effect $\Delta X_3$=(panning point A200%+panning point D125%)

Triangular effect $\Delta Z_3$=(panning point D75%+panning point C200%+panning point E75%)

Triangular effect $\Delta Y_3$=(panning point E125%+panning point B200%)

In the FIGS. 27 and 28, it is shown the representation of the values applied to the mono audio playback systems in its two embodiments, respectively.

It is important to mention that said triangular effect described before can be done through the acoustic space and also can be done through hardware, both embodiments will be explained later in this document.

The reason why we do said assignment of values is unique and precise, as it allows placing the panning points corresponding to each mono audio playback system in the indicated position, also with the interaction of audio signals we generate the audio triangular effect of the present disclosure. If the assignment of values and the interaction of audio signals are not carried out properly, the audio triangular system 100 cannot be effective, so that what is described above as the assignment of values and audio triangular effect can be important essential for this disclosure.

Assignment of Panning Values Through Software

It is important to mention that the Process of Assignment of values to obtain the audio signals corresponding to each one of the three mono audio playback systems described before, can be made through software and it can be applied to both embodiments $X_2$ $Z_2$ $Y_2$ and $X_3$ $Z_3$ $Y_3$ of the present disclosure. In an exemplary but not limitative manner, the necessary elements to carry out said process of assigning values through software are shown.

FIG. 29 illustrates a block diagram of an exemplary embodiment of a computing system 300 for assigning values to obtain the audio signals corresponding to each one of the mono audio playback systems. The computing system 300 may be used to implement embodiments of portions of the audio triangular system 100, or in carrying out embodiments of the method 200.

The computing system 300 is generally a computing system that includes a processing system 306, a storage system 304, software 302, a communication interface 308, and a user interface 310. The processing system 306 loads and executes software 302 from the storage system 304, including a software module 320. When executed by computing system 300, software module 320 directs the processing system 306 to operate as described in herein in further detail in accordance with the above method 200.

The computing system 300 includes a software module 320 for executing method 200. Although computing system 300 as depicted in FIG. 18 includes one software module 320 in the present example, it should be understood that more modules could provide the same operation. Similarly, while the description as provided herein refers to a computing system 300 and a processing system 306, it is to be recognized that implementations of such systems can be performed using one or more processors, which may be communicatively connected, and such implementations are considered to be within the scope of the description. It is also contemplated that these components of computing system 300 may be operating in a number of physical locations.

The processing system 306 can comprise a microprocessor and other circuitry that retrieves and executes software 302 from storage system 304. The processing system 306 can be implemented within a single processing device but can also be distributed across multiple processing devices or sub-systems that cooperate in existing program instructions. Non-limiting examples of processing systems 306 include general purpose central processing units, application specific processors, and logic devices, as well as any other type of processing device, combinations of processing devices, or variations thereof.

The storage system 304 can comprise any storage media readable by processing system 306, and capable of storing software 302. The storage system 304 can include volatile and non-volatile, removable and non-removable media implemented in any method or technology for storage of information, such as computer readable instructions, data structures, program modules, or other information. The storage system 304 can be implemented as a single storage device but may also be implemented across multiple storage devices or sub-systems. The storage system 304 can further include additional elements, such a controller capable of communicating with the processing system 306.

Non-limiting examples of storage media include random access memory, read only memory, magnetic discs, optical discs, flash memory, virtual memory, and non-virtual memory, magnetic sets, magnetic tape, magnetic disc storage or other magnetic storage devices, or any other medium which can be used to store the desired information and that may be accessed by an instruction execution system, as well as any combination or variation thereof, or any other type of storage medium. In some implementations, the storage media can be a non-transitory storage media. In some implementations, at least a portion of the storage media may be transitory. Storage media may be internal or external to computing system 300.

As described in further detail herein, computing system 300 receives and transmits data through communication interface 308, particularly values for the stereophonic panning points which may be transmitted to the three mono audio playback output systems. The data can also include any of the above data used to set up or modify system 100, any calculated quantities or levels, and/or any other data that may pertain to system 100. In embodiments, the communication interface 308 also operates to send and/or receive information, such as, but not limited to, additional information to/from other systems to which computing system 300 is communicatively connected, input related to derived and/or calculated data, and/or any additional information that may pertain to system 100.

The user interface 310 can include one or more of a mouse, a keyboard, a voice input device, a touch input device for receiving a gesture from a user, a motion input device for detecting non-touch gestures and other motions by a user, and/or other comparable input devices and associated processing elements capable of receiving user input from a user. Output devices such as a video display or graphical display can display one or more of the selectable embodiments, values for the stereophonic panning points, or another interface further associated with embodiments of the system and method as disclosed herein. Speakers, printers, haptic devices and other types of output devices may also be included in the user interface 310. Users or other staff can communicate with computing system 300 through the user interface 310 in order to view derived and/or calculated data, to enter or receive any other data or additional information, or any number of other tasks the user may want to complete with computing system 300.

Assignment of Panning Values Through Hardware

It is important to mention that the Process of Assignment of values to obtain the audio signals corresponding to each one of the three mono audio playback systems described before, can also be made through hardware and it can be applied to both embodiments $X_2$ $Z_2$ $Y_2$ and $X_3$ $Z_3$ $Y_3$ of the present disclosure. In an exemplary but not limitative manner, the necessary elements to carry out said process of assigning values through hardware are shown.

The FIG. 30 illustrate a block diagram representing an exemplary embodiment of a hardware system 400 for assigning values to obtain the audio signal corresponding to each one of the three mono audio playback systems.

The hardware system 400 includes and uses a hardware audio multiplier 410, at least a first audio modulator hardware 421, at least a second audio modulator hardware 422, at least a third audio modulator hardware 423, at least a first audio splitter out hardware 431, at least a second audio splitter out hardware 432, at least a third audio splitter out hardware 433.

The audio multiplier hardware 410 receives a stereophonic audio signal and replicate said signal in order to send the same to each one of the at least three audio modulators hardware 421, 422 and 423.

The first audio modulator hardware 421 modulates the stereophonic audio signal received by the same in order to convert said signal into a first modulated audio signal AB, the second audio modulator hardware 422 modulates the stereophonic audio signal received by the same in order to convert said signal into a second modulated audio signal ACB, the third audio modulator hardware 423 modulates the stereophonic audio signal received by the same in order to convert said signal into a third modulated audio signal BA.

The first audio modulator hardware 421 send the first modulated audio signal AB to the first audio splitter out hardware 431, which divides the audio signal received in order to convert said signal into a new audio signal X to reproduce the same in its corresponding left mono audio playback system.

The second audio modulator hardware 422 send the second modulated audio signal ACB to the second audio splitter out hardware 432, which divides the audio signal received by the same in order to convert said signal into a new audio signal Z to reproduce the same in its corresponding front central mono audio playback system.

The third audio modulator hardware 423 send the third modulated audio signal BA to the third audio splitter out hardware 433, which divides the audio signal received by the same in order to convert said signal into a new audio signal Y to reproduce the same in its corresponding right mono audio playback system.

It is important to mention that the principal objective of said process to create the assignment of values through hardware is to obtain the audio signals X, Z and Y for any of the both embodiments $X_2$, $Z_2$, $Y_2$ and embodiment $X_3$, $Z_3$, $Y_3$, those audio signals correspond to each one of the three mono audio playback systems of the present disclosure.

To illustrate the result of the audio signals obtained from the assignment of values described above, the following graphic captures of the audio lines of both modalities were made.

The FIGS. 31*a* and 31*b* illustrate a graphic representation that show graphic results for both embodiments $X_2$, $Z_2$, $Y_2$ and $X_3$, $Z_3$, $Y_3$ after the realization of the previous said assignment of values to obtain the audio signal corresponding to each one of the three mono audio playback systems, therefore, the FIGS. 31*a* and 31*b* allow us to appreciate the graphic representation of the audio signal of each channel out to see the differences obtained between both embodiments of the present disclosure: embodiment $X_2$, $Z_2$, $Y_2$ and $X_3$, $Z_3$, $Y_3$. It is important to mention that said assignment of values to obtain the audio signals for each one of the mono audio playback systems for each one of the two embodiments could have been done through software or through hardware as described before in this document.

Triangular Effect Through the Acoustic Space

It is important to mention that the triangular audio effect of the present disclosure described before can be done in the acoustic space of the listener, this means that it occurs during the appreciation of the sound being reproduced by the triangular audio system, said triangular effect in the acoustic space works for both embodiments $X_2Z_2Y_2$ and embodiment $X_3Z_3Y_3$ of the present disclosure, in addition, it is just as effective if the previous assignment of values was made through software or hardware. In an exemplary but no limitative manner, the interaction of the values of the audio signals coming out of each mono audio playback system in the acoustic space is shown to achieve the triangular audio effect.

The front central mono audio playback system interacts with both the left lateral mono audio playback system and the right lateral mono audio playback system, but the lateral mono systems never interact with each other, this is because the distance between them is almost twice the distance that they have with the front central mono system, this is very important, because if they do not meet the required distance, the interaction of the values of the audio signals coming out of each one of the mono audio playback system will not be made in the physical space correctly, and the body and panning of the sound cannot be created.

The interaction process of the values of the audio signals coming out of each one of the mono audio playback systems makes that the negatives of each letter interact with the positives of the same letter, resulting in the five main points of panning obtained in the following way:

Interaction of the Values of the Audio Signals Coming Out of Each One of the Three Mono Audio Playback Systems to Create the Triangular Effect in Both Embodiments.

The elimination in the triangular physical space occurs with the interaction of panning percentages between the lateral mono audio playback systems with central mono audio playback systems, starting with the elimination of negative percentages with the positives as shown in FIGS. 32*a* and 32*b* that can be used as reference in the explanation of the following two embodiments.

Explanation of Embodiment $X_2$, $Z_2$, $Y_2$

The −B100 value of the left lateral mono audio playback system is eliminated by interacting with the B100 of the front central mono audio playback system, eliminating completely both values for both mono audio playback systems in the triangular audio space.

The −A100 value of the right lateral mono audio playback system eliminates the A100 value of the front central mono audio playback system, eliminating completely both values for both mono audio playback systems in the triangular audio space.

The −E50 value of the left lateral mono audio playback system is eliminated by interacting with the E100 of the front central mono audio playback system, leaving a new value for the front central mono audio playback system E50. This new E50 value can now interact with the E50 value of the right lateral mono audio playback system, as being the result of a previous interaction, the positives can be added throwing the new virtual audio point with its new E100 value in the triangular audio space.

The −D50 value of the right lateral mono audio playback system is eliminated by interacting with the D100 of the front central mono audio playback system, leaving a new value for the front central mono audio playback system D50. This new D50 value can now interact with the D50 value of the left lateral mono audio playback system, as being the result of a previous interaction, the positives can be added throwing the new virtual audio point with its new D100 value in the triangular audio space.

The C0 value of the left lateral mono audio playback system cannot interact with the front central mono audio playback system because its value is 0.

The C0 value of the right lateral mono audio playback system cannot interact with the front central mono audio playback system because its value is 0.

The A100 value of the left lateral mono audio playback system cannot eliminate any value from the front central mono audio playback system since the A100 contained by the front central mono audio playback system has already been previously eliminated. Now the only point that will contain the A100 value will be the left lateral mono audio playback system in the triangular audio space.

The B100 value of the right lateral mono audio playback system cannot eliminate any value from the front central mono audio playback system since the B100 contained by the front central mono audio playback system has already been previously eliminated. Now the only point that will contain the B100 value is the right lateral mono audio playback system in the triangular audio space.

After the interaction of both lateral mono audio playback systems with the front central mono audio playback system, the only point where the C100 value is located is in the front central mono audio playback system in the triangular audio space.

Explanation of Embodiment $X_3$, $Z_3$, $Y_3$

The −B100 value of the left lateral mono audio playback system is eliminated by interacting with the B100 of the front central mono audio playback system, eliminating completely both values for both mono audio playback systems in the triangular audio space.

The −A100 value of the right lateral mono audio playback system eliminates the A100 value of the front central mono audio playback system, eliminating completely both values for both mono audio playback systems in the triangular audio space.

The −E25 value of the left lateral mono audio playback system is eliminated by interacting with the E100 of the front central mono audio playback system, leaving a new value for the front central mono audio playback system E75. This new E75 value can now interact with the E125 value of the right lateral mono audio playback system, as being the result of a previous interaction, the positives can be added throwing the new virtual audio point with its new E200 value in the triangular audio space.

The −D25 value of the right lateral mono audio playback system is eliminated by interacting with the D100 of the font central mono audio playback system, leaving a new value for the front central mono audio playback system D75. This new D75 value can now interact with the D125 value of the left lateral mono audio playback system, as being the result of a previous interaction, the positives can be added throwing the new virtual audio point with its new D200 value in the triangular audio space.

The C50 value of the left lateral mono audio playback system interact with the C100 value of the front central mono audio playback system and at the same time the C50 value of the right lateral mono audio playback system interact with the C100 value of the front central mono audio playback system creating a new C200 value for the front central mono audio playback system.

The A200 value of the left lateral mono audio playback system cannot eliminate any value from the front central mono audio playback system since the A100 contained by the front central mono audio playback system has already been previously eliminated. Now the only point that will contain the A200 value will be the left lateral mono audio playback system in the triangular audio space.

The B200 value of the right lateral mono audio playback system cannot eliminate any value from the front central mono audio playback system since the B100 contained by the front central mono audio playback system has already been previously eliminated. Now the only point that will contain the B200 value is the right lateral mono audio playback system in the triangular audio space.

By complementing audio signal of the Left mono audio playback system with the audio signal of the frontal central mono audio playback system and at the same time, complementing the audio signal of the right mono audio playback system with the audio signal of the frontal central mono audio playback system for both embodiments above described, it can be obtained 100% of each of the panning points "A" "D" "C" "E" "B" in a new triangular panning. This way obtains the higher value of each panning point, regardless of the number of virtual points that the user wishes to create.

By carrying out the values assignment previously described above and thanks to the interaction of the values themselves, the system is able to create a complete spatial atmosphere of sounds with their own body and depth, granting the ability of approaching the "n" number of panning points at 100%.

Triangular Effect Through Hardware

It is important to mention that the triangular audio effect of the present disclosure previously described can also be done through hardware and for both embodiments $X_2Z_2Y_2$ and $X_3Z_3Y_3$, in addition, it is equally effective if the previous assignment of values was made through software or hardware. In an exemplary but not limitative manner, the necessary elements to create the triangular audio effect through hardware are shown.

The FIG. 33 illustrates a block diagram of an exemplary embodiment to accomplish the triangular audio effect 600 of the present disclosure through the hardware system 500.

The hardware system 500 includes and uses at least one of the first audio splitter hardware 531, at least a second audio splitter hardware 532, at least a third audio splitter hardware 533, at least one of the first audio mixer out hardware 541, at least a second audio mixer out hardware 542 and at least a third audio mixer out hardware 543.

The first audio splitter hardware 531 receives the audio signal ACB obtained from the previous assignment of values, splits said audio signal and convert it into a new audio signal XY, the second audio splitter hardware 532 receives the audio signal AB obtained from the previous assignment of values, splits said audio signal and convert it into a new audio signal XZ, the third audio splitter hardware 533 receives the audio signal BA obtained from the previous assignment of values, splits said audio signal and convert it into a new audio signal YZ.

It is important to mention that said previous assignment of values could have been done through software or through hardware, both methods have been described above in this document.

It is important to mention that each one of the at least three audio splitter hardware 531, 532 and 533 are interconnected to each other internally.

The first mixer out of audio hardware 541 receives the audio signals from the first audio splitter hardware 531 and the second audio splitter hardware 532 to generate a new audio signal X, which will be reproduced by its corresponding left mono audio playback system.

The second mixer out of audio hardware 542 receives the audio signals from the first audio splitter hardware 531 and from the third audio splitter hardware 533 to generate a new audio signal Y, which will be reproduced by its corresponding right mono audio playback system.

The third mixer out of audio hardware 543 receives the audio signals from the second audio splitter hardware 532 and from the third audio splitter hardware 533 to generate a new audio signal Z, which will be played/reproduced by its corresponding front central mono audio playback system.

To illustrate the result of the audio signals obtained from the assignment of values described above, the following graphic captures of the audio lines of both modalities were made.

The FIG. 34 illustrates the graphic representation that show us the graphic results after the audio triangular effect has been applied for both embodiments through hardware to the corresponding audio signals for each one of the three mono audio playback systems, therefore, this FIG. 34 allow us to appreciate the graphic representation of audio signal of each channel out of the present disclosure. It is important to mention that said assignment of values to obtain the audio signals for each one of the three mono audio playback systems for each one of the two embodiments could have been done through software of through hardware as previously described. It is important to reaffirm that said FIG. 34 show us the graphic results after the audio triangular effect has been applied to through hardware to the audio signals obtained from the previous assignment of values.

Location and Angles Needed for the Three Mono Audio Playback Systems for the Audio Triangular System 100.

The audio triangular system 100 comprises three mono audio playback systems, one in front of the listener, one on the left in relation to the listener and one on the right in relation to the listener.

Each mono audio playback system must comply with the following technical specifications as a minimal requirement for being applied to the audio triangular system 100 of the present disclosure:

Each one of the mono audio playback systems emit in a complete range of treble, mid and bass tones, with bass having a frequency of approximately 10 Hz to approximately 300 Hz, mid having a frequency of approximately 300 Hz to approximately 2.4 kHz, and treble having a frequency of approximately 2.4 kHz to approximately 20 kHz. The three mono audio playback systems must be of the same size and power and they shall be also calibrated to each other in relation to the volume and frequencies emitted by each mono audio playback system.

The rule of location of the mono audio playback systems for the audio triangular system 100 is that there must be the same distance (1×) between the listener and each mono audio playback system, that is to say, if the listener is located 2 meters from the front mono audio playback system, the lateral mono audio playback systems must be also aligned in relation to the listener and each one must be 2 meters away from him/her, forming an isosceles triangle, as can be seen in FIG. 35

When creating an isosceles triangle with the location of the mono audio playback systems, the internal angles of the formed triangle must be delimited, the angle of the front corner must be 90 degrees, while the two angles of the side corners must be 45 degrees each. It should be noted that the three mono audio playback systems must be oriented to the head of the listener, as shown in FIG. 36

It is important to mention that said location and angles necessary for the mono audio playback systems of the audio triangular systems 100 describe the ideal exemplary embodiment for listening the audio triangular system 100, since said location and angles specified above offer the maximum appreciation point towards the listener.

However, there is an embodiment in which the distance of the front mono audio playback system with relation to the listener can be modified when necessary due to the features of the space in which the playback equipment will be placed. This means that said front mono audio playback system may be placed closer or farther while it maintains the audio triangular system 100 effect. In order to achieve this, the formulas shown in the FIG. 37 which allows to calculate the relationship between the sound level (L) in decibels (dB) (what is known as sound pressure level or sound intensity level) depending on the distance (r). This formula is well known in the prior art. By correctly applying the abovementioned formula, the system of the present disclosure will continue being effective.

The above formula should only be allowed to modify the distance of the front mono audio playback system with relation to the listener. However, the distance of the lateral mono audio playback systems with relation to the listener always must be the same, that is to say, if the left mono audio playback system is at a distance (1×) with relation to the listener, the right mono audio playback system must be maintained to the same distance (1×) with relation to the listener.

Therefore, the distance between the front mono audio playback system and the listener can be increased or reduced as long as the abovementioned formula is correctly applied and both of the right and left lateral mono audio playback system are maintained at the same distance each one in relation to the listener.

Due to the specified above, it is important to understand that the inner angles of the triangle formed by the three mono audio playback systems are related with the distance that exists between the listener and each mono audio playback system. As a result, said angles will vary in accordance with the modification of the distance between the front mono audio playback system and the listener.

It is important to mention that the effect of the audio triangular system 100 is achieved by locating the three mono audio playback systems at the same distance in relation the listener. The effect will always be better than that which is achieved by modifying the distance of the front mono audio playback system in relation of the listener, in spite of having correctly used the abovementioned formula. The effect cannot be achieved otherwise due to the spatial geometry and harmony that is obtained when the three mono audio playback system are located at the same distance with relation to the listener.

Therefore, although the effect of the audio triangular system 100 can be appreciated in those cases in which is necessary to modify the distance between the front mono audio playback system and the listener by correctly using the aforementioned formula, this is not the best way to listen the audio that is generated by the present disclosure.

If the mono audio playback systems are not accommodated at the same separation distance in relation to the listener and the internal angles of the triangle formed by said mono audio playback systems are not respected, which correspond to the front corner with 90° and the two angles of the side corners with 45° each, as shown in FIG. 36, the optimal operation of the audio triangular system 100 would not achieved. It is important to understand that in those cases in which it is necessary to modify the distance between the front mono audio playback system and the listener, the inner angles of the formed triangle would be automatically modified, furthermore, it will be necessary to exactly use the aforementioned formula, so it is fundamental to respect these parameters for its effective operation.

The audio triangular system begins with the assignment of specific values to obtain the audio signals corresponding to each one of the mono audio playback system to create the audio triangular effect which generates the physical and virtual panning points in the contour of the triangle or frontal semicircle formed by the specific location of the mono audio playback systems. By this way it gives a specific and marked location to the sounds in relation to the original stereophonic mix and panning.

Because of the foregoing described for this disclosure, it is absolutely necessary that the following parameters be rigorously followed:

1) The assignment of the specific values to obtain the audio signals corresponding to each one of the three mono audio playback systems for its two embodiments $X_2$, $Z_2$, $Y_2$ and embodiment $X_2$, $Z_2$, $Y_2$ 2) Audio triangular effect of the present disclosure in its two embodiments $X_2$, $Z_2$, $Y_2$ and embodiment $X_3$, $Z_3$, $Y_3$.

3) The location, distances and angles of the three mono audio playback systems.

Otherwise, the audio triangular system 100 will not be effective.

Multichannel Replication

It is important to mention that the audio triangular system 100 described above can be simultaneously reproduced or replicated as many times as necessary for use in various applications. The terms "reproduce", or "replicate" should be understood as the simultaneous use of an additional audio triangular system 100 or several additional audio triangular systems 100 for an application in a particular device or system. In an exemplary, but not limitative way, the audio triangular system 100 of the present disclosure can be replicated as many times as necessary to apply it simultaneously into a multi-channel system in stereo pairs. By way of non-limiting example, the audio triangular system 100 of the present disclosure can be duplicated to be applied in multichannel systems with 4 channels formed by 2 stereo systems. In the same way, the audio triangular system 100 of the present disclosure can be tripled for its application in multichannel systems of 6 channels formed by 3 stereo systems. In another embodiment of the disclosure, the audio triangular system can be quadruple and applied in multichannel systems of 8 channels formed by 4 stereo systems. A person skilled in the art will appreciate that the audio triangular system 100 can be simultaneously replicated or reproduced as many times as necessary for its application for any one multi-channel system in stereo pairs.

It is important to understand that all the aspects mentioned above, describe the manner in which a triangular system intervenes on two audio channels (L channel and R channel) to create three audio channels, and therefore, in the scope of the embodiment 3 described in this application the vectoral playback system/equipment utilizes two triangular audio systems that intervene 4 audio channels (V1, V2, V3, V4) to create 6 audio channels, same that can be reproduced through 6 mono audio playback systems.

Therefore, in the embodiment 3 said 6 mono audio playback systems should be placed, in a preferred embodiment and without limitation to it, in a specific manner in relation to the hearer's position as showed in FIG. 21, wherein a first mono audio playback system identified as left-down is located at the left side of the hearer's position at a floor level, a second mono audio playback system identified as right-down is located at the right side of the hearer's position at a floor level. It is important to highlight that the distance between the hearer's position and the left down system should be the same between the hearer's position and the right down system, and this will depend of the panoramic amplitude that needs to be perceived and the space available to install the vector playback system.

A third mono audio playback system identified as left-up is located vertically aligned in relation to the mono audio playback system identified as left-down and in a height that is determined as a two-fold between the listener's head and the floor. A fourth mono audio playback system called right-up, is vertically aligned with respect to the right-down mono audio reproduction system and at a height delimited by twice the distance between the head of the listener and the floor. A fifth mono audio reproduction system called central-down is arranged in front of the listener and at floor level, it is important to note that the distance between the listener and said central down mono audio reproduction system should be the same between the listener and the left-down and right-down mono audio playback systems. A sixth mono audio playback system called central-up is arranged vertically aligned relative to the central-down mono audio playback system and at a height limited by twice the distance between the head of the listener and the floor/ground.

It is important to mention due to the above, that said 6 mono audio playback/reproduction systems left-down, right-down, left-up, right-up, central-down y central-up have the same distance to the head of the listener and said 6 mono audio playback systems should be oriented towards the listener.

FIG. 22 shows as a way of example, without limitation to it, that said arrangement that utilizes 6 mono audio playback systems creates a curve in the panoramic field that can be appreciated in front of the listener (emphasis added) when vectorial panoramized audios are reproduced; wherein said panoramic field surrounds the listener in a way similar to panoramic a semicircle, which generates an acoustic effect of deepness and amplitude both in the horizontal and vertical planes offering therefore "a 3D experience" which improves and broadens the intentions of the music producer in the acoustic space of the listener allowing at the same time to respect the vectorial panoramizing created by the audio producer.

FIG. 23 shows a general flow diagram, which demonstrates the interaction and connection between the different elements that the present application encompasses, as well as the dependency for those elements to work together and achieve the results intended. This is how FIG. 23 shows the relation between the vectorial panoramization, the vectorial audio playback system and the triangular audio system, demonstrating the way in which each element is needed to construct embodiment 3 of the present application and achieve the desired results.

The acoustic results that is achieved by the present application, and that can be sensed in the sweet spot of any of the three preferred embodiments of the application (that could be taken as a comparative element vs the prior art), differ from all of those previously known as the present application achieves such results based on different factors, such as the fact that the playback audio system of the present application emits a full range of frequencies in low medium and treble sounds and therefore does not needs to incorporate any subwoofer, which according to the teachings of the prior art would affect the performance and acoustic result in the sweet spot due to the elevated concentration of treble frequencies in the lower space of the listener's acoustic space. Therefore, with any of the three embodiments of the present application, it is possible to appreciate sounds with any frequency range coming from any location point in the acoustic space of the listener, which are related also to the vectoral panoramizing activities of the audio producer.

Another one of the facts that demonstrates the technical advantages of the audio system of the present application is that it creates a symmetric geometry through the disposition of the mono audio playback systems utilized in any of its three preferred embodiments, and furthermore, the system of the present application utilizes the full vertical physical space of the listener, which allows for the appreciation of sound be broader. Also, another factor that aids in achieving the acoustic result of the present application and that can be best appreciated, for instance, in the sweet spot of any of the preferred embodiments of the present application is the distance between each mono audio playback system in relation to the listener's position and the audio percentages as this two conditions allow that sounds collide with each other and with the listener, finally achieving that the listener becomes not merely an expectator but and integral part of the audio experience when it receives and perceives the harmony and the harmonics generated by the systems of the present application.

It is also a fact that the technical principles governing the 1D, and 3D systems would suggest on the one hand, that if the skilled artisan was only in possession and aware of the technical features of 1D audio system, that migrating to a 2D system would be economically unfeasible. Also, and on the other hand, if a 3D system were considered to be migrated to a 2D system, the skilled artisan would expect a detract from the quality and possibilities (especially of sound depth); and therefore a skilled artisan would not be in possibilities to obviously deduce a 2D system like the one described in the present disclosure, in which all frequencies (low, medium and trebele) are possible at any position of the any panning points; in which the range of height (verticality) of the sounds is complete and not only of medium height as in the case of 3D systems that are unable to position high and medium sounds in the lower part of the spectrum; in which the acoustic appreciation of the sounds occurs preferentially frontally, which makes the depth more realistic without sounds coming from the back of the listening (which even generate auditory stress in the listening); and where there are strategically located panoramic points to generate geometric harmony that translates into harmonics that are perceived by the listener.

The audio vector system of the present disclosure in any of its embodiments can be applied in any of the following technical fields: music production (vector panning), digital mixers, physical mixers, audio reproduction equipment, audio reproduction equipment in video, streaming, video games, virtual reality devices, headphones and portable music devices.

The invention claimed is:

1. A method for generation and reproduction of vector panned audio to change the sound dimension and produce an evolving experience in a physical space of the listener, the method comprising:

a) generating a vector panned audio that includes 25 panning points place on 8 stereophonic pan lines which are contained in 4 audio channels "V2", "V2", "V3" and "V4" to create an audio in a horizontal and vertical plane;

b) reproducing said vector panned audio through a vector playback equipment to adjust and remix said vector panned audio, wherein said playback equipment comprises 4 mono audio playback systems, wherein each of said 4 mono audio playback systems has a frequency adjustment depending on its location and wherein said 4 mono audio playback systems are placed forming a quadrangle or quadrilateral in front of the listener or at the sides of the listener, two of them placed at the upper part and two at the bottom part; wherein each mono audio playback system reproduce its corresponding audio channel V1, V2, V3 or V4;

c) creating a specific audio format through an encoder for said vector panned audio to allow its multimedia playing;

d) reproducing said vector panned audio with said specific audio format through another playback equipment, which comprises a multimedia player that contains an audio decoder, 2 Triangular Audio Systems, and 6 mono audio playback systems, wherein each of said 6 mono audio playback systems has a frequency adjustment depending on its location and wherein said 6 mono audio playback systems are played with 3 on the upper part in relation to the listener and 3 on the bottom part in relation to the listener to produce the evolving experience.

2. The method for the generation and reproduction of vector panned audio according to claim 1, wherein the generation of the vector panning audio comprises:

a) creating a panoramic field delimited by X and Y axes by means of 4 physical pan points, which are created with the said audio channels V1, V2, V3 and V4, wherein each audio channel is assigned to its corresponding physical pan point;

b) setting an individual position of the 8 stereophonic pan lines within a panoramic field delimited by X and Y axes using 4 audio channels V1, V2, V3 and V4;

c) setting a plurality of pan points on each of said 8 stereophonic pan lines to obtain 25 panning points;

d) using a vector panning table to place each sound at any of the said 25 panning points which are in said 8 stereophonic pan lines;

e) using a pair of physical or virtual vector panning controls to apply sound panning percentages indicated in said vector panning table to place each sound at any of said 25 panning points found on said 8 stereophonic pan lines.

3. The method for the generation and reproduction of vector panned audio according to claim 2, wherein the individual position of each of the 8 stereophonic pan lines is established within said panoramic field when the stereophonic pan line "1-2" is located horizontally on the upper perimeter of said panoramic field, which is achieved using channels V1 and V2, the stereophonic pan line "3-4" is located horizontally on the lower perimeter of said panoramic field, which is achieved using channels V3 and V4, the stereophonic pan line "5-6" is placed vertically on the left perimeter of said panoramic field, which is achieved using channels V3 and V1, the stereophonic pan line "7-8" is located vertically on the right perimeter of said panoramic field, which is achieved using channels V2 and V4, the stereophonic pan line "9-10" is located diagonally from the lower left corner up to the upper right corner of said panoramic field, which is achieved using channels V3 and V2, the stereophonic pan line "11-12" is located diagonally from the upper left corner to the lower right corner of said panoramic field, which is achieved using channels V1 and V4, the stereophonic pan line "13-14" is located horizontally on the "X" axis of said panoramic field, which is achieved using channels V1 and V3 and at the same time the channels V2 and V4, and, the stereophonic pan line "15-16" is placed vertically on the "Y" axis of said panoramic field, which is achieved using channels V1 and V2 and at the same time channels V3 and V4.

4. The method for the generation and reproduction of vector panned audio according to claim 2, wherein 5 panning points are established on each one of the said 8 stereophonic pan lines, thus yielding the 25 panning points of which 4 correspond to physical panning points, specifically points 1, 5, 21 and 25, and the remaining 21 points correspond to virtual panning points, wherein;

on the stereophonic pan line "1-2" there are placed the panning points 1, 2, 3, 4 and 5, on the stereophonic pan line "3-4" there are panning points 21, 22, 23, 24 and 25, on the stereophonic pan line "5-6" there are panning points 1, 6, 11, 16 and 21, on the stereo pan line "7-8" there are panning points 5, 10, 15, 20 and 25, in the stereophonic pan line "9-10" there are the panning points 5, 9, 13, 17 and 21, in the stereophonic pan line "11-12" there are the panning points 1, 7, 13, 19 and 25, in the stereophonic pan line "13-14" there are the panning points 11, 12, 13, 14 and 15, and, in the stereophonic pan line "15-16" there are the panning points 3, 8, 13, 18 and 23.

5. The method for the generation and reproduction of vector panned audio according to claim 2, wherein said vector panning table indicates the specific audio percentage or percentages that should be assigned in 1, 2 or 4 of the said output audio channels "V1", "V2", "V3", "V4" to place a sound at any of the 25 panning points wherein to place a sound at panning point "1" the 100% of a sound is sent only to channel "V1", to place a sound at panning point "2" the 75% of said sound is sent to channel "V1" and the 25% of the same sound is sent to channel "V2", to place a sound at panning point "3" the 50% of said sound is sent to channel "V1" and the 50% of the same sound is sent to channel "V2", to place a sound at panning point "4" the 25% of said sound is sent to channel "V1" and the 75% of the same sound is sent to channel "V2", to place a sound at panning point "5" the 100% of that sound is sent to channel "V2" only, to place a sound at the panning point "6" the 75% of that sound is sent to the channel "V1" and the 25% of the same sound is sent to channel "V3", to place a sound at the panning point "7" the 75% of said sound is sent to channel "V1" and the 25% of the same sound is sent to channel "V4", to place a sound at panning point "8" the 75% of that sound evenly divided is sent towards channels "V1 and V2" and the 25% of the same sound evenly divided is sent towards channels "V3 and V4", to place a sound at the panning point "9" the 75% of said sound is sent to channel "V2" and the 25% of the same sound is sent to channel "V3", to place a sound at the panning point "10" the 75% of said sound is sent to channel "V2" and the 25% of the same sound is sent to channel "V4", to place a sound at the panning point "11" the 50% of said sound is sent to channel "V1" and the 50% of the same sound is sent to channel "V3", to place a sound at panning point "12" the 75% of that sound evenly divided is sent to channels "V1 and V3" and the 25% of the same sound evenly divided is sent to channels "V2 and V4", to place a sound at panning pint "13" the 50% of that sound evenly divided is sent to channels "V1" and "V2" and the 50% of the same sound evenly divided is sent to channels "V3" and "V4", to place a sound at the panning point "14" the 75% of said sound evenly divided is sent to channels "V2 and V4" and the 25% of the same sound evenly divided is sent to channels "V1 and V3", to place a sound at panning point "15" the 50% of that sound is sent to channel "V2" and the 50% of the same sound is sent towards channel "V4", to place a sound at the panning point "16" the 25% of said sound is sent to channel "V1" and the 75% of the same sound is sent to channel "V3", to place a sound at the panning point "17" the 75% of said sound is sent to channel "V3" and the 25% of the same sound is sent to channel "V2", to place a sound at the panning point "18" the 75% of said sound evenly divided is sent to channels "V3 and V4" and the 25% of the same sound evenly divided is sent to channels "V1 and V2", to place a sound at the panning point "19" the 25% of said sound is sent to channel "V1" and the 75% of the same sound is sent to channel "V4", to place a sound at the panning point "20" the 25% of said sound is sent to channel "V2" and the 75% of the same sound is sent to channel "V4", to place a sound at the panning point "21" the 100% of said sound is sent only to channel "V3", to place a sound at panning point "22" the 75% of that sound is sent to channel "V3" and the 25% of the same sound is sent to channel "V4", to place a sound at the panning point "23" the 50% of said sound is sent to channel "V3" and the 50% of the same sound is sent to channel "V4", to place a sound at the panning point "24" the 25% of said sound is sent to channel "V3" and the 75% of the same sound is sent to channel "V4", and to place a sound at the panning point "25" the 100% of said sound is sent only to channel "V4".

6. The method for the generation and reproduction of vector panned audio according to claim 2, wherein said pair of physical vector panning controls included in each line or track are part of a physical mixer, said controls being used to place each sound at any of the said 25 panning points, wherein one of the physical vector panning controls serves to define the vertical position of a sound, that is, the position in relation to the "Y" axis of the panoramic field and wherein the other one of the physical vector panning controls serve to define the horizontal position of the same sound, that is, the position in relation to the "X" axis of the panoramic field wherein said controls interact with an electronic circuit as an electronic module to be added to a physical mixer.

7. The method for the generation and reproduction of vector panned audio according to claim 2, wherein said pair of virtual vector panning controls included in each line or track are part of a virtual or digital mixer are used to place each at any of the said 25 panning points, wherein one of the virtual vector panning controls serves to define the vertical position of a sound, that is, the position in relation the "Y" axis of the panoramic field and wherein the other one of the virtual vector panning controls serves to define the horizontal position of the same sound, that is, the position in relation to the "X" axis of the panoramic field, wherein said controls interact with a VST type VST plug-in to be executed in a music sequencer or DAW.

8. The method for the generation and reproduction of vector panned audio according to claim 2, wherein said panoramic field delimited by X and Y axes represents the panoramic field to place any sound, and wherein a physical panning points represent each corner of the said panoramic field, said physical panning points are created with the said audio channels V1, V2, V3 and V4, wherein channel V1 is assigned to a first physical panning point, which represents the upper left corner of the said panoramic field, channel V2 is assigned to a second physical panning point, which represents the upper right corner of the said panoramic field, channel V3 is assigned to a third physical panning point, which represents the lower left corner of the said panoramic field, finally, channel V4 is assigned to a fourth physical panning point, which represents the lower right corner of that panoramic field.

9. The method for the generation and reproduction of vector panned audio according to claim 1, wherein the generation of the vector panned audio is performed in real-time capturing the sounds and its location in a physical space using four microphones placed to form a quadrilateral or quadrangle in the physical space of the set or location to be recorded, that is, a microphone is placed in the upper-left corner, a microphone in the upper-right corner, a microphone in the lower-left corner and another microphone in the lower-right corner, wherein the distance between said microphones should be as wide as the panoramic field to be captured, so that the real sound can be captured with its real location, wherein the microphone placed in the upper-left corner will capture the sound corresponding to the channel V1, the microphone placed in the upper-right corner will capture the sound corresponding to the channel V2, the microphone placed in the lower-left corner will capture the sound corresponding to channel V3 and the microphone placed in the lower-right corner will capture the sound corresponding to channel V4.

10. The method for the generation and reproduction of vector panned audio according to claim 1, wherein the construction of the codified audio format comprises treating the vector panned audio signal to convert it into a specific format through an encoder to transport the codified audio package to a decoder.

11. The method for the generation and reproduction of vector panned audio according to claim 1, wherein said vector panned audio is reproduced through said vector playback equipment to adjust and remix said vector panning, wherein said playback equipment is composed by 4 mono audio playback systems that are disposed to form a quadrilateral or quadrangle in front of the listener, wherein one of the mono audio playback systems called left-down is arranged in the front left part of the listener and at floor height, one of the mono audio playback systems called right-down is arranged in the part front right of the listener and at the height of the floor; where the distance between the listener and the left-down mono audio playback system must be the same between the listener and the right-down mono audio playback system, so if a line was drawn between the listener and said left-down and right-down mono audio playback systems would form an isosceles triangle, additionally, one of the mono audio playback systems called left-up is arranged vertically aligned in relation to the left-down mono audio playback system and at a height delimited by twice the distance between the listener's head and the ground, finally, one of the mono audio playback systems called right-up is arranged vertically aligned in relation to the mono audio playback system called right-down and at a height delimited by twice the distance between the listener's head and the ground;

wherein said 4 mono audio playback systems called left-down, right-down, left-up, and right-up are oriented at an angle in such a way that their direction is towards the position of the listener;

wherein said mono audio playback systems emit their corresponding channel, that is, the mono audio playback system called as left-up emits channel V1, the mono audio playback system called as right-up emits channel V2, the mono audio playback system called as left-down emits channel V3 and the mono audio playback system called as right-down emits channel V4.

12. The method for the generation and reproduction of vector panned audio according to claim 1, wherein said vector panned audio is reproduced through said vector playback equipment to adjust and remix said vector panning, wherein said vector playback equipment is composed by 4 mono audio playback systems that are disposed to form a quadrilateral or quadrangle on the sides of the listener, where one of the mono audio playback systems called left-down is arranged on the left side of the listener and at floor height, one of the mono audio playback systems called right-down is arranged on the right side of the listener and at floor height; wherein the distance between the listener and the left-down mono audio playback system must be the same between the listener and the right-down mono audio playback system, so if a line was drawn between the listener and said left-down and right-down mono audio playback systems would form a straight line, additionally, one of the mono audio playback systems called as left-up is arranged vertically aligned in relation to the left-down mono audio playback system and at a height delimited by twice the distance between the head of the listener and the ground, and one of the mono audio playback systems called right-up is arranged vertically aligned in relation to the mono audio playback system right-down and at a height delimited by twice the distance between the listener's head and the ground;

wherein the left-mono audio playback systems must be directed to their corresponding right-mono audio playback systems, that is, the left-down mono audio playback system must be directed towards the right-down mono audio playback system and vice versa and the left-up mono audio playback system must be directed towards the right-up mono audio playback system and vice versa, in such a way that the sounds collide with each other and with the listener;

wherein said mono audio playback systems emit their corresponding channel, this is, the mono audio playback system called left-up emits channel V1, the mono audio playback system called right-up emits channel V2, the mono audio playback system called left-down emits channel V3 and the mono audio playback system called right-down emits channel V4.

13. The method for the generation and reproduction of vector panned audio according to claim 1, wherein the mono audio playback systems are adjusted in their frequencies depending on their location in relation to the listener.

14. The method for the generation and reproduction of vector panned audio according to claim 1, wherein said vector panned audio is reproduced with said specific format through the another playback equipment, which is composed by a multimedia player that contains a decoder that decodes said vector panned audio previously codified, wherein said multimedia player interacts with 2 Triangular Audio Systems, wherein said triangular audio systems receive the output channels of a vector panned audio, wherein said 4 audio channels V1, V2, V3 and V4 are reproduced through 6 mono audio playback systems;

wherein the multimedia player directs the upper output channels V1 and V2 to the inputs of a first triangular audio system, which will perform a panning value assignment to obtain 3 output audio channels, which will be directed to the audio inputs of the 3 mono audio playback systems of the first triangular audio system, which are placed 1 in the upper front-central part and 2 on the sides of the upper part in relation to the listener, wherein additionally the multimedia player directs the lower audio output channels V3 and V4 to the inputs of a second triangular audio system, which will perform a panning value assignment to obtain 3 audio output channels, which will be directed to the audio inputs of the 3 mono audio playback systems of the second triangular audio system, which are placed 1 in the lower front-central part and 2 in the sides of the lower part in relation to the listener;

wherein a first mono audio playback system called left-down is arranged on the left side of the listener and at floor height, a second mono audio playback system called right-down is arranged on the right side of the listener and at floor height, a third mono audio playback system called left-up is arranged vertically aligned with the left-down mono audio playback system and at a height delimited by twice the distance between the listener's head and the ground, a fourth mono audio playback system called right-up is arranged vertically aligned with the right-down mono audio playback system and at a height delimited by twice the distance between the listener's head and the ground, a fifth mono audio playback system called central-down is arranged in front of the listener and at ground level, it is important to note that the distance between the listener and said central-down mono audio playback system must be the same between the listener and the left-down and right-down mono audio playback systems, a sixth mono audio playback system called central-up is arranged vertically aligned in relation to the center-down mono audio playback system and at a height delimited by twice the distance between the listener's head and the ground;

wherein said 6 mono audio playback systems left-down, right-down, left-up, right-up, central-down, and central-up have the same distance in relation to the head of the listener and said 6 mono audio playback systems should be directed towards the listener.

15. A system for generation and reproduction of vector panned audio to change a sound dimension and produce an enveloping experience in a physical space of a listener, the system comprising:

a) A physical or virtual mixer that contains a pair of vector panning controls to generate a vector panned audio based on a vector panning table;

b) A vector playback equipment that reproduces said vector panned audio to adjust and remix said vector panned audio, wherein said vector playback equipment is composed by 4 mono audio playback systems, wherein each of said 4 mono audio playback systems has a frequency adjustment depending on its location and wherein said mono audio playback systems are placed to form a quadrilateral or quadrangle in front of the listener or at the sides of the listener, two on the up part and two on the bottom part; wherein said mono audio playback system reproduces its corresponding audio channel V1, V2, V3 or V4;

c) An encoder that creates a specific audio format for said vector panned audio to allows its multimedia playback;

d) A second playback equipment that reproduces said audio with said specific audio format, wherein said second playback equipment includes a multimedia player that contains an audio decoder, 2 Triangular Audio Systems and 6 mono audio playback systems, wherein each of said 6 mono audio playback systems has a frequency adjustment depending on its location and wherein said mono audio playback systems are placed with 3 on the upper part in relation to the listener and 3 on the bottom part in relation to the listener to produce an enveloping experience.

16. The system for the generation and reproduction of vector panned audio according to claim 15, which comprises a wherein said pair of vector panning controls is a pair of physical controls for vector panning included in each line or track, that is, a pair of physical controls that are included on a physical mixer, wherein said controls are used to place each sound in any of the said 25 panning points based on said vector panning table, wherein to place a sound at panning point "1" the 100% of a sound is sent only to channel "V1", to place a sound at panning point "2" the 75% of said sound is sent to channel "V1" and the 25% of the same sound is sent to channel "V2", to place a sound at panning point "3" the 50% of said sound is sent to channel "V1" and the 50% of the same sound is sent to channel "V2", to place a sound at panning point "4" the 25% of said sound is sent to channel "V1" and the 75% of the same sound is sent to channel "V2", to place a sound at panning point "5" the 100% of that sound is sent to channel "V2" only, to place a sound at the panning point "6" the 75% of that sound is sent to the channel "V1" and the 25% of the same sound is sent to channel "V3", to place a sound at the panning point "7" the 75% of said sound is sent to channel "V1" and the 25% of the same sound is sent to channel "V4", to place a sound at panning point "8" the 75% of that sound evenly divided is sent towards channels "V1 and V2" and the 25% of the same sound evenly divided is sent towards channels "V3 and V4", to place a sound at the panning point "9" the 75% of said sound is sent to channel "V2" and the 25% of the same sound is sent to channel "V3", to place a sound at the panning point "10" the 75% of said sound is sent to channel "V2" and the 25% of the same sound is sent to channel "V4", to place a sound at the panning point "11" the 50% of said sound is sent to channel "V1" and the 50% of the same sound is sent to channel "V3", to place a sound at panning point "12" the 75% of that sound evenly divided is sent to channels "V1 and V3" and the 25% of the same sound evenly divided is sent to channels "V2 and V4", to place a sound at panning pint "13" the 50% of that sound evenly divided is sent to channels "V1" and "V2" and the 50% of the same sound evenly divided is sent to channels "V3" and "V4", to place a sound at the panning point "14" the 75% of said sound evenly divided is sent to channels "V2 and V4" and the 25% of the same sound evenly divided is sent to channels "V1 and V3", to place a sound at panning point "15" the 50% of that sound is sent to channel "V2" and the 50% of the same sound is sent towards channel "V4", to place a sound at the panning point "16" the 25% of said sound is sent to channel "V1" and the 75% of the same sound is sent to channel "V3", to place a sound at the panning point "17" the 75% of said sound is sent to channel "V3" and the 25% of the same sound is sent to channel "V2", to place a sound at the panning point "18" the 75% of said sound evenly divided is sent to channels "V3 and V4" and the 25% of the same sound evenly divided is sent to channels "V1 and V2", to place a sound at the panning point "19" the 25% of said sound is sent to channel "V1" and the 75% of the same sound is sent to channel "V4", to place a sound at the panning point "20" the 25% of said sound is sent to channel "V2" and the 75% of the same sound is sent to channel "V4", to place a sound at the panning point "21" the 100% of said sound is sent only to channel "V3", to place a sound at panning point "22" the 75% of that sound is sent to channel "V3" and the 25% of the same sound is sent to channel "V4", to place a sound at the panning point "23" the 50% of said sound is sent to channel "V3" and the 50% of the same sound is sent to channel "V4", to place a sound at the panning point "24" the 25% of said sound is sent to channel "V3" and the 75% of the same sound is sent to channel "V4", and to place a sound at the panning point "25" the 100% of said sound is sent only to channel "V4", wherein one of the physical controls serves to define a vertical position of a sound, that is, the position in relation to the "Y" axis of the panoramic field and the other one of the physical controls serves to define a horizontal position of the same sound, that is, the position in relation to the "X" axis of the panoramic field; wherein said controls interact with an electronic circuit as an electronic module to be added to a physical mixer;

wherein said pair of physical controls for vector panning are integrated into an electronic circuit, which comprises:

i) at least one input channel "channel in 1" that receives an audio signal of an audio track from a physical mixer of N number of channels represented by tracks; ii) a VR1 (Variable Resistors) that receives the audio signal to give a voltage represented by the concept of audio signal volume at the input of the preamplifier which in turn increases the audio signal from 6 to 12 db; iii) 2 coupling capacitors C1 and C2 in which said preamplified signal is divided into two different panning directions, a vertical panning and a horizontal panning; iiii) 2 different VR (Variable Resistors) connection modules coupled with said coupling capacitors, one for vertical panning control and the other for horizontal panning control; 5) a vertical panning control composed by 4 VR (Variable Resistors) (VR2, VR3, VR4, VR5) interconnected, to be able to move at the same time to each other as they are controlled under the same axis but with different polarities; and 4 impedance coupling resistors R1, R2, R3, R4 connected in parallel input, wherein when the audio signal is output from the coupling capacitor C1 it is divided into the 4 impedance coupling resistors towards VR2, VR3, VR4, VR5 interconnected by the same axis but with different polarities, achieving with this, that while the VR3 and VR4 raise the audio signal to the LV and RV audio output points, the VR2 and VR5 lower the signal from the audio output points, LH and RH audio output to ground, thereby achieving a compensation and reduction of the audio signals towards the different LV, RV, LH, RH audio output points; 6) a horizontal pan control composed of 4 VR (Variable Resistance) (VR6, VR7, VR8, VR9) interconnected, to be able to move at the same time to each other as they are controlled under the same axis but with different polarities, and 4 resistors of coupling of impedances R5, R6, R7, R8 connected in parallel input, wherein when leaving the audio signal from the coupling capacitor C2 it is divided into the 4 coupling resistors of impedances towards the VR6, VR7, VR8, VR9 interconnected with each other on the same axis but with different polarities, achieving with this, that while the VR7 and VR8 raise the audio signal to the audio output points L-H and R-H, the VR6 and VR9 lower the signal to ground of the audio output points L-V and R-V thus achieving a compensation and reduction of the audio signals towards the different audio output points L-V, R-V, L-H, R-H;

wherein, said physical panning controls can also be executed by means of an integrated circuit, which comprises:

wherein the preamplified signal passes to an integrated circuit that will be in charge of generating a circuit inside making use of the variable resistors VR2, VR3, VR4, VR5, wherein said variable resistors have the L-V, R-V, L-H, R-H outputs at their ends, and wherein the audio signal point comes out with their respective offsets and attenuations.

17. The system for the generation and reproduction of vector panned audio according to claim 15, wherein said pair of vector panning controls is a pair of virtual vector panning controls included in each line or track, that is, a pair of virtual vector panning controls that are included in a virtual or digital mixer, wherein said controls are used to place each sound in any of 25 panning points, wherein to place a sound at panning point "1" the 100% of a sound is sent only to channel "V1", to place a sound at panning point "2" the 75% of said sound is sent to channel "V1" and the 25% of the same sound is sent to channel "V2", to place a sound at panning point "3" the 50% of said sound is sent to channel "V1" and the 50% of the same sound is sent to channel "V2", to place a sound at panning point "4" the 25% of said sound is sent to channel "V1" and the 75% of the same sound is sent to channel "V2", to place a sound at panning point "5" the 100% of that sound is sent to channel "V2" only, to place a sound at the panning point "6" the 75% of that sound is sent to the channel "V1" and the 25% of the same sound is sent to channel "V3", to place a sound at the panning point "7" the 75% of said sound is sent to channel "V1" and the 25% of the same sound is sent to channel "V4", to place a sound at panning point "8" the 75% of that sound evenly divided is sent towards channels "V1 and V2" and the 25% of the same sound evenly divided is sent towards channels "V3 and V4", to place a sound at the panning point "9" the 75% of said sound is sent to channel "V2" and the 25% of the same sound is sent to channel "V3", to place a sound at the panning point "10" the 75% of said sound is sent to channel "V2" and the 25% of the same sound is sent to channel "V4", to place a sound at the panning point "11" the 50% of said sound is sent to channel "V1" and the 50% of the same sound is sent to channel "V3", to place a sound at panning point "12" the 75% of that sound evenly divided is sent to channels "V1 and V3" and the 25% of the same sound evenly divided is sent to channels "V2 and V4", to place a sound at panning pint "13" the 50% of that sound evenly divided is sent to channels "V1" and "V2" and the 50% of the same sound evenly divided is sent to channels "V3" and "V4", to place a sound at the panning point "14" the 75% of said sound evenly divided is sent to channels "V2 and V4" and the 25% of the same sound evenly divided is sent to channels "V1 and V3", to place a sound at panning point "15" the 50% of that sound is sent to channel "V2" and the 50% of the same sound is sent towards channel "V4", to place a sound at the panning point "16" the 25% of said sound is sent to channel "V1" and the 75% of the same sound is sent to channel "V3", to place a sound at the panning point "17" the 75% of said sound is sent to channel "V3" and the 25% of the same sound is sent to channel "V2", to place a sound at the panning point "18" the 75% of said sound evenly divided is sent to channels "V3 and V4" and the 25% of the same sound evenly divided is sent to channels "V1 and V2", to place a sound at the panning point "19" the 25% of said sound is sent to channel "V1" and the 75% of the same sound is sent to channel "V4", to place a sound at the panning point "20" the 25% of said sound is sent to channel "V2" and the 75% of the same sound is sent to channel "V4", to place a sound at the panning point "21" the 100% of said sound is sent only to channel "V3", to place a sound at panning point "22" the 75% of that sound is sent to channel "V3" and the 25% of the same sound is sent to channel "V4", to place a sound at the panning point "23" the 50% of said sound is sent to channel "V3" and the 50% of the same sound is sent to channel "V4", to place a sound at the panning point "24" the 25% of said sound is sent to channel "V3" and the 75% of the same sound is sent to channel "V4", and to place a sound at the panning point "25" the 100% of said sound is sent only to channel "V4", wherein one of the virtual vector panning controls serves to define a vertical position of a sound, that is, the position in relation to the "Y" axis of the panoramic field, and the other one of the virtual vector panning controls serves to define a horizontal position of the same sound, that is, the position in relation to the "X" axis of the panoramic field; wherein said controls interact with a VST type VST plug-in to be executed in the confines of a music sequencer or DAW.

18. The system for the generation and reproduction of vector panned audio according to claim 15, wherein said vector playback equipment reproduces said audio to adjust and remix said vector panning, wherein said playback equipment is composed by 4 mono audio playback systems that are arranged to form a quadrilateral or quadrangle in front of the listener, wherein one of the Mono audio playback systems called left-down is arranged on the front left of the listener and at floor height, one of the mono audio playback systems called right-down is arranged on the front right of the listener and at floor height; wherein the distance between the listener and the left-down mono audio playback system must be the same between the listener and the right-down mono audio playback system, so if a line was drawn between the listener and said left-down and right-down mono audio playback systems would form an isosceles triangle, additionally, one of the mono audio playback systems called left-up is arranged vertically aligned in relation to the left-down mono audio playback system and at a height delimited by twice the distance between the head of the listener and the ground, finally, one of the mono audio playback systems called right-up is arranged vertically aligned in relation to the mono audio playback system right-down and at a height delimited by twice the distance between the listener's head and the ground;

wherein said 4 mono audio playback systems called left-down, right-down, left-up, and right-up are oriented at an angle in such a way that their direction is towards the position of the listener;

wherein said mono audio playback systems emit their corresponding channel, that is, the mono audio playback system called left-up emits channel V1, the mono audio playback system called right-up emits channel V2, the mono audio playback system called left-down emits channel V3 and the mono audio playback system called right-down emits channel V4, wherein the mono audio playback systems are adjusted in their frequencies depending on its location in relation to the listener.

19. The system for the generation and reproduction of vector panned audio according to claim 15, wherein said vector playback equipment reproduces said audio to adjust and remix said vector panning, wherein said playback equipment is composed by 4 mono audio playback systems that are arranged to form a quadrilateral or quadrangle on the sides of the listener, wherein one of the mono audio playback systems called left-down is arranged on the left side of the listener and at floor height, one of the mono audio playback systems called right-down is arranged on the right side of the listener and at floor height; wherein the distance between the listener and the left-down mono audio playback system must be the same between the listener and the right-down mono audio playback system, so if a line was drawn between the listener and said left-down and right-down mono audio playback systems would form a straight line, additionally, one of the mono audio playback system named as left-up is arranged vertically aligned relative to the left-down mono audio playback system and at a height delimited by twice the distance between the listener's head and the ground, wherein one of the mono audio playback systems called right-up is arranged vertically aligned in relation to the mono audio playback system right-down and at a height delimited by twice the distance between the listener's head and the ground;

wherein the left mono audio playback systems must be directed to their corresponding right mono audio playback systems, that is, the left-down mono audio playback system must be directed towards the right-down mono audio playback system and vice versa and the left-up mono audio playback system must be directed towards the right-up mono audio playback system and vice versa, in such a way that the sounds collide with each other and with the listener;

wherein said mono audio playback systems emit their corresponding channel, that is, the mono audio playback system called left-up emits channel V1, the mono audio playback system called right-up emits channel V2, the mono audio playback system called left-down emits channel V3 and the mono audio playback system called right-down emits channel V4, wherein the mono audio playback systems are adjusted in their frequencies depending on their location in relation to the listener.

20. The system for the generation and reproduction of vector panned audio according to claim 15, which comprises an encoder that treats the vector panned audio signal to give it a specific format, wherein said encoded audio specific format is necessary to transport the codified audio package to a decoder.

21. The system for the generation and reproduction of vector panned audio according to claim 15, wherein the second playback equipment that reproduces said audio with specific format comprises a multimedia player that includes a decoder that decodes said vector panned audio previously codified, and wherein said multimedia player interacts with 2 Triangular Audio Systems, that receive the output channels of a vector panned audio, wherein said 4 audio channels V1, V2, V3 and V4 are reproduced through 6 mono audio playback systems;

and wherein the multimedia player directs the upper output channels V1 and V2 to the inputs of a first triangular audio system, which will perform a panning value assignment to obtain 3 output audio channels, which will be directed to the audio inputs of the 3 mono audio playback systems of the first triangular audio system, which are placed 1 in the upper front-central part and 2 on the sides of the upper part in relation to the listener, wherein additionally the multimedia player directs the lower audio output channels V3 and V4 to the inputs of a second triangular audio system, which will perform a panning value assignment to obtain 3 audio output channels, which will be directed to the second 3 mono audio playback systems, which are placed 1 in the lower front-central part and 2 in the sides of the lower part in relation to the listener;

wherein a first mono audio playback system called left-down is arranged on the left side of the listener and at floor height, a second mono audio playback system called right-down is arranged on the right side of the listener and at floor height, and a third mono audio playback system called left-up is arranged vertically aligned with the left-down mono audio playback system and at a height delimited by twice the distance between the listener's head and the ground, a fourth mono audio playback system called right-up is arranged vertically aligned with the right-down mono audio playback system and at a height delimited by twice the distance between the listener's head and the ground; a fifth mono audio playback system called central-down is arranged in front of the listener and at ground level, it is important to note that the distance between the listener and said central-down mono audio playback system must be the same between the listener and the left-down and right-down mono audio playback systems, a sixth mono audio playback system called central-up is arranged vertically aligned in relation to the center-down mono audio playback system and at a height delimited by twice the distance between the listener's head and the ground;

wherein said 6 mono audio playback systems left-down, right-down, left-up, right-up, central-down, and central-up have the same distance in relation to the head of the listener and said 6 mono audio playback systems should be directed towards the listener, wherein the mono audio playback systems are adjusted in their frequencies depending on its location in relation to the listener.

* * * * *